US010676850B2

(12) United States Patent
Kweon et al.

(10) Patent No.: US 10,676,850 B2
(45) Date of Patent: Jun. 9, 2020

(54) WASHING MACHINE AND METHOD FOR CONTROLLING THE SAME

(71) Applicant: Samsung Electronics Co., Ltd, Gyeonggi-do (KR)

(72) Inventors: Soon Cheol Kweon, Seoul (KR); Hee Jin Park, Gyeonggi-do (KR); Young Uk Yun, Gyeonggi-do (KR); Seung Eun Chung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 369 days.

(21) Appl. No.: 15/512,061

(22) PCT Filed: Aug. 31, 2015

(86) PCT No.: PCT/KR2015/009152

§ 371 (c)(1),
(2) Date: Mar. 16, 2017

(87) PCT Pub. No.: WO2016/043452

PCT Pub. Date: Mar. 24, 2016

(65) Prior Publication Data

US 2017/0254011 A1 Sep. 7, 2017

(30) Foreign Application Priority Data

Sep. 16, 2014 (KR) ..... 10-2014-0122616

(51) Int. Cl.
*D06F 33/02* (2006.01)
*D06F 37/04* (2006.01)
(Continued)

(52) U.S. Cl.
CPC ..... *D06F 33/02* (2013.01); *D06F 37/04* (2013.01); *D06F 37/32* (2013.01); *D06F 39/02* (2013.01);
(Continued)

(58) Field of Classification Search
CPC ..... D06F 33/02; D06F 39/088; D06F 39/087; D06F 39/083; D06F 37/32; D06F 37/04;
(Continued)

(56) References Cited

U.S. PATENT DOCUMENTS

2008/0134727 A1* 6/2008 May ..... G01D 5/145 68/12.02
2010/0205826 A1 8/2010 Ashrafzadeh et al.
2013/0160216 A1 6/2013 Buendia et al.

FOREIGN PATENT DOCUMENTS

DE 19819554 A1 11/1999
JP 9173696 A 7/1997
(Continued)

OTHER PUBLICATIONS

Machine Translation of JP 2009-165683 to Furubayashi et al, Jul. 2009. (Year: 2009).*
(Continued)

*Primary Examiner* — Benjamin L Osterhout

(57) ABSTRACT

A washing machine may include a drum rotationally arranged for containing laundry, a motion detector configured to detect a motion of the laundry, and a controller configured to control rotation speed of the drum based on the detected motion such that the laundry shows a predetermined motion.

20 Claims, 34 Drawing Sheets

(51) Int. Cl.

| | |
|---|---|
| ***D06F 39/08*** | (2006.01) |
| ***D06F 39/02*** | (2006.01) |
| ***D06F 37/30*** | (2020.01) |
| ***D06F 37/32*** | (2006.01) |
| *D06F 37/36* | (2006.01) |
| *D06F 39/14* | (2006.01) |

(52) U.S. Cl.
CPC ..... *D06F 39/083* (2013.01); *D06F 39/087* (2013.01); *D06F 39/088* (2013.01); *D06F 37/304* (2013.01); *D06F 37/36* (2013.01); *D06F 39/14* (2013.01); *D06F 2202/06* (2013.01); *D06F 2202/065* (2013.01); *D06F 2202/10* (2013.01); *D06F 2204/06* (2013.01); *D06F 2204/065* (2013.01); *D06F 2222/00* (2013.01)

(58) Field of Classification Search
CPC ..... D06F 39/02; D06F 37/304; D06F 37/36; D06F 2202/06; D06F 2202/10; D06F 2204/06; D06F 39/14; D06F 2202/65
See application file for complete search history.

(56) References Cited

FOREIGN PATENT DOCUMENTS

| | | | |
|---|---|---|---|
| JP | 2009165683 | A | 7/2009 |
| KR | 1020100031865 | A | 3/2010 |
| KR | 1020100094683 | A | 8/2010 |
| KR | 1020110016311 | A | 2/2011 |

OTHER PUBLICATIONS

European Patent Office, "Supplementary European Search Report," Application No. EP 15 84 2002, dated Aug. 1, 2017, 8 pages.
Communication under Rule 71(3) EPC dated Aug. 20, 2018 in connection with European Patent Application No. 15 842 002.6, 95 pages.
International Search Report dated Oct. 30, 2015 in connection with International Application No. PCT/KR2015/009152, 5 pages.
Written Opinion of the International Searching Authority dated Oct. 30, 2015 in connection with International Application No. PCT/KR2015/009152, 6 pages.

* cited by examiner

[Fig. 1]
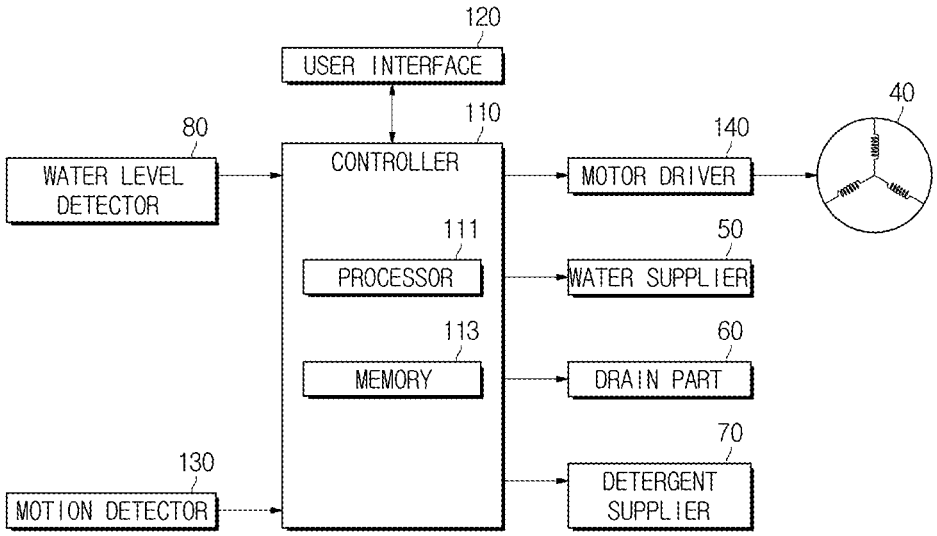
[Fig. 2]
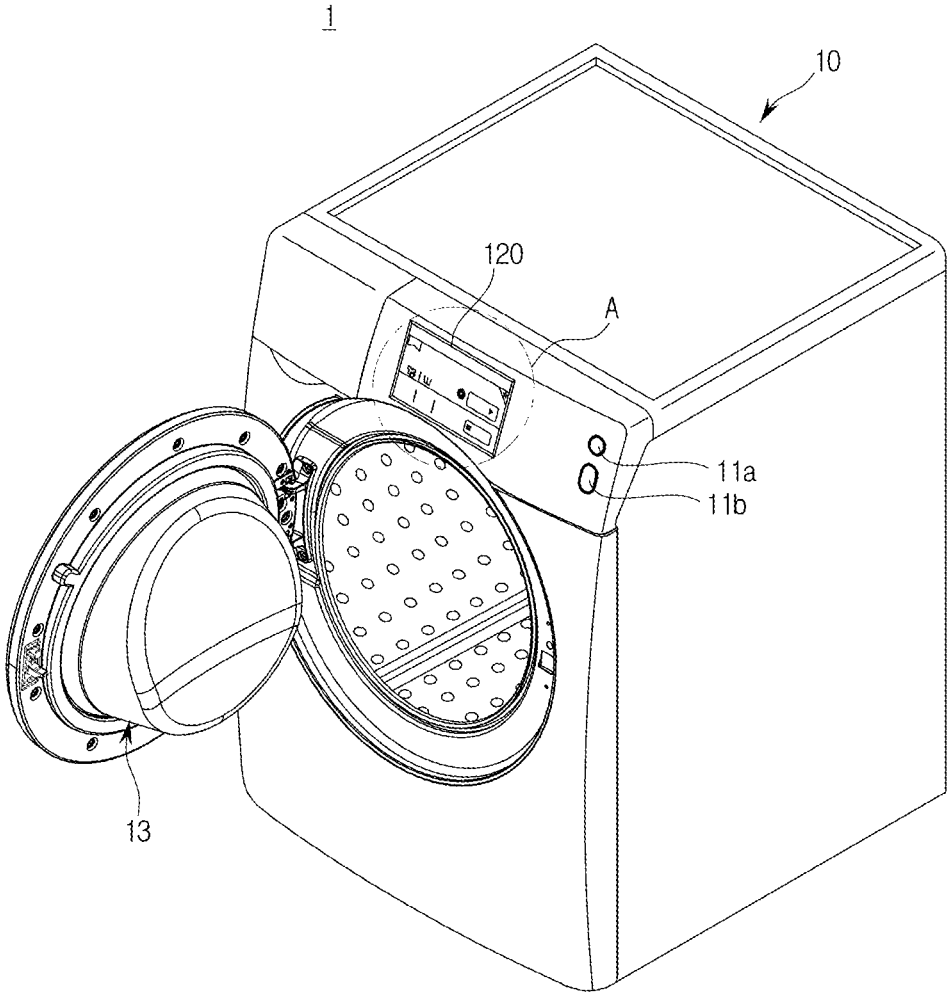

[Fig. 3]
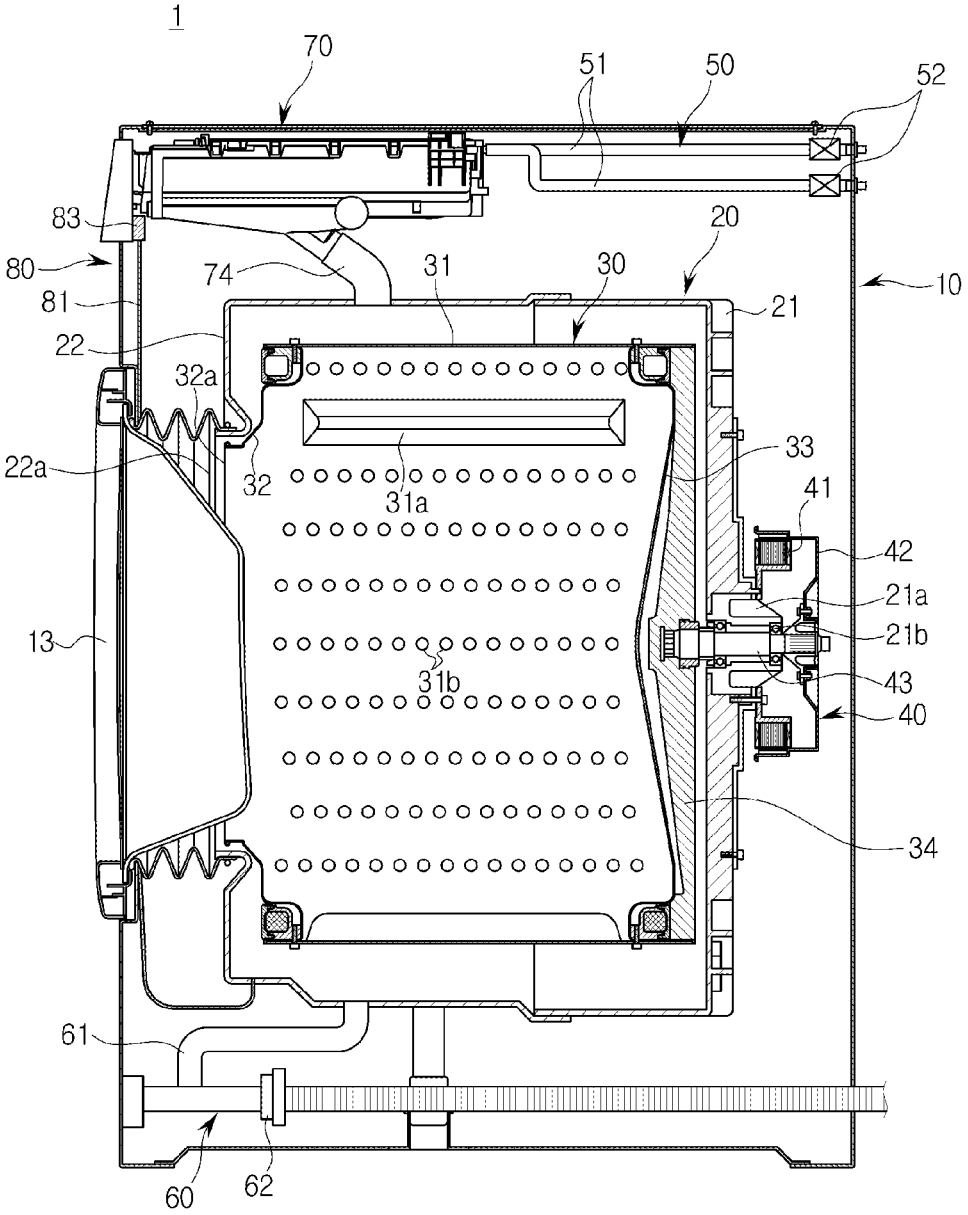

[Fig. 4]
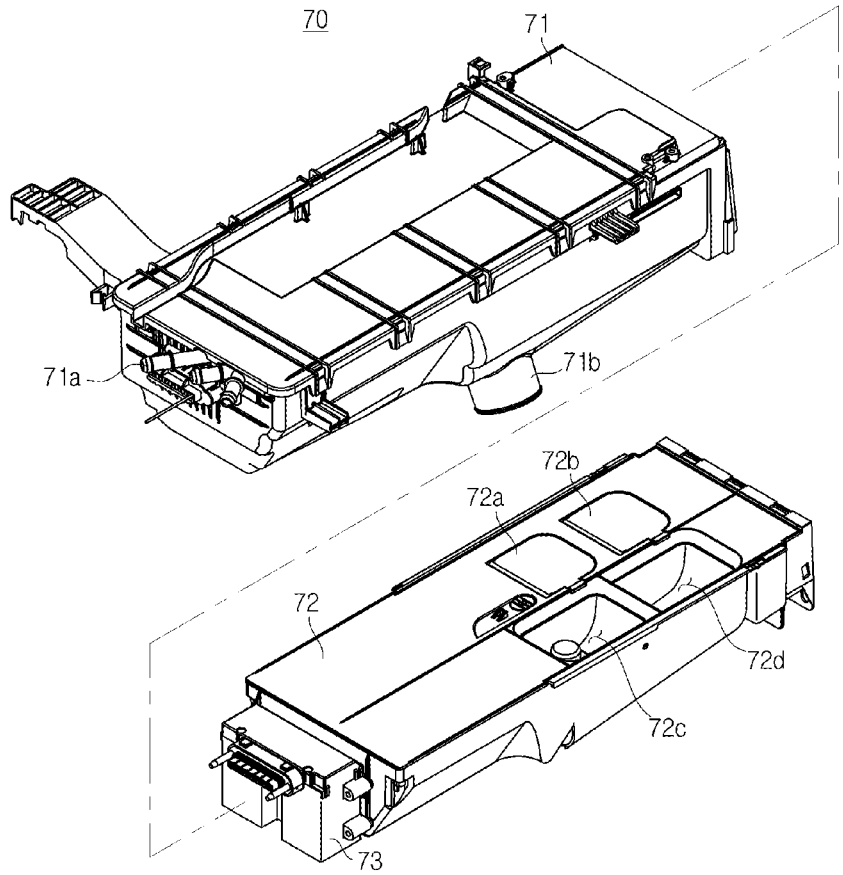
[Fig. 5]
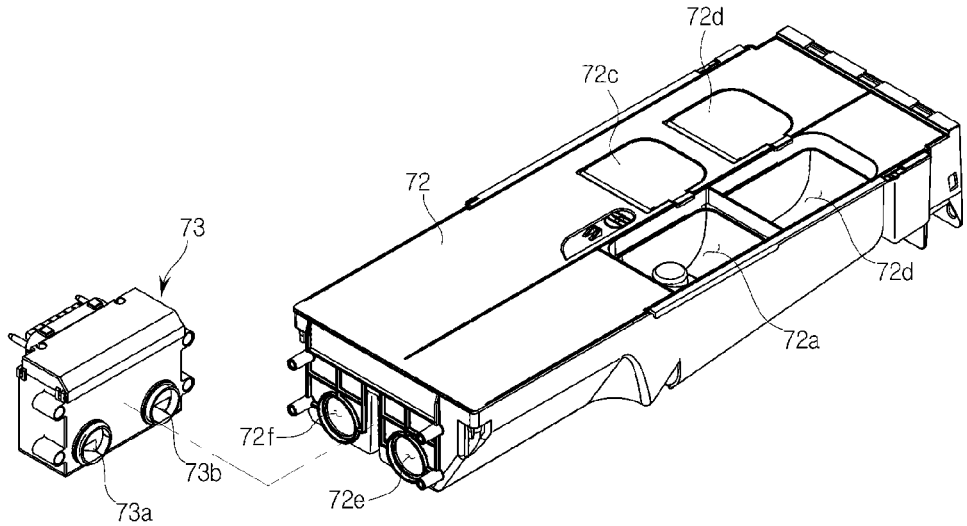

[Fig. 6]
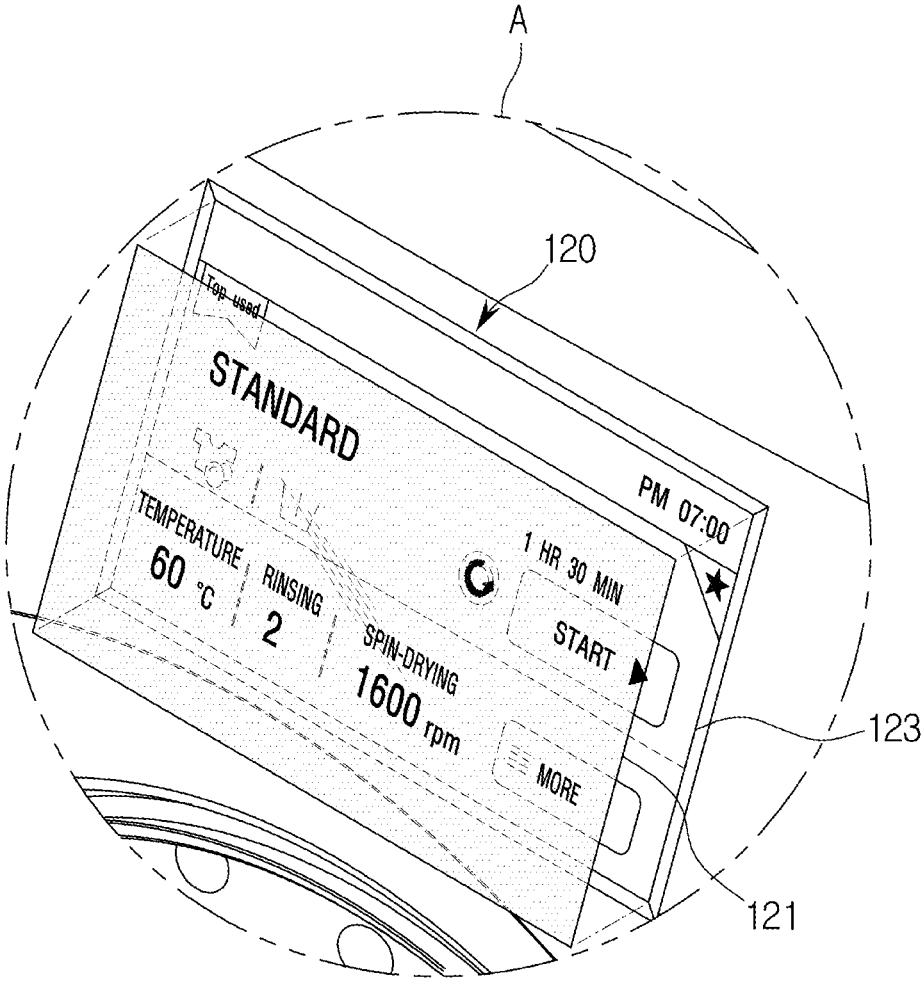

[Fig. 7]
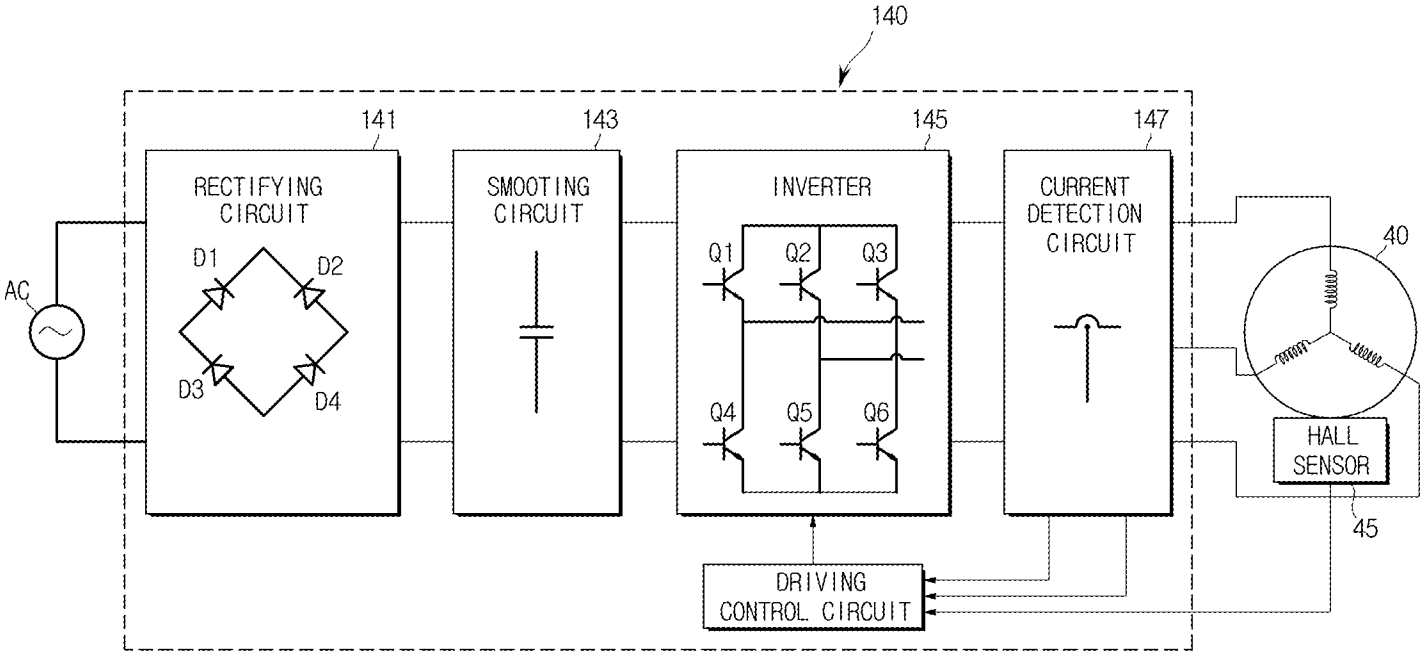

[Fig. 8]
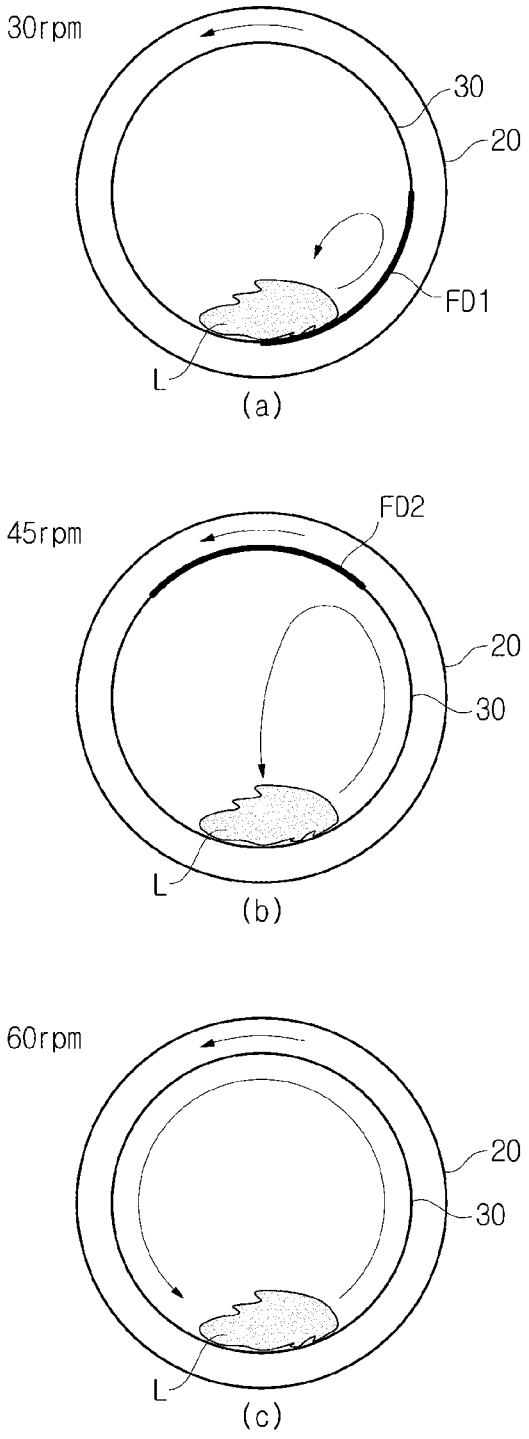

[Fig. 9]
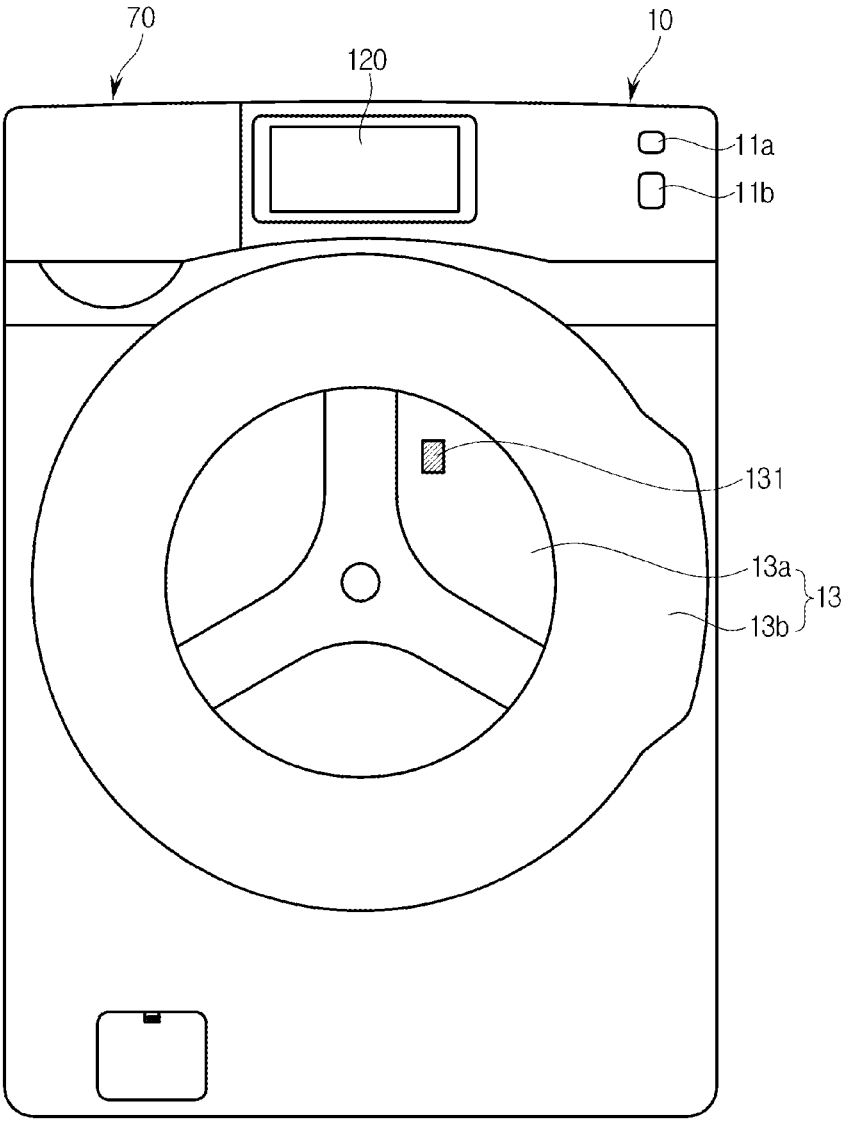

[Fig. 10]
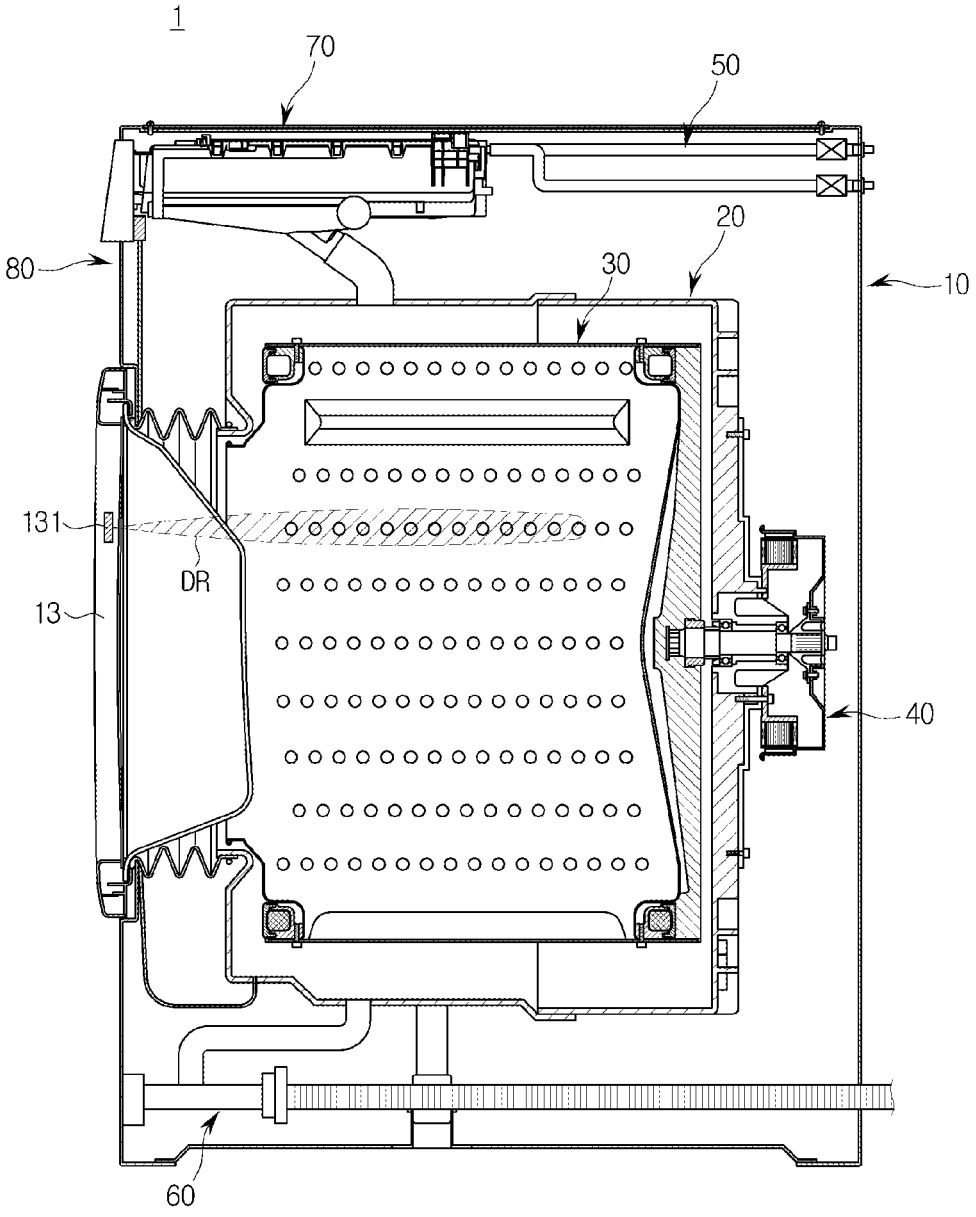

[Fig. 11]
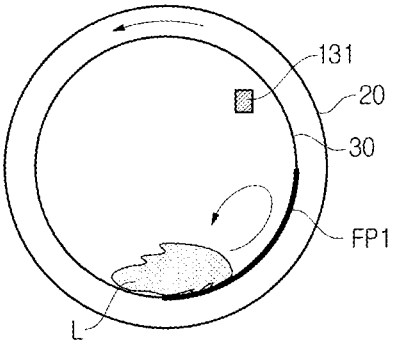
(a)
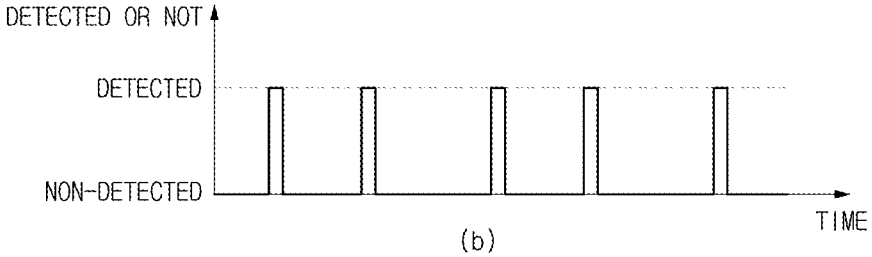
(b)
[Fig. 12]
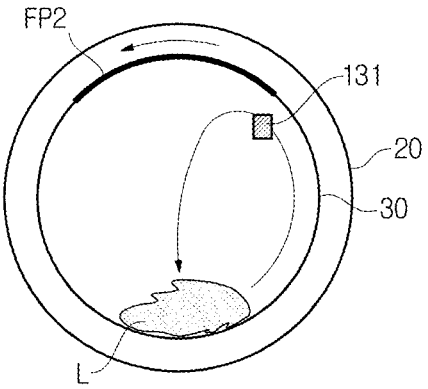
(a)
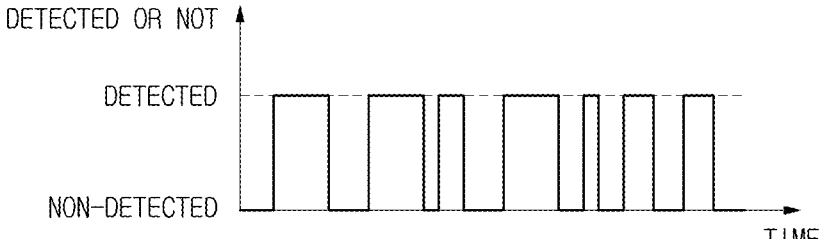
(b)

[Fig. 13]
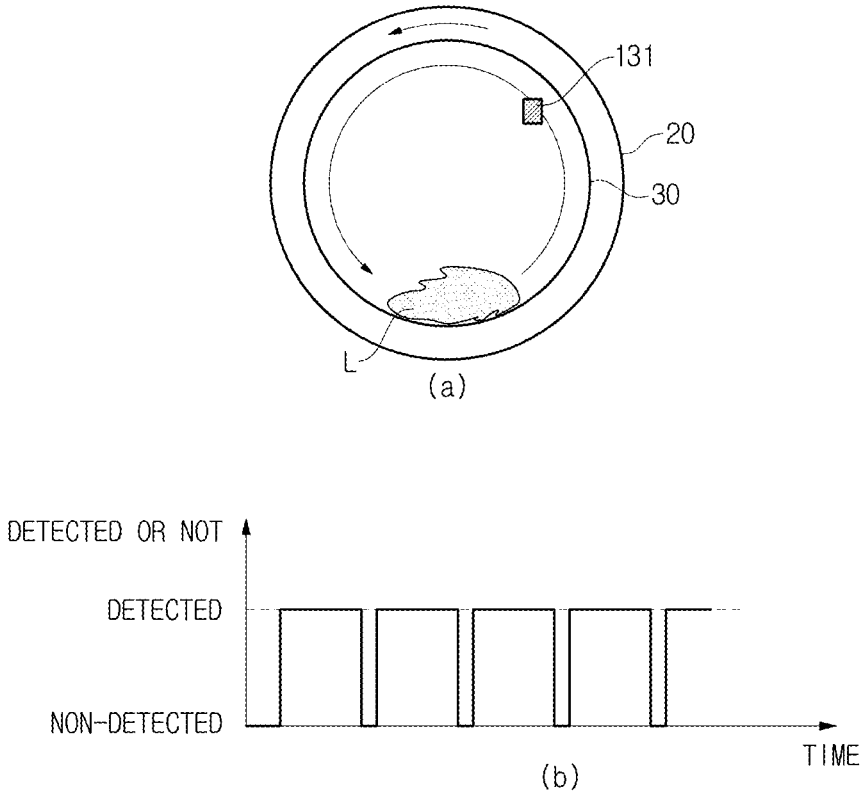
[Fig. 14]
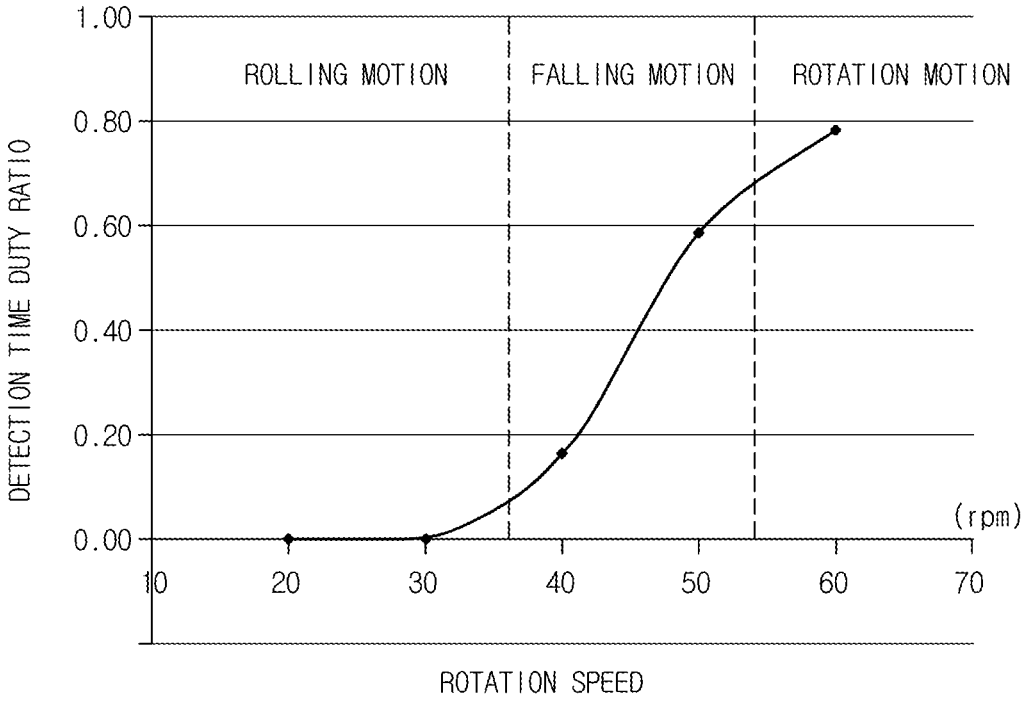

[Fig. 15]
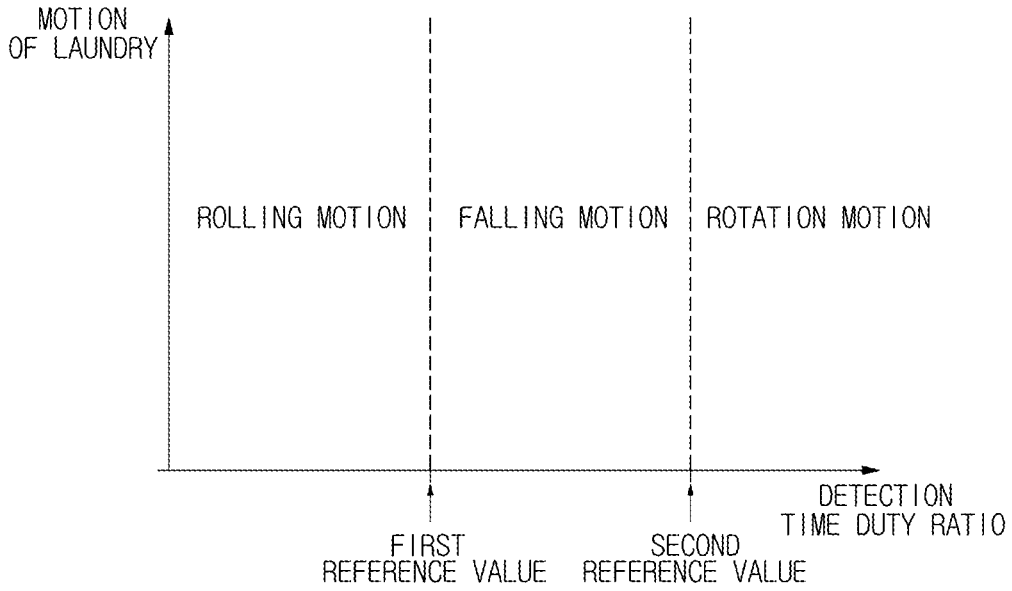
[Fig. 16]
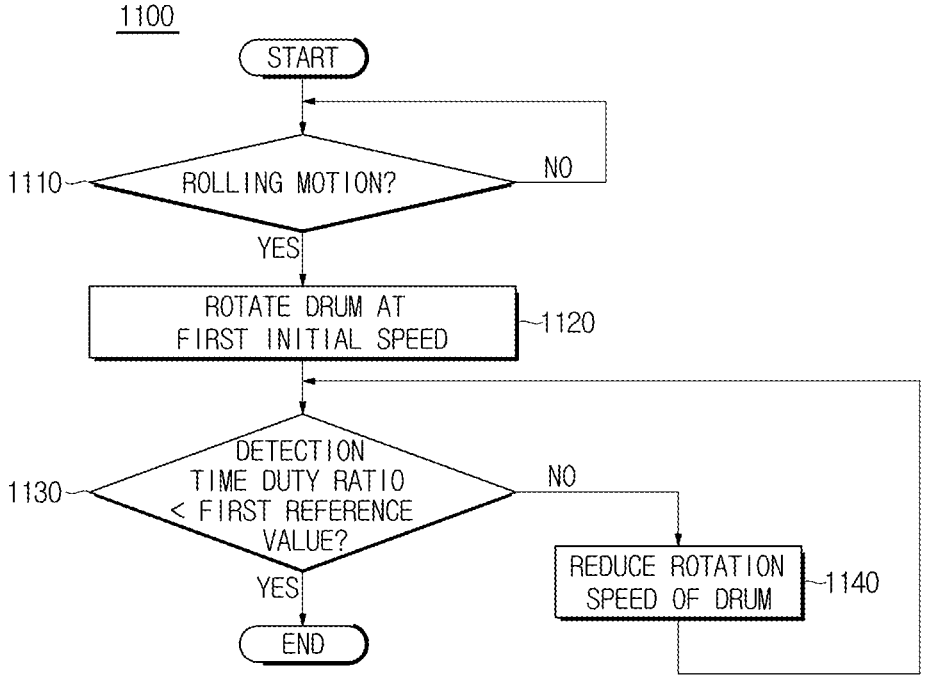

[Fig. 17]
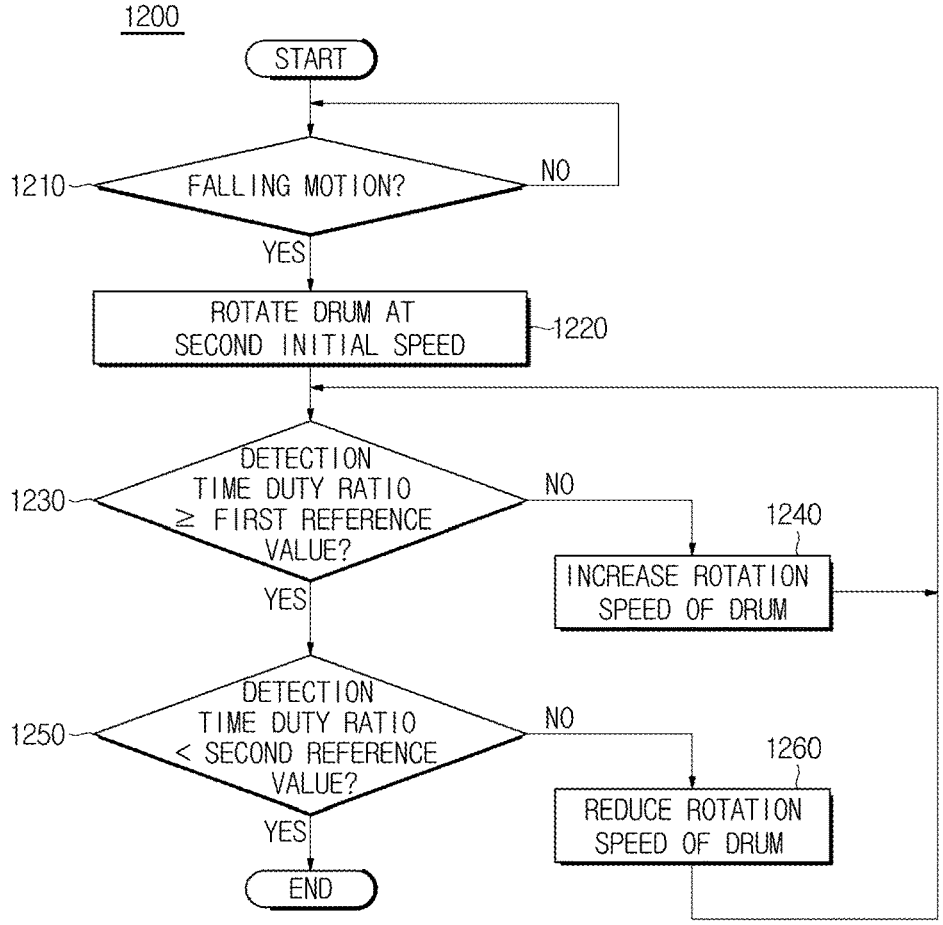
[Fig. 18]
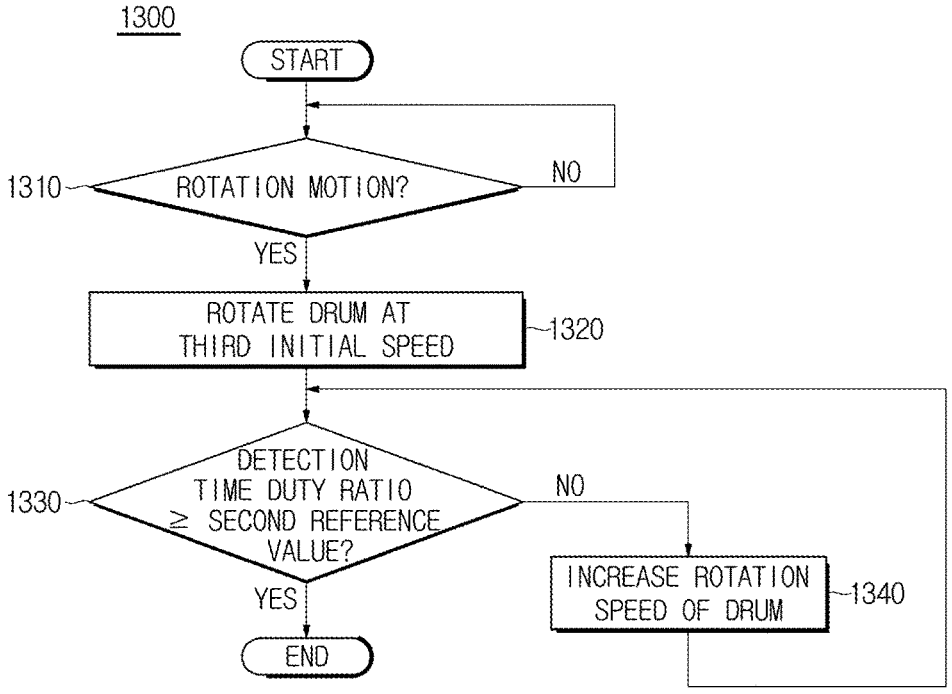

[Fig. 19]
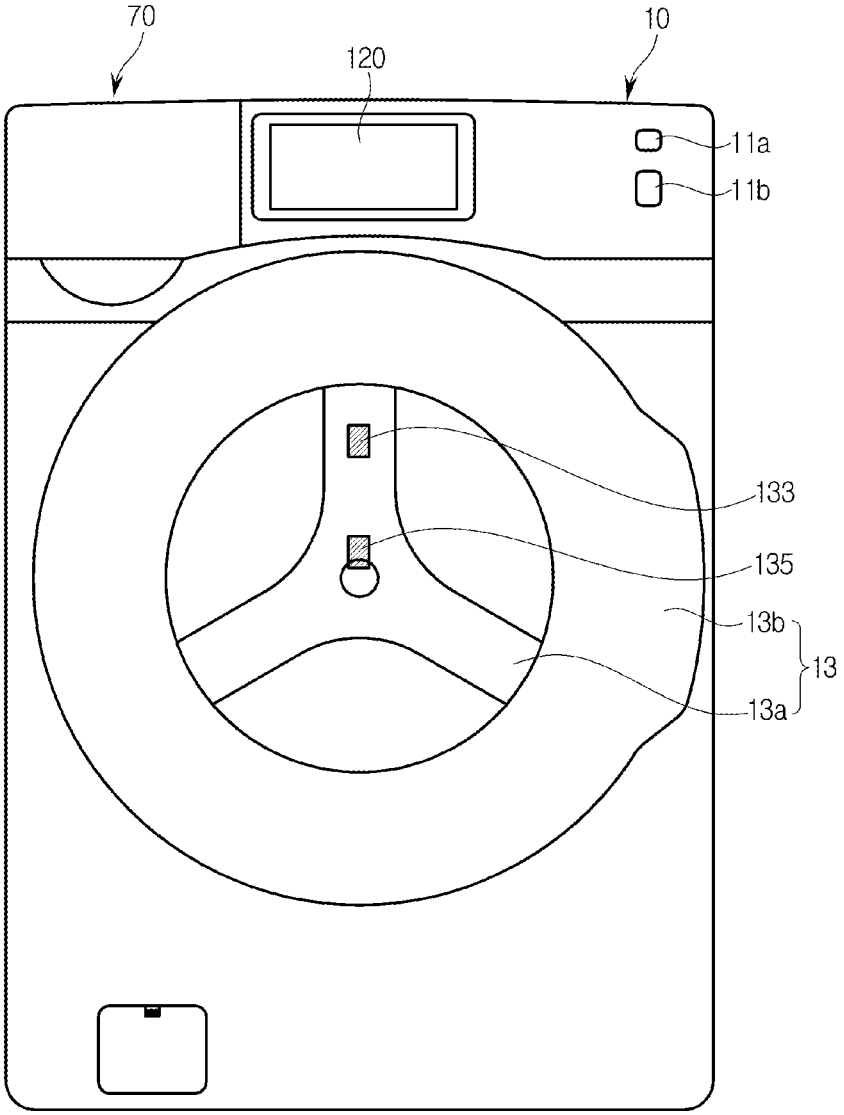

[Fig. 20]
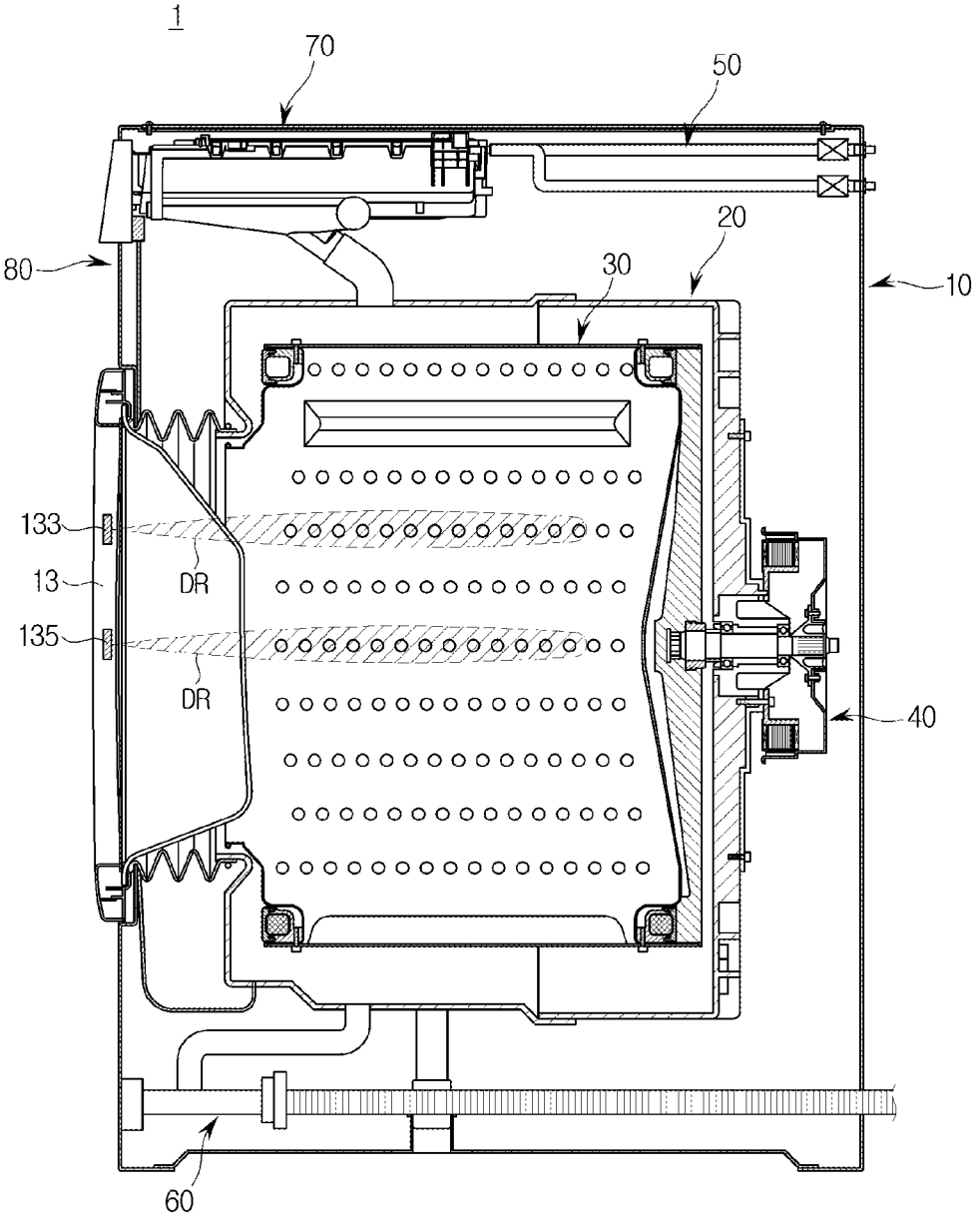

[Fig. 21]
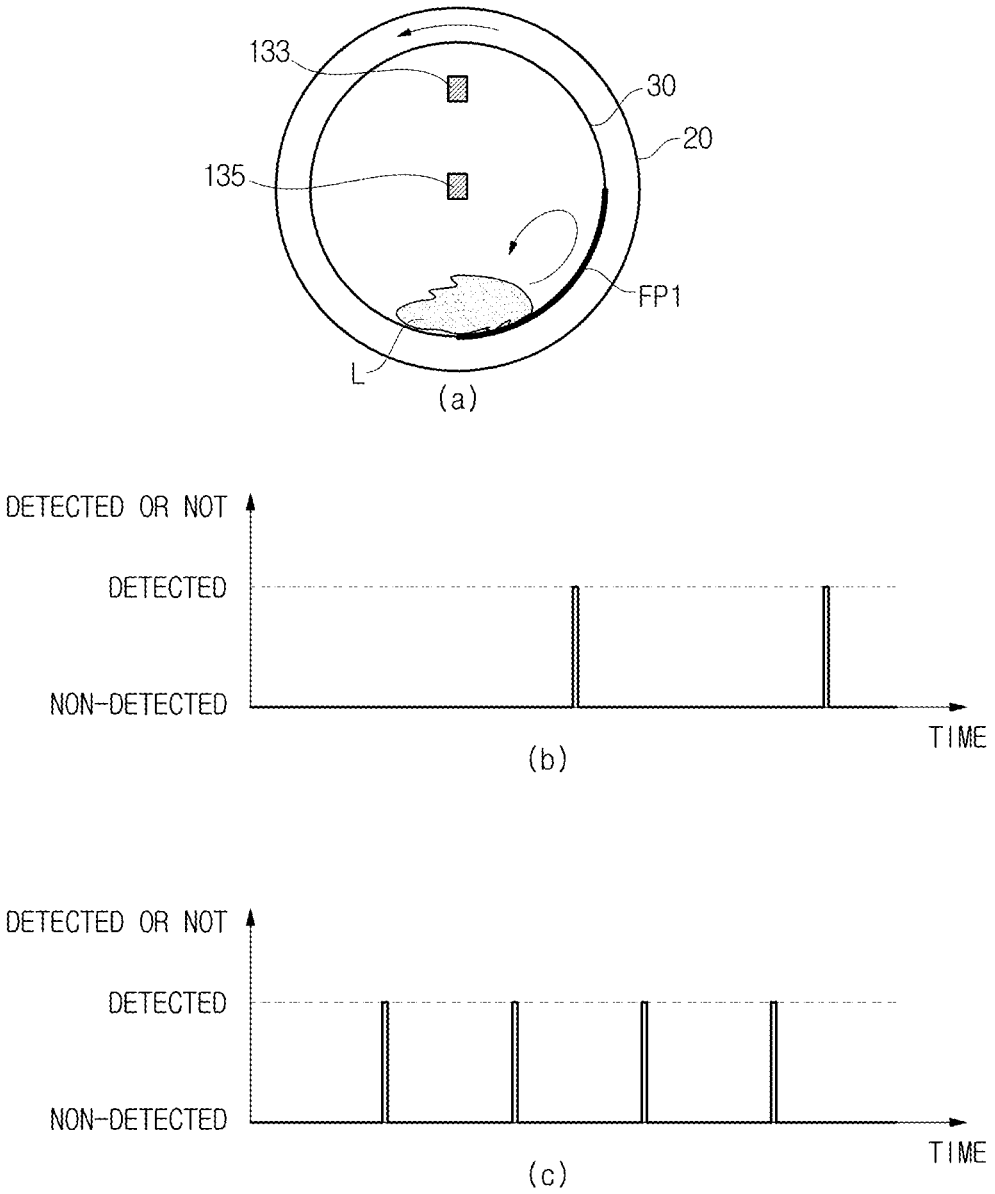

[Fig. 22]
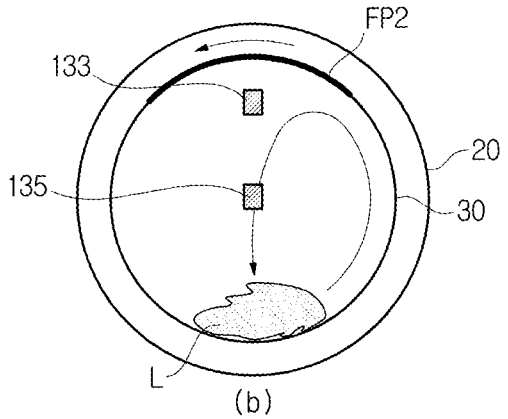
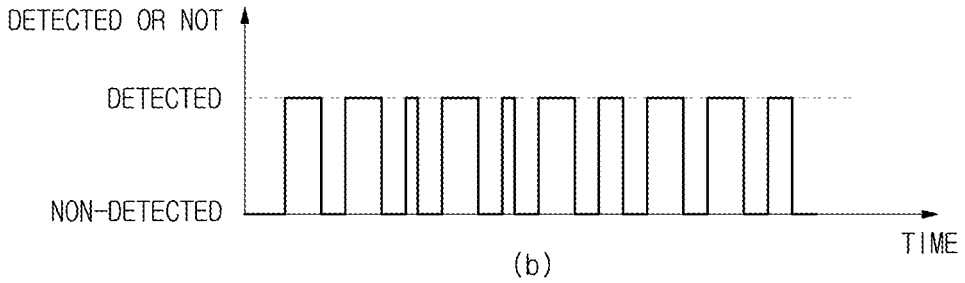
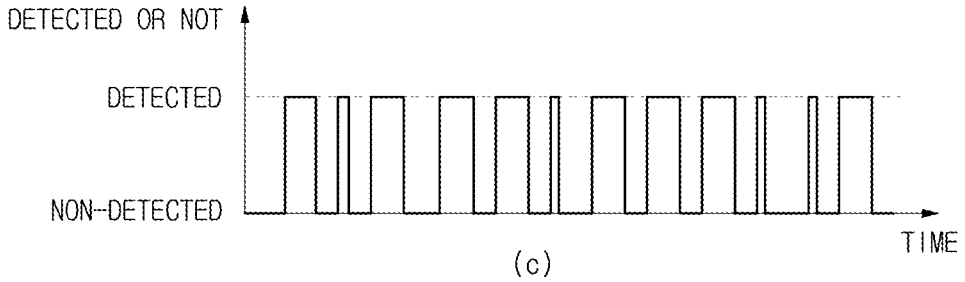

[Fig. 23]
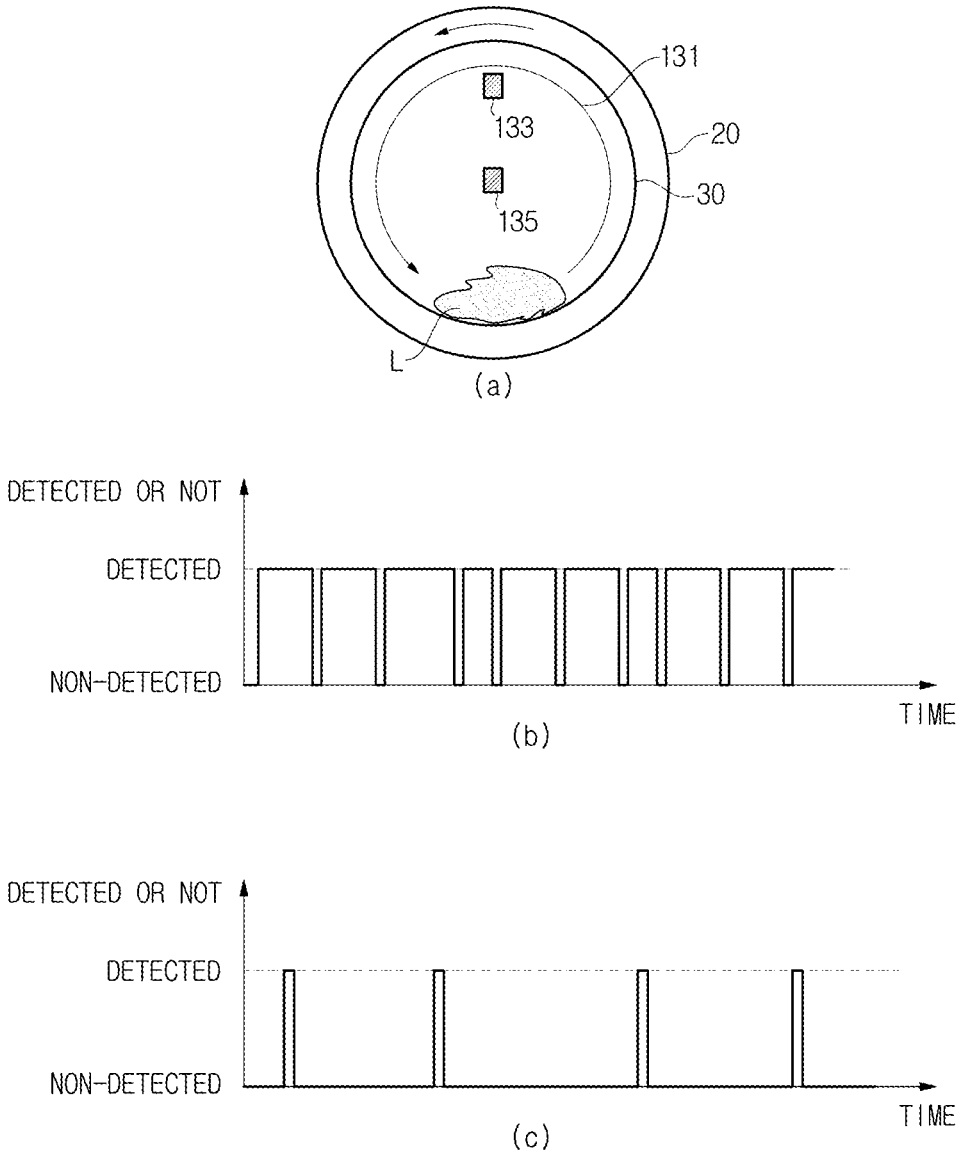

[Fig. 24]
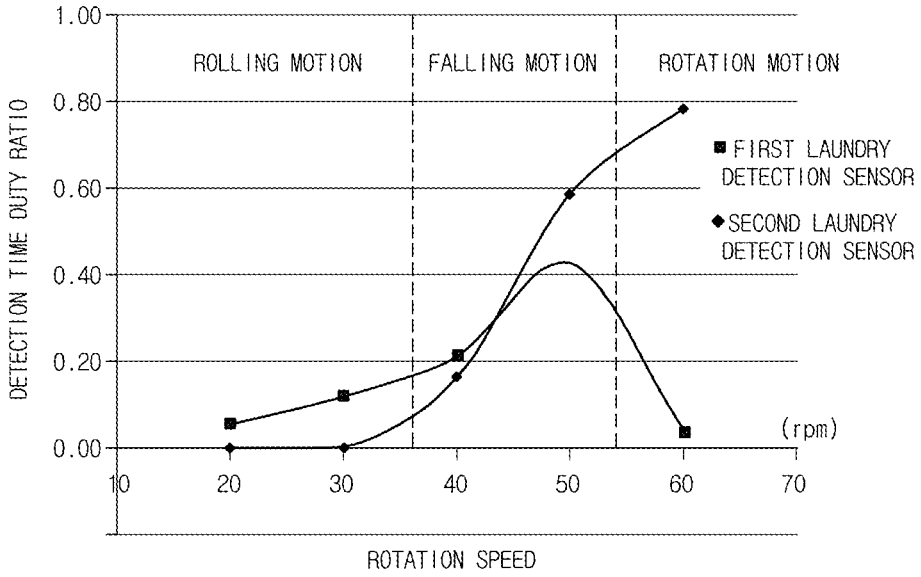
[Fig. 25]
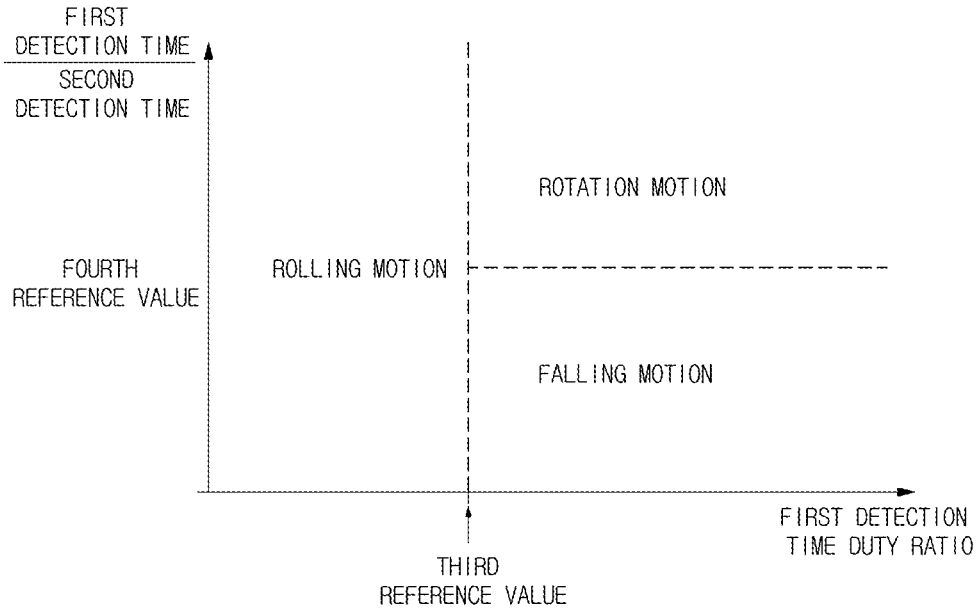

[Fig. 26]
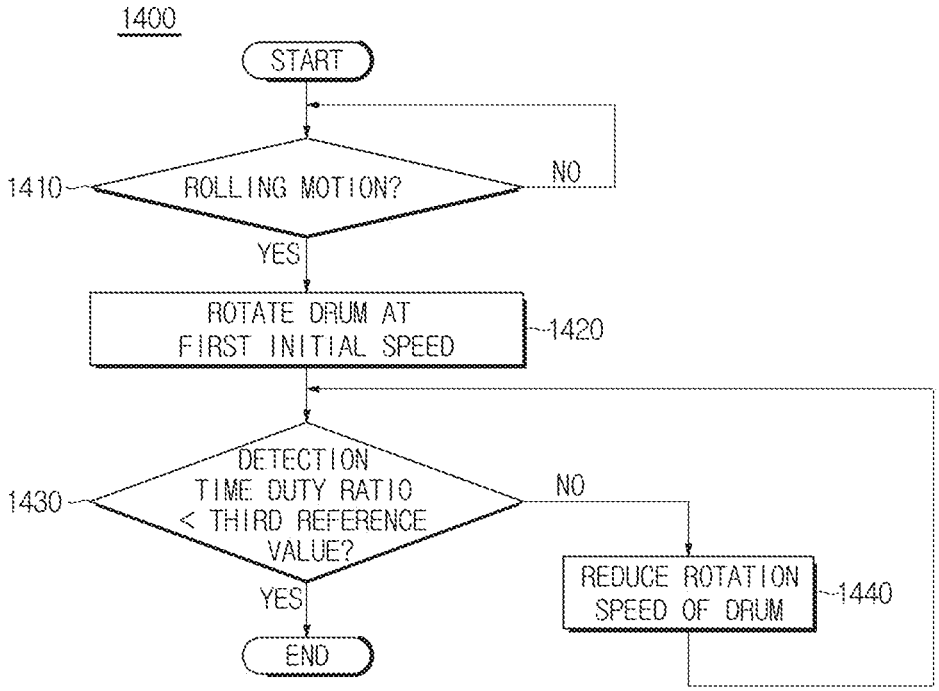
[Fig. 27]
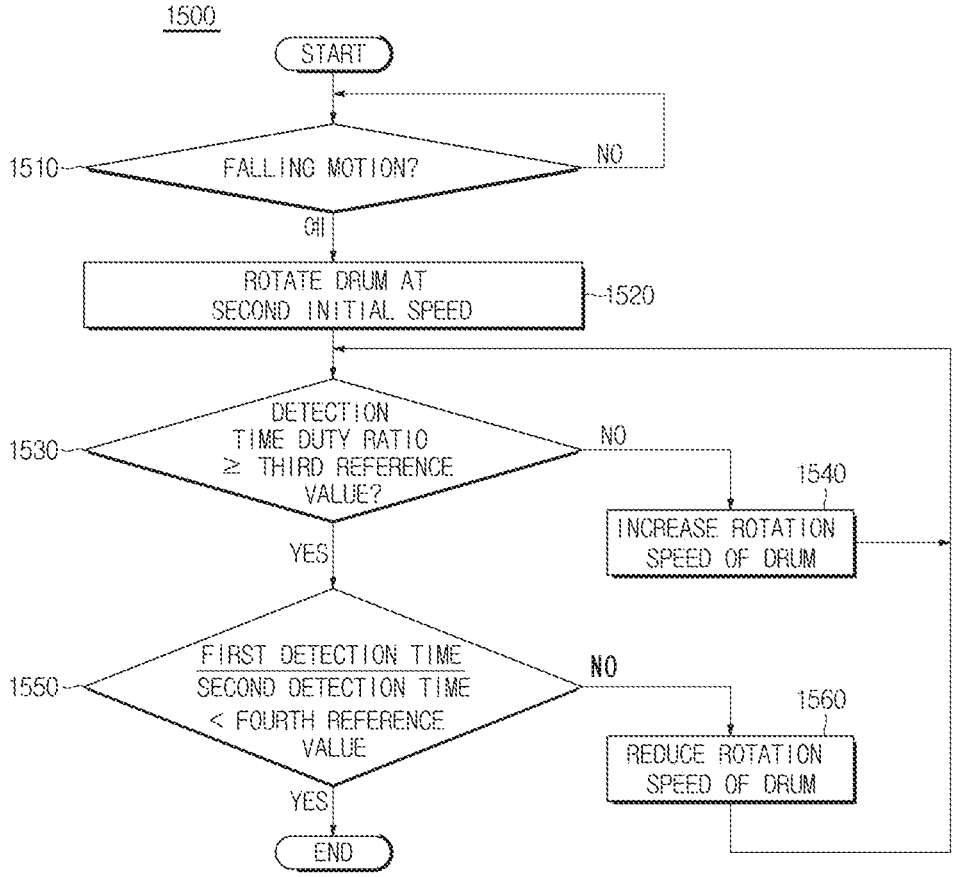

[Fig. 28]
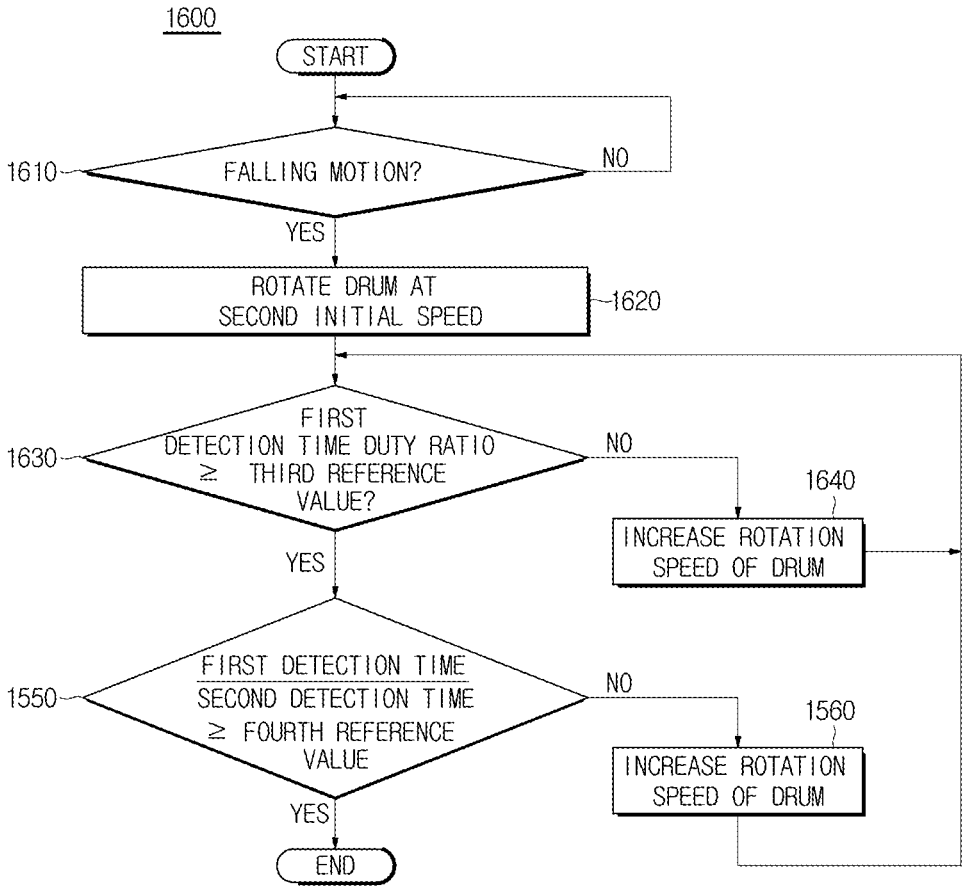

[Fig. 29]
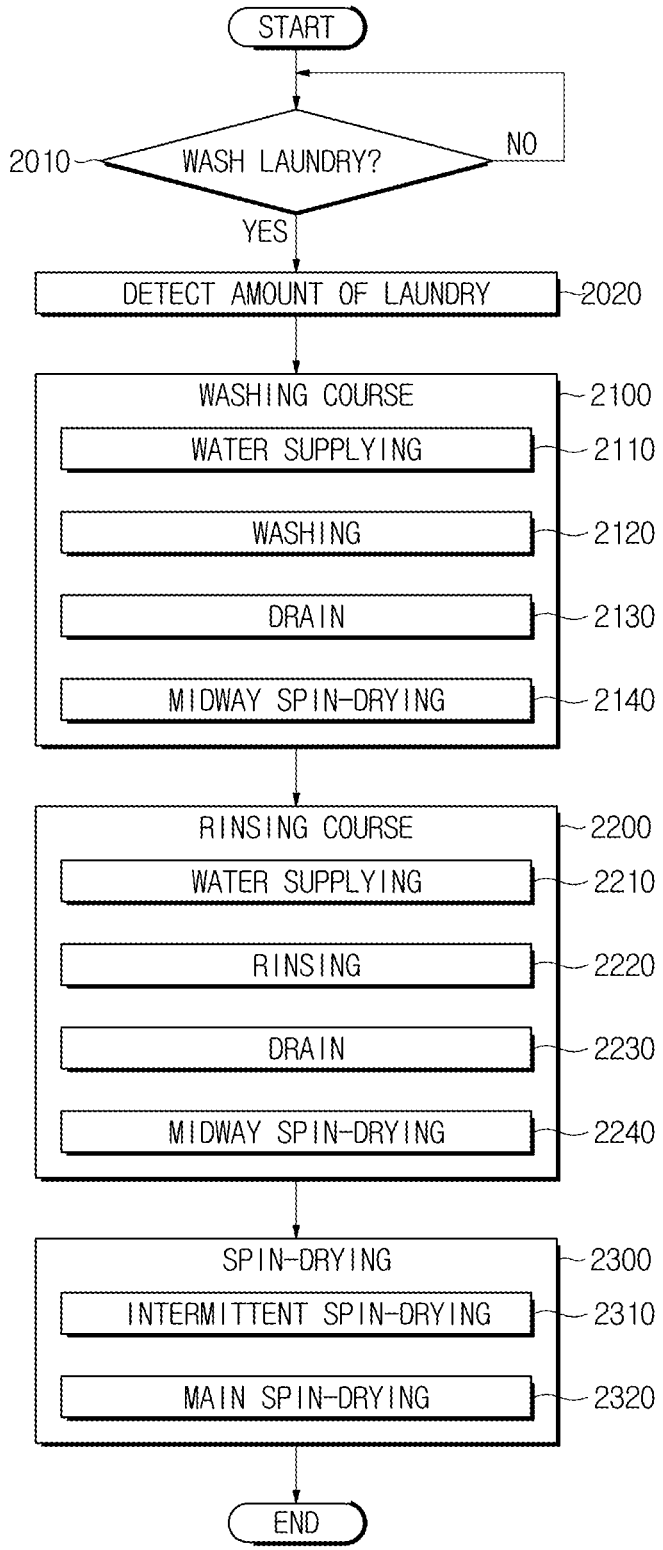

[Fig. 30]

| MOTION | ROLLING MOTION | FALLING MOTION | ROTATION MOTION |
|---|---|---|---|
| FIRST WASHING MOTION | X | O | X |
| SECOND WASHING MOTION | O | O | X |
| THIRD WASHING MOTION | X | O | O |
| FOURTH WASHING MOTION | O | O | O |
| FIFTH WASHING MOTION | O | X | X |
| SIXTH WASHING MOTION | O | X | O |
| SEVENTH WASHING MOTION | X | X | O |

[Fig. 31]
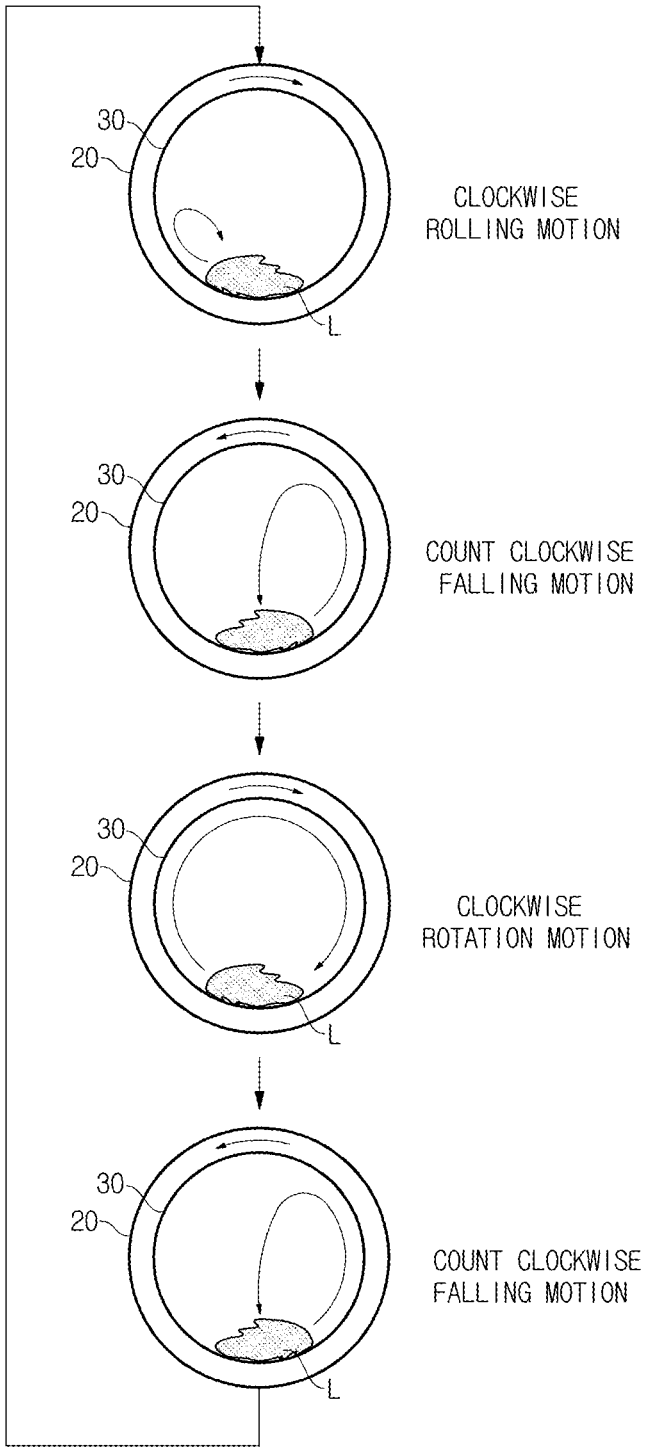

[Fig. 32]
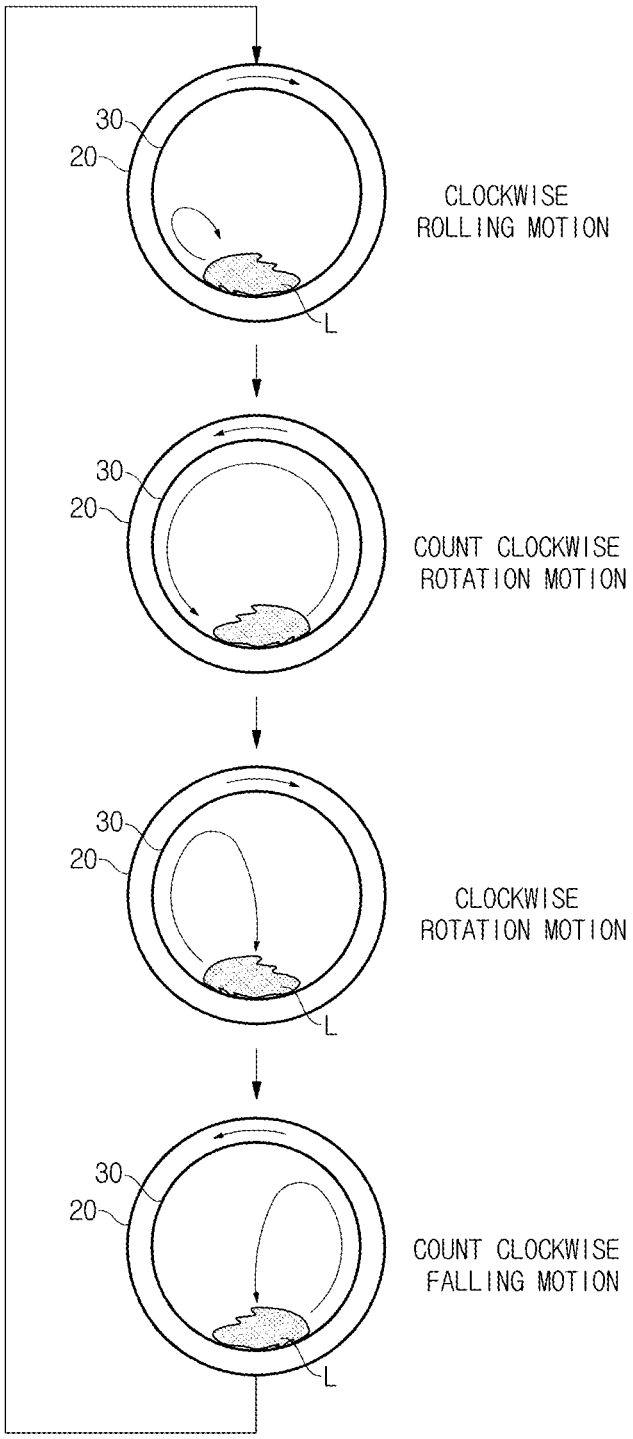

[Fig. 33]
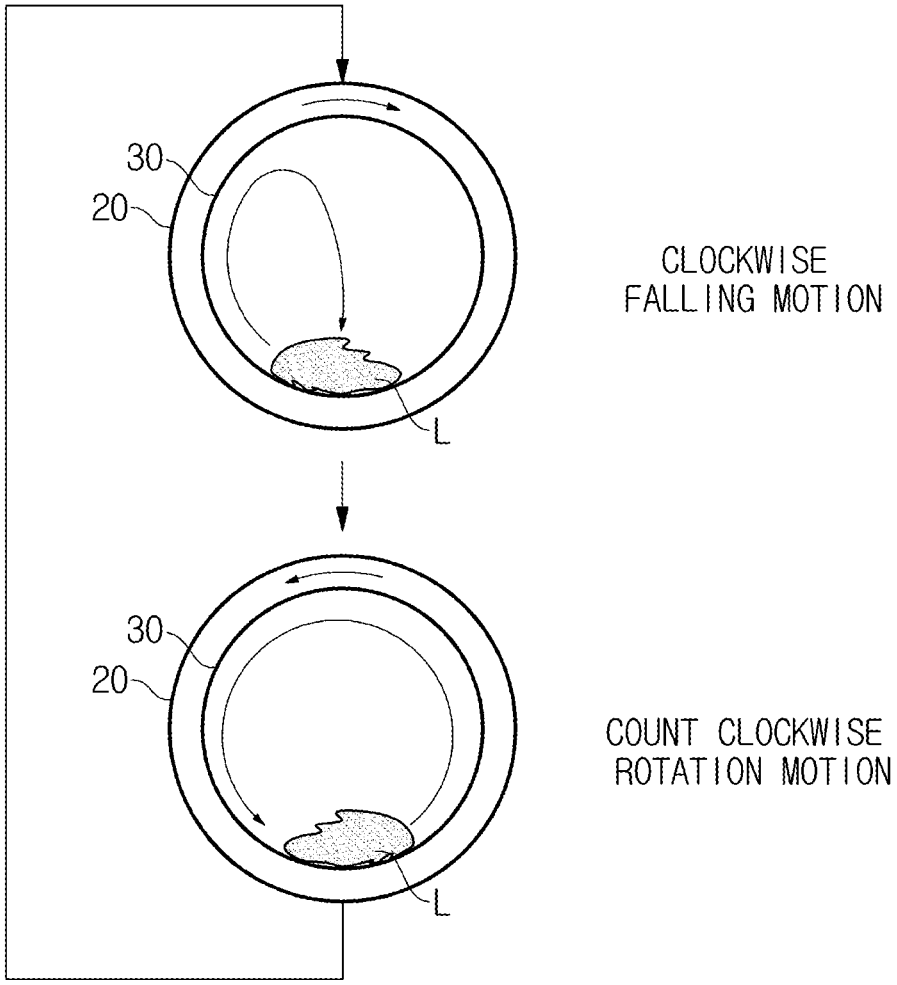

[Fig. 34]
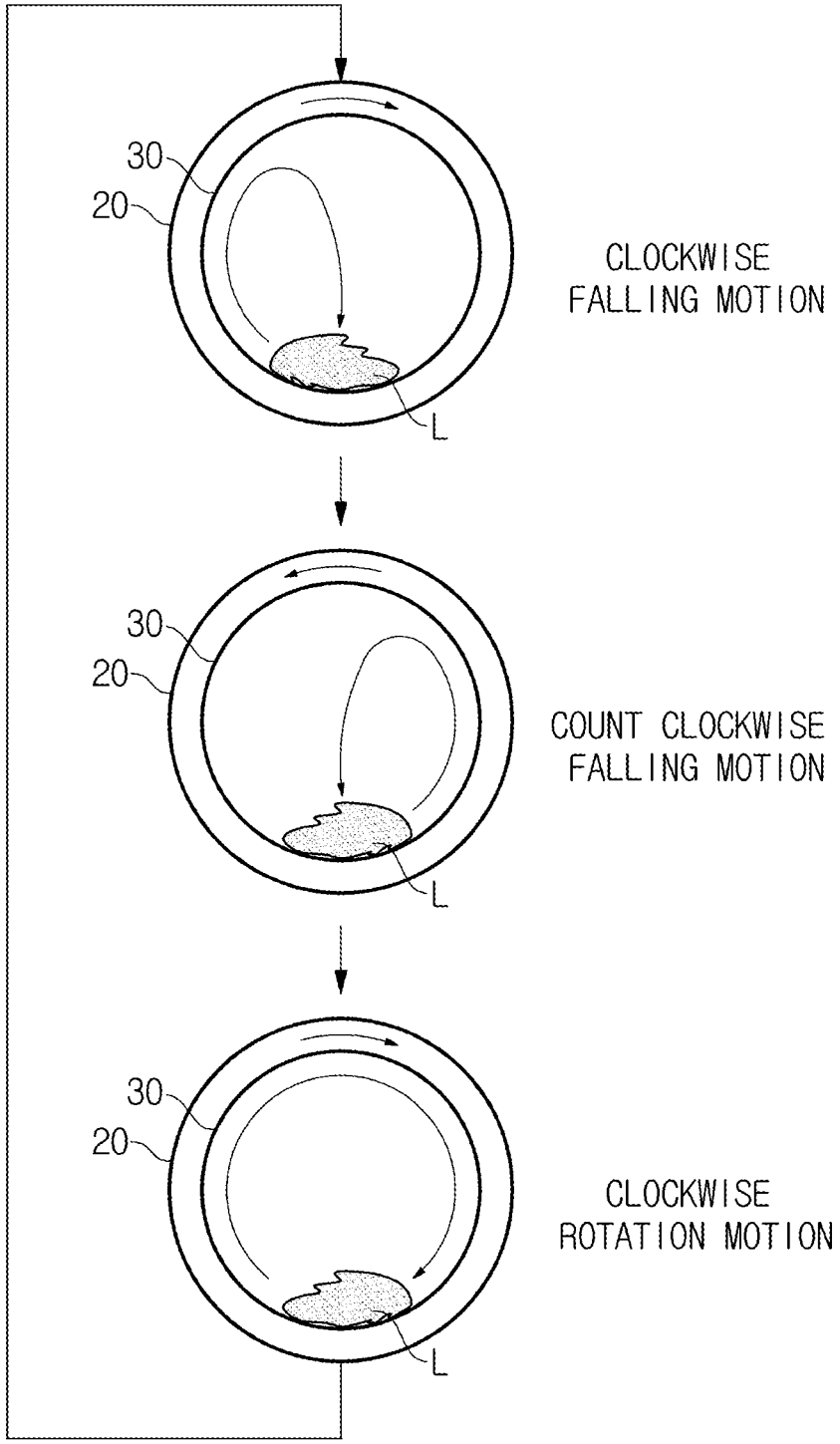

[Fig. 35]
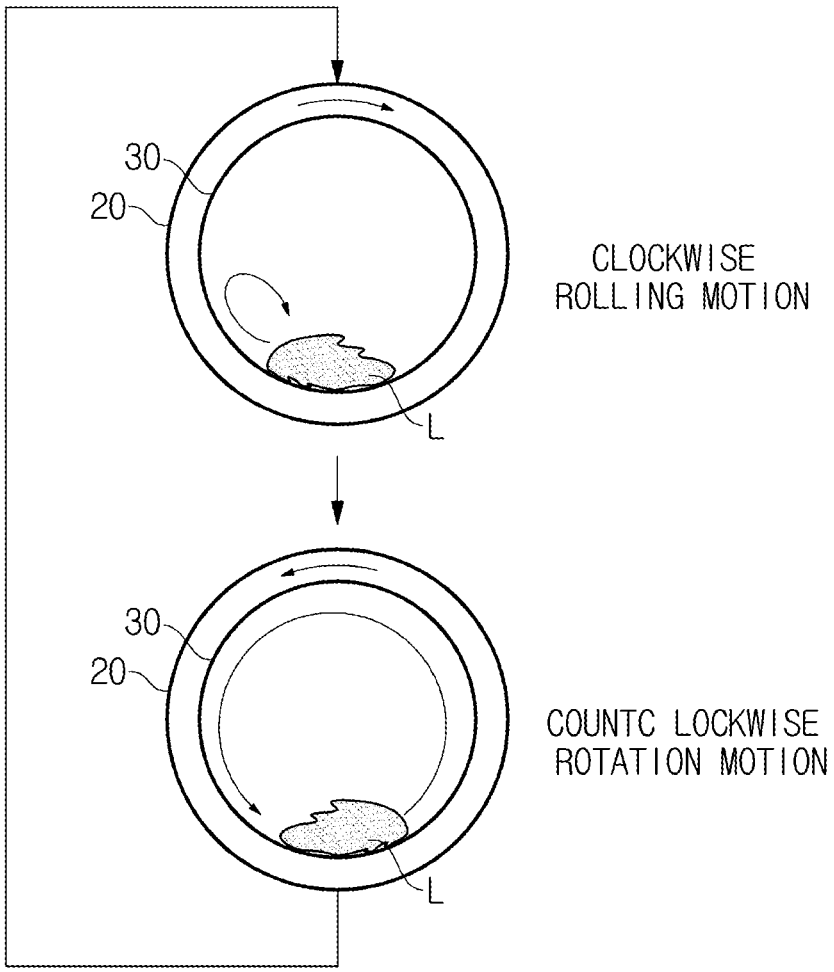

[Fig. 36]
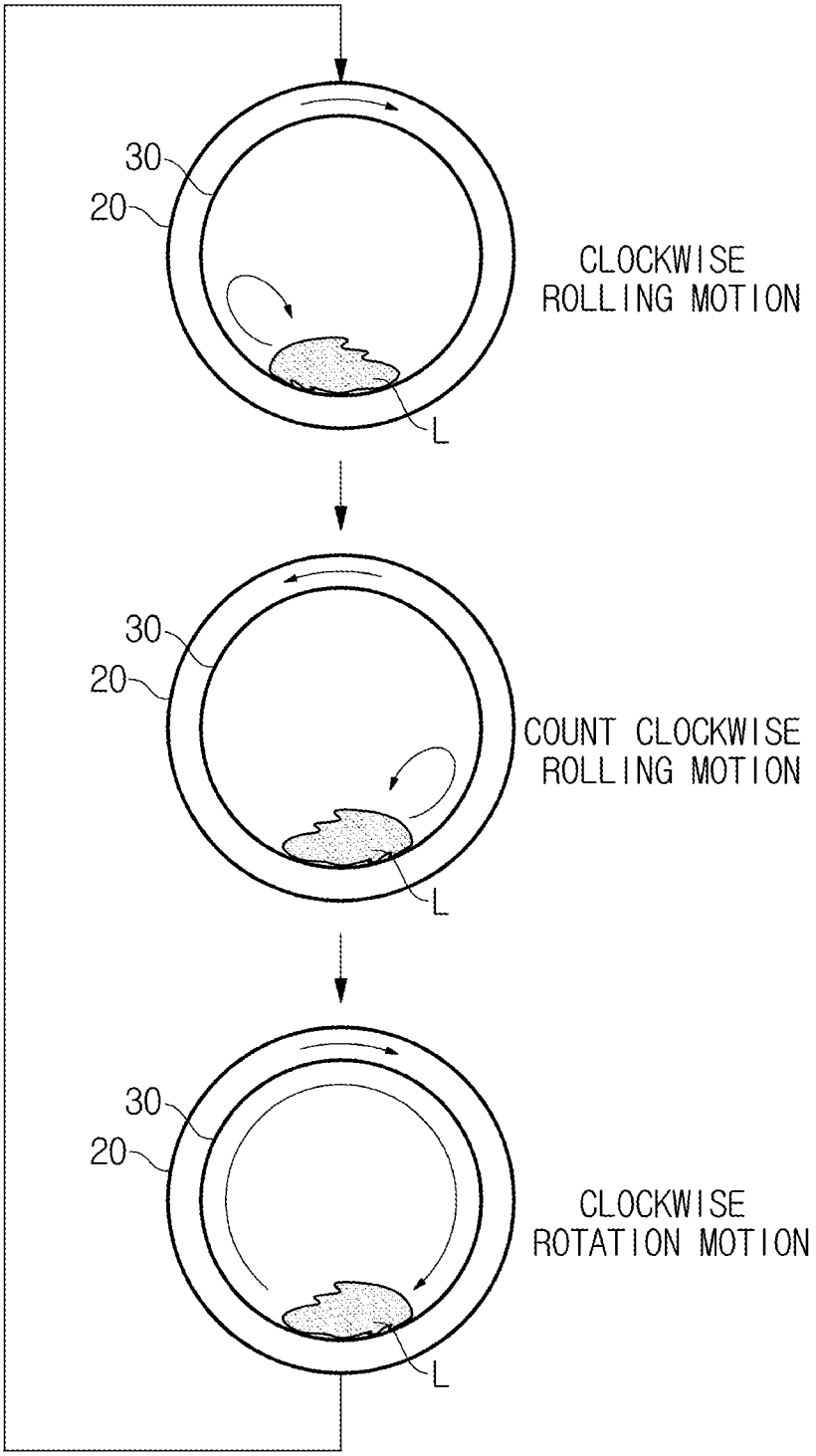

[Fig. 37]
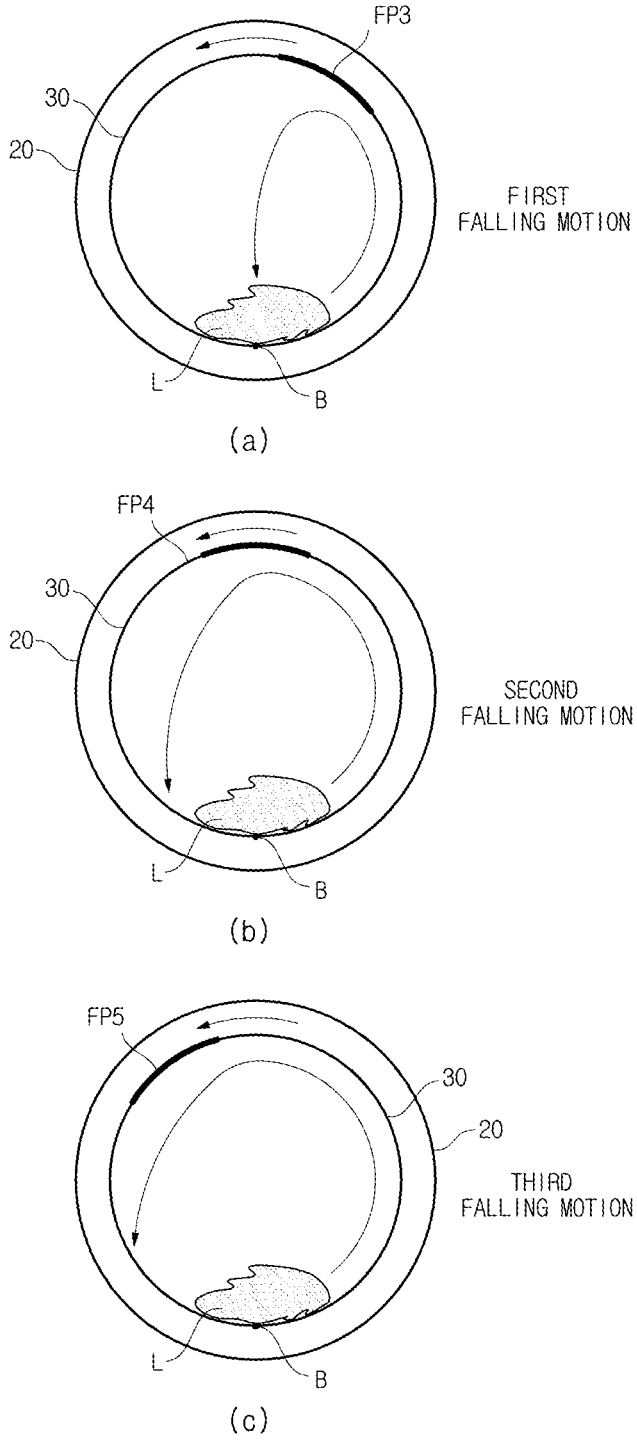

[Fig. 38]
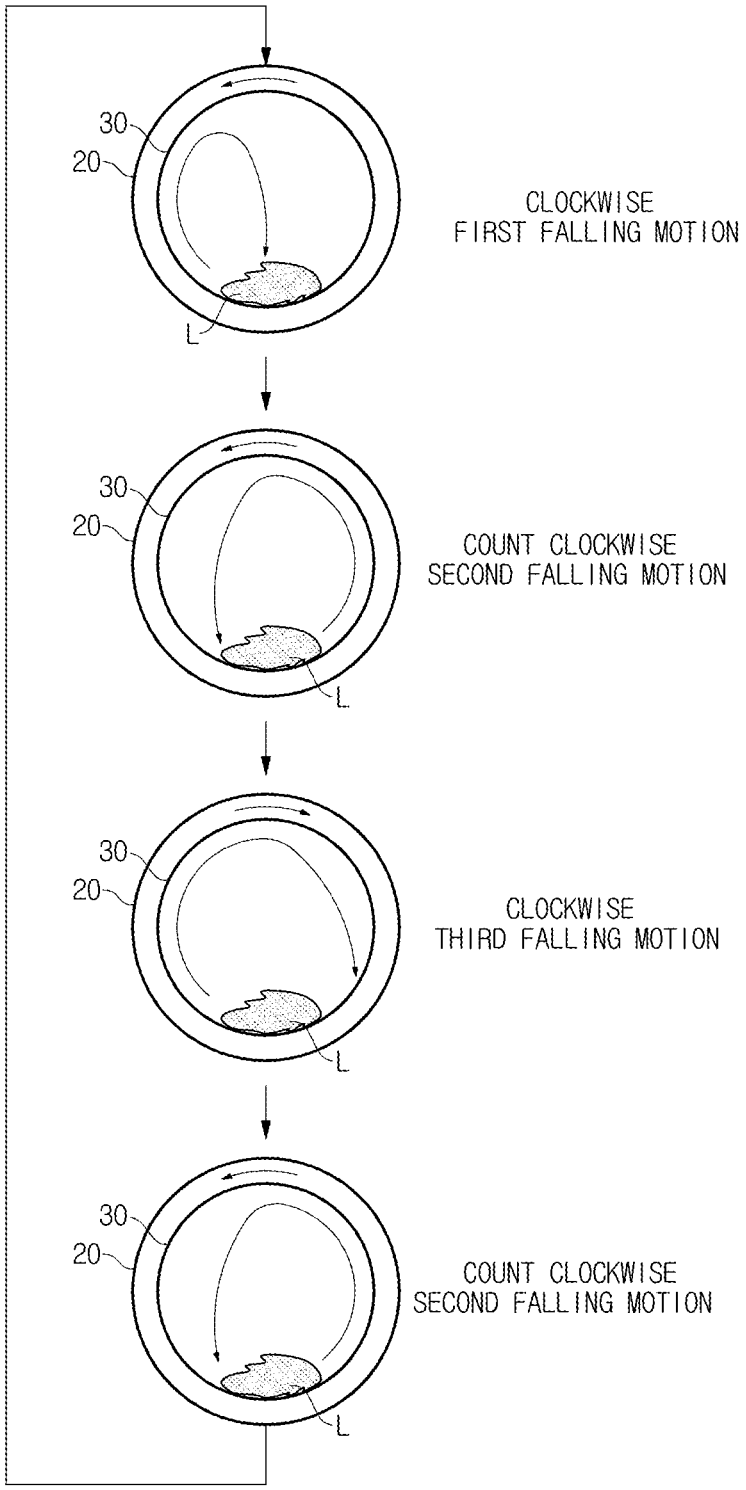

[Fig. 39]
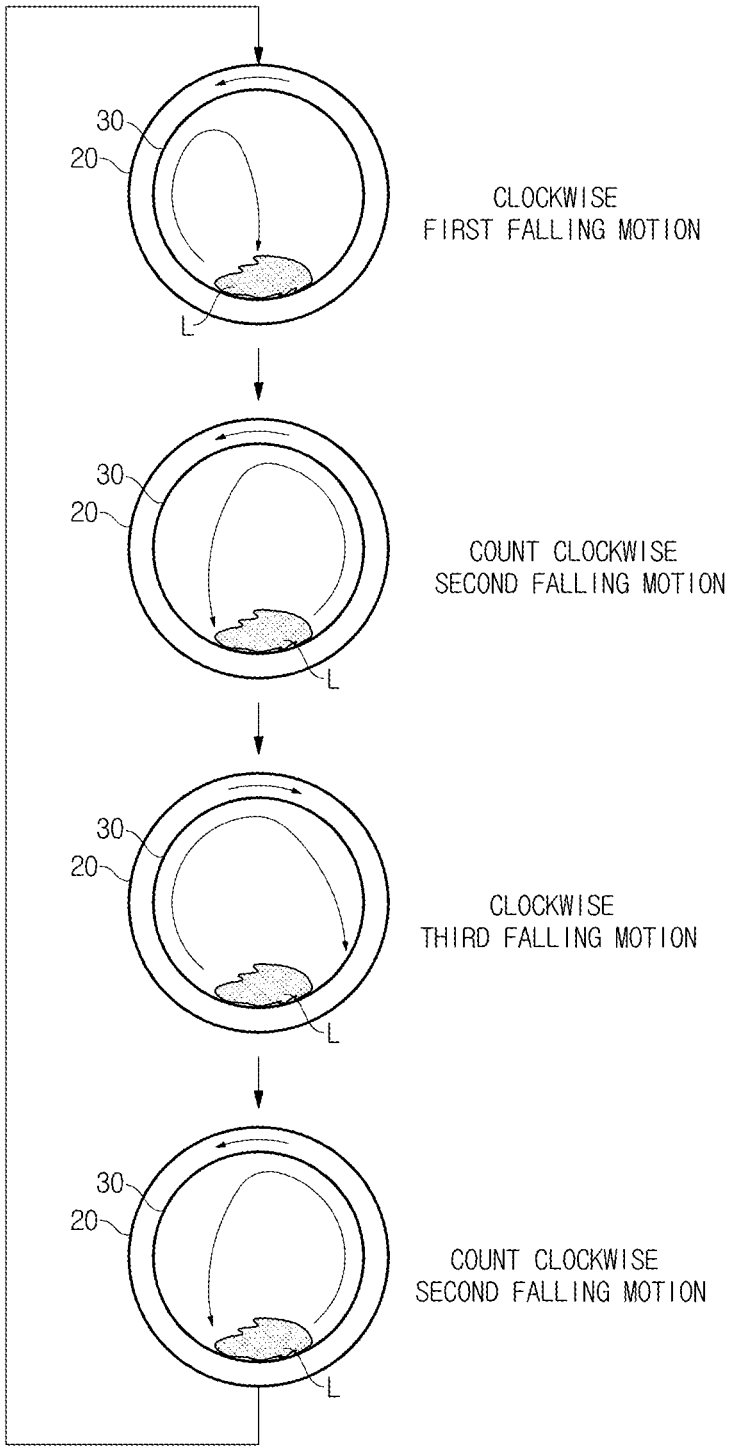

[Fig. 40]
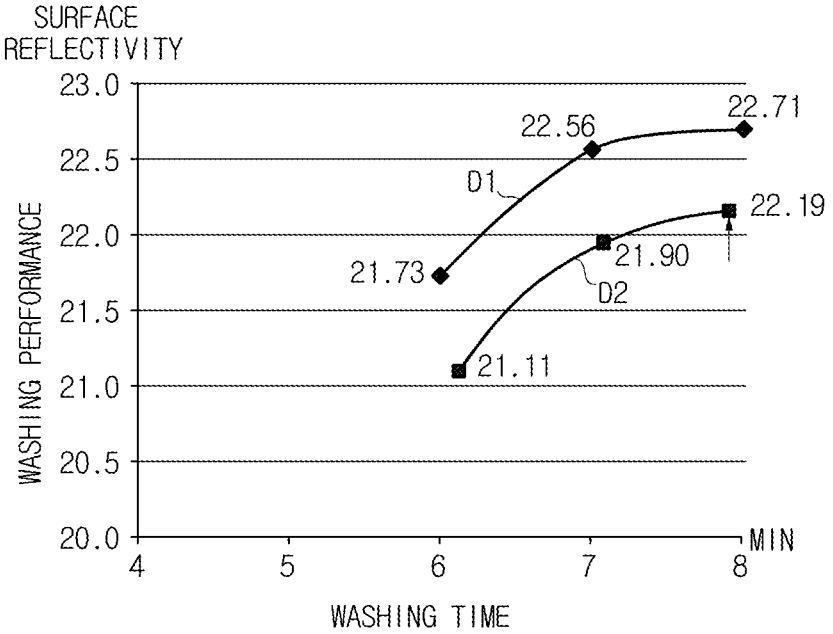
[Fig. 41]
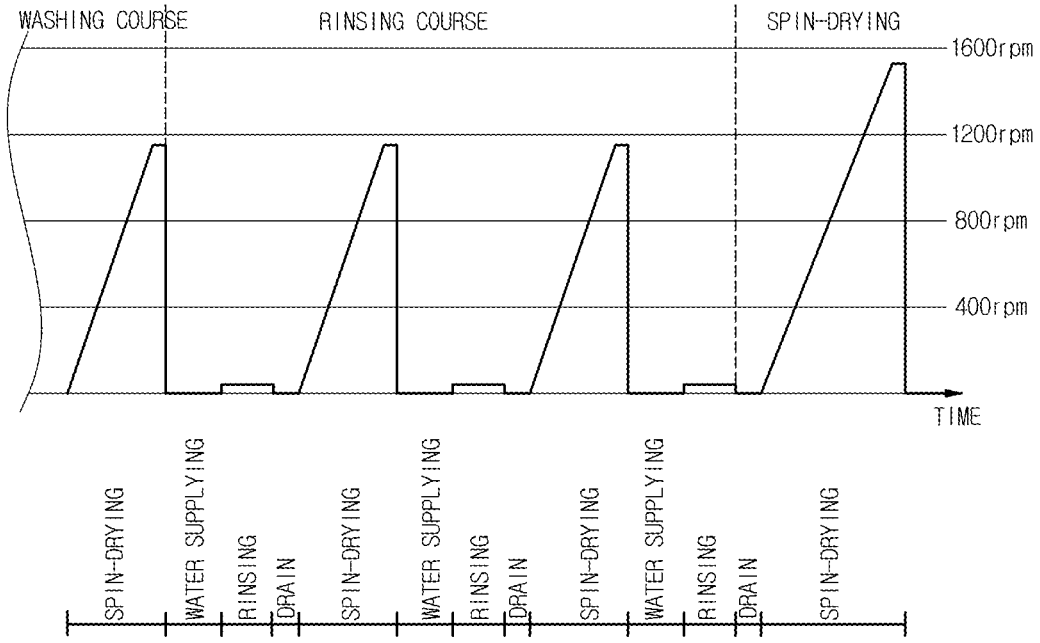

[Fig. 42]
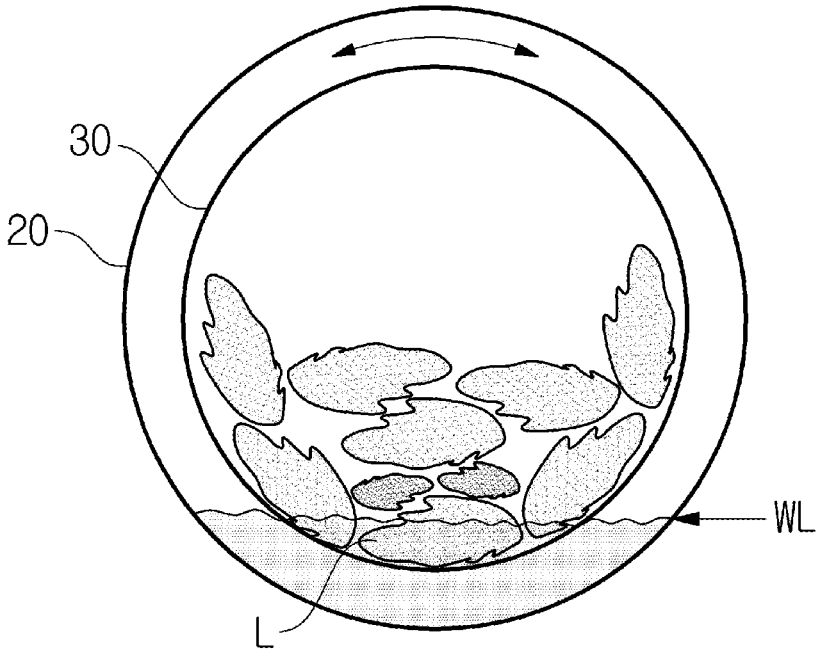
[Fig. 43]
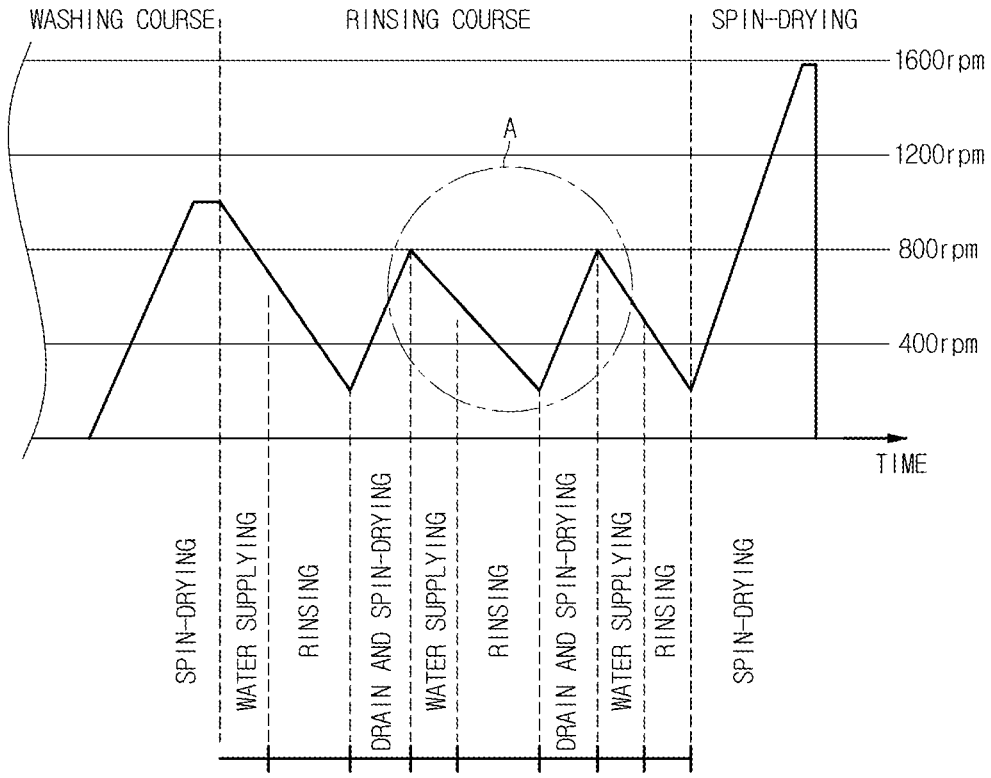

[Fig. 44]
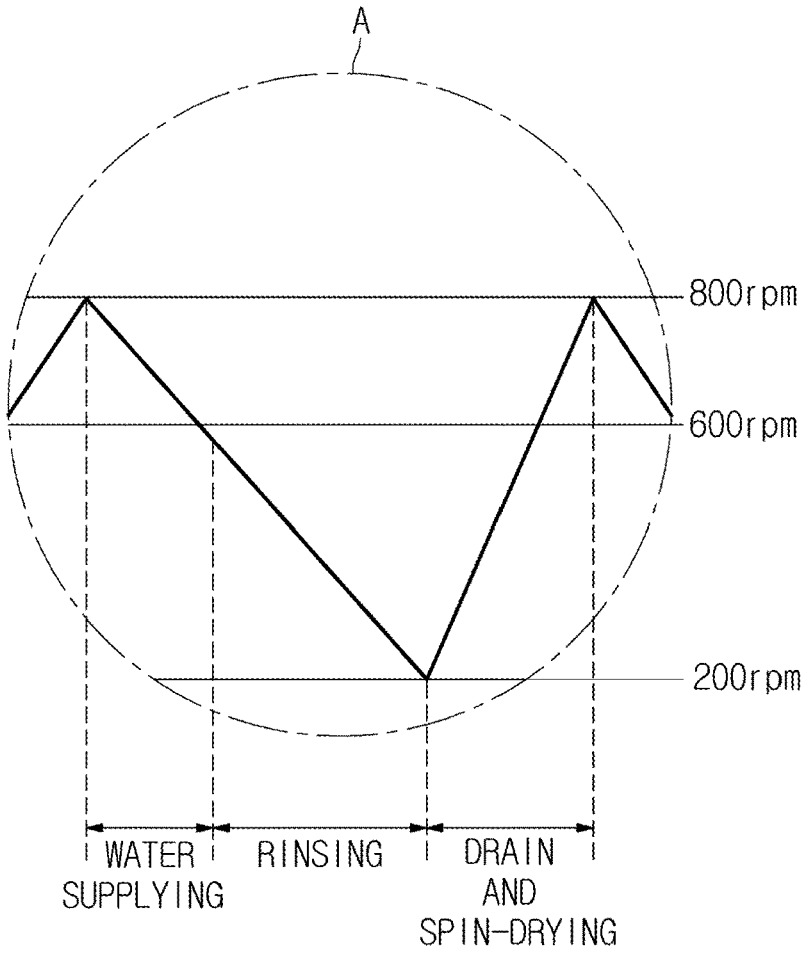
[Fig. 45]
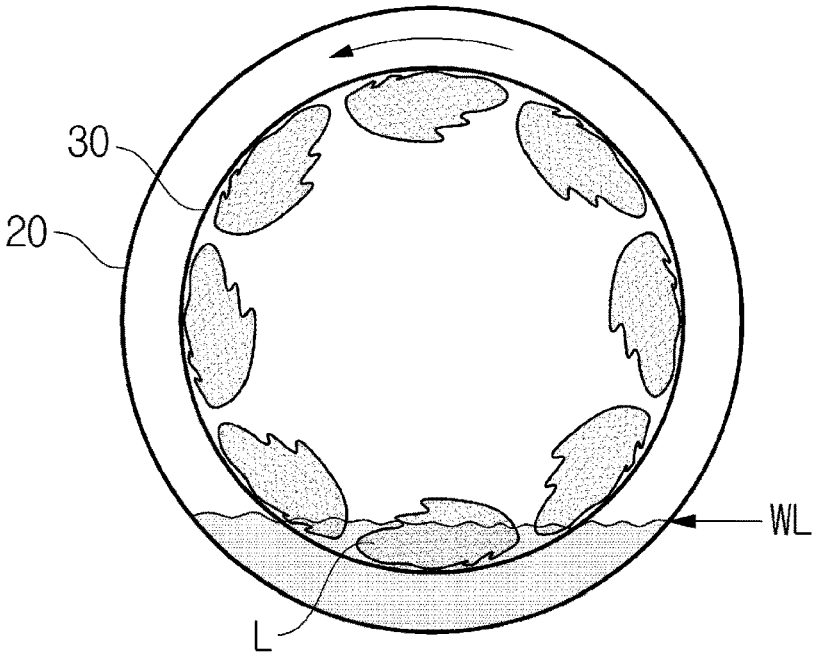

WASHING MACHINE AND METHOD FOR CONTROLLING THE SAME

CROSS-REFERENCE TO RELATED APPLICATIONS

The present application claims priority under 35 U.S.C. § 365 to International Patent Application No. PCT/KR2015/009152 filed Aug. 31, 2015, entitled "WASHING MACHINE AND METHOD FOR CONTROLLING SAME", and, through International Patent Application No. PCT/KR2015/009152, to Korean Patent Application No. 10-2014-0122616 filed Sep. 16, 2014, each of which are incorporated herein by reference into the present disclosure as if fully set forth herein.

TECHNICAL FIELD

The present disclosure relates to a washing machine and method for controlling the same to improve washing performance.

BACKGROUND ART

Washing machines generally have drum-type washers that wash laundry with falling impact by dropping the laundry by rotation of the drum, pulsator-type washers that wash laundry with friction between the laundry and water by rotating a pulsator installed on the bottom of the drum, and agitator-type washers that wash laundry with frictional force between the laundry and water by using an agitator protruding from the inside of the drum to produce water currents.

Such various washing machines rotate e.g., the drum clockwise or counterclockwise at regular speed in order to spin water in washing and rinsing courses or agitate the laundry. On the other hand, in a spin-drying course, the washing machine rotates e.g., the drum at a high speed to apply centrifugal force to the laundry and separates water from the laundry using the centrifugal force.

Typically, the washing machine uses chemical actions by a detergent and mechanical actions by rotation of the drum, pulsator, agitator, etc., to separate and remove stains from the laundry.

Conventional washing machines rotate the drum at an optimal rotation speed designed beforehand to optimize the mechanical actions used in washing.

However, although the optimal rotation speed varies depending on types of the laundry, the pre-designed rotation speed has not reflected this.

DISCLOSURE

Technical Problem

An aspect of the present disclosure is directed to providing a washing machine and method for controlling the same, to detect a motion of the laundry.

Another aspect of the present disclosure is directed to providing a washing machine and method for controlling the same, to control a rotation speed of the drum for the laundry to show a predetermined motion.

Another aspect of the present disclosure is directed to providing a washing machine and method for controlling the same, to push the laundry close to the inner circumferential face of the drum in the rinsing course.

Technical Solution

In accordance with one aspect of the present disclosure, a washing machine may include a drum rotationally arranged for containing laundry, a motion detector configured to detect a motion of the laundry, and a controller configured to control rotation speed of the drum based on the detected motion such that the laundry shows a predetermined motion.

The motion detector may include a laundry detection sensor installed lopsided in an upper part of the drum for detecting the laundry.

The laundry detection sensor may emit at least one of infrared rays, laser, radio waves, ultrasounds, and acoustic waves to the inside of the drum, and receive at least one of infrared rays, laser, radio waves, ultrasounds, and acoustic waves reflected from the laundry.

The controller may determine a motion of the laundry based on at least one of infrared rays, laser, radio waves, ultrasounds, and acoustic waves received by the laundry detection sensor The controller may control rotation speed of the drum based on detection time for which the laundry detection sensor receives at least one of the reflected infrared rays, laser, radio waves, ultrasounds, and acoustic waves.

The motion detector may include a first laundry detection sensor installed in an upper position of a center of the drum for detecting the laundry, and a second laundry detection sensor installed in the center of the drum for detecting the laundry.

The first and second laundry detection sensors may emit at least one of infrared rays, laser, radio waves, ultrasounds, and acoustic waves to the inside of the drum, and receive at least one of infrared rays, laser, radio waves, ultrasounds, and acoustic waves reflected from the laundry.

The controller may determine a motion of the laundry based on at least one of infrared rays, laser, radio waves, ultrasounds, and acoustic waves received by the first and second laundry detection sensors.

The controller may control rotation speed of the drum based on first detection time for which the first laundry detection sensor receives at least one of the infrared rays, laser, radio waves, ultrasounds, and acoustic waves and second detection time for which the second laundry detection sensor receives at least one of the infrared rays, laser, radio waves, ultrasounds, and acoustic waves.

The controller may control rotation speed of the drum based on a ratio of the first detection time and the second detection time.

The controller may change rotation speed of the drum such that the laundry shows at least two different motions during a washing course.

The controller may change rotation speed of the drum such that the laundry shows different motions depending on the quantity of the laundry.

The controller may change rotation speed of the drum such that the laundry shows different motions depending on materials of the laundry.

The controller may control rotation speed of the drum such that the laundry is rotated along with the drum while being pushed close to the inner circumferential face of the drum during a rinsing course.

The controller may rotate the drum at more than a predetermined reference speed during the rinsing course.

The washing machine may further include a water supplier configured to supply water to the drum. The controller may control the water supplier to supply water to the drum while rotation speed of the drum is being reduced.

The washing machine may further include a drain part configured to drain water contained in the drum. The controller may control the drain part to drain water contained in the drum while rotation speed of the drum is being increased.

In accordance with one aspect of the present disclosure, a method for controlling a washing machine may include rotating a drum containing laundry, detecting a motion of the laundry, and controlling rotation speed of the drum based on the detected motion such that the laundry shows a predetermined motion.

The detecting of the motion of the laundry may include emitting at least one of infrared rays, laser, radio waves, ultrasound, and acoustic waves to the inside of the drum, and receiving at least one of infrared rays, laser, radio waves, ultrasound, and acoustic waves reflected from the laundry.

The detecting of the motion of the laundry may include determining a motion of the laundry based on reception time for at least one of the received infrared rays, laser, radio waves, ultrasound, and acoustic waves.

The controlling of the rotation speed of the drum may include changing rotation speed of the drum such that the laundry shows at least two different motions.

The controlling of the rotation speed of the drum may include changing rotation speed of the drum such that the laundry shows different motions depending on the quantity of the laundry.

The controlling of the rotation speed of the drum may include changing rotation speed of the drum such that the laundry shows different motions depending on materials of the laundry.

The controlling of the rotation speed of the drum may include controlling rotation speed of the drum such that the laundry is rotated along with the drum while being pushed close to the inner circumferential face of the drum during a rinsing course.

The controlling of the rotation speed of the drum may include supplying water to the drum while rotation speed of the drum is being reduced.

The controlling of the rotation speed of the drum may include draining water contained in the drum while rotation speed of the drum is being reduced.

Advantageous Effects

According to an aspect of the present disclosure, a washing machine which detects a motion of the laundry by means of a motion detector can be provided, and a controlling method thereof can be provided.

According to another aspect of the present disclosure, a washing machine which controls a rotation speed of the drum based on detection results from the motion detector for the laundry to show a predetermined motion can be provided, and a controlling method thereof can be provided.

According to another aspect of the present disclosure, a washing machine which controls the rotation speed of the drum based on detection results from the motion detector to push the laundry close to the inner circumferential face of the drum in the rinsing course can be provided, and a controlling method thereof can be provided.

DESCRIPTION OF DRAWINGS

FIG. 1 is a control block diagram of a washing machine, according to an embodiment of the present disclosure;

FIG. 2 shows the exterior of a washing machine, according to an embodiment of the present disclosure;

FIG. 3 is a side cross-sectional view of a washing machine, according to an embodiment of the present disclosure;

FIGS. 4 and 5 show features of a detergent supplier included in a washing machine, according to an embodiment of the present disclosure;

FIG. 6 shows a feature of a user interface included in a washing machine, according to an embodiment of the present disclosure;

FIG. 7 is a block diagram of a motor driver included in a washing machine, according to an embodiment of the present disclosure;

FIG. 8 shows exemplary laundry motions by rotation of a drum included in a washing machine, according to an embodiment of the present disclosure;

FIGS. 9 and 10 show an exemplary motion detector included in a washing machine, according to an embodiment of the present disclosure;

FIGS. 11 to 13 show outputs of the motion detector shown in FIGS. 9 and 10 according to laundry motions;

FIG. 14 shows detection results from the motion detector shown in FIGS. 9 and 10 according to rotation speeds of a drum;

FIG. 15 shows classifications of laundry motion according to detection results from the motion detector shown in FIGS. 9 and 10;

FIGS. 16 to 18 are flowcharts of a method for a washing machine to implement motions of the laundry, according to an embodiment of the present disclosure;

FIGS. 19 and 20 show another exemplary motion detector included in a washing machine, according to an embodiment of the present disclosure;

FIGS. 21 to 23 show outputs of the motion detector shown in FIGS. 19 and 20 according to laundry motions;

FIG. 24 shows detection results from the motion detector shown in FIGS. 19 and 20 according to the rotation speed of a drum;

FIG. 25 shows classifications of laundry motion according to detection results from the motion detector shown in FIGS. 19 and 20;

FIGS. 26 to 28 are flowcharts of a method for a washing machine to implement motions of the laundry, according to an embodiment of the present disclosure;

FIG. 29 shows operation of a washing machine, according to an embodiment of the present disclosure;

FIG. 30 shows combinations of possible laundry motions during washing operation of a washing machine, according to an embodiment of the present disclosure;

FIGS. 31 to 39 show various motions of the laundry according to the combinations of laundry motions shown in FIG. 30;

FIG. 40 shows washing performance according to various motions of the laundry;

FIG. 41 shows the rinsing course of a conventional washing machine;

FIG. 42 shows motions of the laundry during a rinsing operation of a conventional washing machine;

FIG. 43 shows the rinsing course of a washing machine, according to an embodiment of the present disclosure;

FIG. 44 is an enlarged view of an area A of FIG. 43; and

FIG. 45 shows motions of the laundry during rinsing operation of a washing machine, according to an embodiment of the present disclosure.

BEST MODE

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

A "touch" may be made by one of the fingers including the thumb or an input unit capable of making touch gestures (e.g., a stylus). The touch may include hovering by one of the fingers including the thumb or an input unit capable of making touch gestures. The touch may include not only a single touch but also multi touch.

Embodiments of the present disclosure will now be described with reference to accompanying drawings.

FIG. 1 is a control block diagram of a washing machine, according to an embodiment of the present disclosure, FIG. 2 shows the exterior of a washing machine, according to an embodiment of the present disclosure, and FIG. 3 is a side cross-sectional view of a washing machine, according to an embodiment of the present disclosure. Furthermore, FIGS. 4 and 5 show features of a detergent supplier included in a washing machine, according to an embodiment of the present disclosure, FIG. 6 shows a feature of a user interface included in a washing machine, according to an embodiment of the present disclosure, and FIG. 7 is a block diagram of a motor driver included in a washing machine, according to an embodiment of the present disclosure.

Configuration of a washing machine 1 will be described with reference to FIGS. 1 to 7.

The washing machine 1 may include a cabinet 10 forming the exterior of the washing machine 1, and in the front center of the cabinet 10, there are an inlet arranged in the front center of the cabinet 10 to insert or withdraw the laundry and a door 13 arranged to open or close the inlet.

The door 13 may be pivotally mounted on the cabinet 10 to open or close the inlet formed in the front center of the cabinet 101.

Furthermore, a user interface 120 for interacting with the user may be arranged on the front top of the cabinet 10, and a power button 11*a* for powering on or off the washing machine 1 and a start button 11*b* for starting or stopping the washing machine 1 may be arranged on the right of the user interface 120. The user interface 120 will be described in detail later.

The cabinet 10 accommodates various components included in the washing machine 1.

Specifically, the washing machine 1 may include a tub 20 for containing water, a drum 30 rotationally arranged inside the tub 20, a driving motor 40 for driving the drum 30 to be rotated, a water supplier 50 for supplying water into the tub 20, a drain part 60 for draining water from the tub 20, a detergent supplier 80 for supplying a detergent, a user interface 120 for interacting with the user, a motion detector 130 for detecting motions of the laundry, a motor driver 140 for applying driving current to the driving motor 40, and a main controller 110 for controlling overall operation of the washing machine 110, as shown in FIGS. 2 and 3.

The tub 20 is arranged inside the cabinet 10 to contain water to be used in washing the laundry.

The tub 20 may include a cylindrical tub rear body 21 with the rear side closed and a tub front body 22 with an opening formed on the front, as shown in FIG. 3.

On the rear side of the tub rear body 21, a bearing 21*a* for rotationally fixating the driving motor 40 and a bearing housing 21*b* are arranged, as will be described below, and on the front side of the tub front body 22, an opening 22*a* may be formed to insert or withdraw the laundry.

Furthermore, the tub 20 may be connected to the water supplier 50 and detergent supplier 70 through a connecting pipe 74 arranged above the tub 20, and connected to the drain part 60 through a drain pipe 61 arranged below the tub 20.

The drum 30 is rotationally arranged inside the tub 20 and contains the laundry. By rotation of the drum 30, the laundry is washed.

The drum 30 may include a cylindrical drum body 31, a front drum plate 32 arranged on the front of the drum body 31, and a rear drum plate 33 arranged on the back of the drum body 31, as shown in FIG. 3.

A through hole 31*a* allowing the water contained in the tub 20 to flow to the inside of the drum 30 and lifters 31*b* to lift the laundry up in the drum 30 may be arranged in the drum body 31.

Furthermore, an opening 32*a* through which to insert or withdraw the laundry to or from the inside of the drum 30 may be arranged on the front drum plate 32, and a shaft flange 34 connected to the driving motor 40, which will be described below, may be installed on the rear drum plate 33.

The driving motor 40 receives a driving current from the motor driver 140, which will be described below, to produce turning force to rotate the drum 30.

The driving motor 40 may include, as shown in FIG. 3, a stator 41 fixed on the rear side of the tub 20, a rotor 42 rotated by magnetic interaction with the stator 41, a rotating shaft 43 having one side connected to the rotor 42 and the other side passing through the rear side of the tub 120 and connected to the shaft flange 34 arranged on the rear side of the drum 30, and a hall sensor 45 for detecting rotation of the rotor 42, as shown in FIG. 3.

As described above, the rotation shaft 43 may be rotationally fixed to the tub 20 by the bearing 25 arranged on the rear side of the tub 20.

The hall sensor 45 detects rotational displacement of the rotor 42 and outputs an electric signal corresponding to the detected rotational displacement.

The driving motor 140 may employ a brushless direct current (BLDC) motor or synchronous alternative current (AC) motor, whose rotation speed is easily controlled.

The water supplier 50 is arranged above the tub 20 for supplying water to the tub 20 from an external water source for the washing or rinsing course.

The water supplier 50 may include a water pipe 51 connecting between the external water source (not shown)

and the detergent supplier 80, and a water valve 52 arranged in the water pipe 51 for opening or closing the water pipe 51, as shown in FIG. 3.

The drain part 60 is arranged below the tub 20 for draining out the water that was used for washing the laundry.

The drain part 60 includes the drain pipe 61 for guiding the water in the tub 20 out of the main body 10, and a drain pump 62 arranged in the drain pipe 61 for draining out the water through the drain pipe 61, as shown in FIG. 3.

The detergent supplier 70 manually or automatically supplies detergent or rinse to the tub 20. In other words, the detergent supplier 70 may automatically supply detergent and rinse stored in the detergent supplier 70 to the tub 20, or supply detergent and rinse manually inserted by the user to the tub 20.

The detergent supplier 70 may include a detergent container 72 for containing a large quantity of detergent and rinse, a detergent container housing 71 for accommodating the detergent container 72, and a detergent supply pump 73 for automatically supplying the detergent or rinse contained in the detergent container 72 to the tub 20, as shown in FIGS. 4 and 5.

The detergent container housing 71 is fixedly mounted inside the cabinet 10 of the washing machine 1, and a water port 71*a* for receiving water from the water supplier 50 is arranged on the rear side of the detergent container housing 71 and a connecting port 71*b* is arranged on the bottom face of the detergent container housing 71 for discharging a combination of the detergent released by the detergent supply pump 73 and the water supplied through the water port 71*a*.

The water and detergent discharged through the connecting port 71*b* are supplied to the tub 20 through a connecting pipe 75.

The detergent container 72 is movably installed inside the detergent container housing 71. If the detergent or rinse contained in the detergent container 72 runs out, the user may pull the detergent container 72 out of the detergent container housing 71 and put additional detergent or rinse into the detergent container 72.

The detergent container 72 may be partitioned into first and second detergent storage areas for containing detergent, and first and second rinse storage areas for containing rinse.

The first detergent storage area and the first rinse storage area store liquid detergent and liquid rinse, respectively, to be automatically supplied to the tub 20 through the detergent supply pump 73, and the second detergent storage area and the second rinse storage area store detergent and rinse, respectively, inserted by the user in person.

A first detergent inlet 72*a* for supplying detergent to the first detergent storage area and a first rinse inlet 72*b* for supplying rinse to the first rinse storage area once the contained detergent and rinse run out are arranged on the top of the detergent container 72. Furthermore, on the top of the detergent container 72, a second detergent inlet 72*c* and a second rinse inlet 72*d* are arranged for the user to put in detergent and rinse in person.

On the rear side of the detergent container 72, a detergent outlet hole 72*e* and a rinse outlet hole 72*f* for applying the detergent and the rinse contained in the detergent storage space and the rinse storage space, respectively, to a detergent supply pump 73, which will be described below, are arranged.

The detergent supply pump 73 is arranged on the rear side of the detergent container 72, and may include a detergent pump to put the detergent contained in the detergent container 72 into the tub 20, and a rinse pump to put the rinse contained in the rinse container 72 into the tub 20.

On the front of the detergent supply pump 73, a detergent inlet hole 73*a* formed to correspond to the detergent outlet hole 72*c* arranged on the back of the detergent container 72 for allowing the detergent contained in the detergent container 72 to be put into the detergent supply pump 73, and a rinse inlet hole 73*b* formed to correspond to the rinse outlet hole 72*f* for allowing the rinse to be put into the detergent supply pump 73 may be arranged.

Furthermore, on the back of the detergent supply pump 73, a detergent outlet to discharge detergent and a rinse outlet to discharge rinse may be arranged.

When the user inputs automatic detergent supply, the detergent supplier 70 may automatically supply detergent in supplying water for the washing course and automatically supply rinse in supplying water for the rinsing course.

A water level detector 80 detects a water level of the water contained in the tub 20.

The water level detector 80 may include a water level detection pipe 81 extending from the bottom of the tub 20 to the top of the cabinet 10, and a pressure sensor 83 for detecting pressure inside the water level detection pipe 81, as shown in FIG. 3.

Once the water is supplied into the tub 20, the water is supplied even to the water level detection pipe 81 connected to the bottom of the tub 20. Furthermore, as the water level of the water contained in the tub 20 rises, the water level in the water level detection pipe 81 rises as well, and the pressure inside the water level detection pipe 81 rises. This is because the air inside the water level detection pipe 81 is compressed by the water contained in the water level detection pipe 81.

The pressure sensor 83 may detect the pressure inside the water level detection pipe 81 and provide an electric signal corresponding to the detected pressure to the controller 110 as will be described below, and the controller 110 may determine a water level in the tub 20 based on the pressure inside the water level detection pipe 81 output from the pressure sensor 83.

The user interface 120 receives a user control command from the user and displays information about operation of the washing machine 1. Specifically, the user interface 120 may include an input means, such as buttons for receiving user control commands from the user, and a display means, such as a display for displaying the information about operation of the washing machine 1 for the user according to a user control command from the user.

For example, the user interface 120 may employ a touch screen panel (TSP) for receiving touch inputs from the user and display operational information corresponding to the touch input of the user.

Specifically, as shown in FIG. 6, the user interface 120 may include a touch panel 121 for detecting contact coordinates touched by a body part of the user, and a display panel 123 for displaying information about operation of the washing machine 1.

The touch panel 121 may be arranged on the front of the display panel 123 and formed of a transparent material. Furthermore, the touch panel 121 may detect not only the contact of a body part of the user but also the touched coordinates.

The touch panel 121 may employ a capacitive touch panel for detecting a change in capacity due to contact of the user and a resistive touch panel for detecting pressure due to contact of the user.

The display panel 123 displays the user control commands that the user may input, and displays information about operation of the washing machine 1 in response to a touch input of the user. For example, before the washing machine 1 is operated, the display panel 123 may display washing setting information input by the user about e.g., washing course, rinsing course, spin-drying course. Furthermore, after the washing machine 1 is operated, the display panel 123 may display information about the washing operation, such as a course being performed by the washing machine 1 and time remaining until completion of the washing.

The display panel 123 may employ a Liquid Crystal Display (LCD) panel, Light Emitting Diode (LED) panel, an Organic Light Emitting Diode (OLED) panel, or the like.

In another example, the user interface 120 may include a plurality of input buttons to receive user control commands determined in advance, and a display panel to display information about operation of the washing machine 1 according to an input user control command.

The plurality of input buttons may each receive a particular user control command. For example, the plurality of input buttons may include a washing course setting button to receive a course of washing, a rinsing count setting button to receive the number of rinsing times, a spin-drying intensity setting button to receive a spin-drying intensity, etc.

The input buttons may employ push switches or membrane switches to detect pressure by the user, a touch pad to detect contacts of the user, etc.

The motion detector 130 detects a motion of the laundry contained in the drum 30.

As described above, the drum 30 is rotationally arranged inside the tub 20 and contains the laundry. The laundry in the drum 30 has various motions according to rotation speed and rotation direction of the drum 30.

For example, the laundry may be rolled over in the lower part of the drum 30, or lifted up the drum 30 by the aforementioned lifter 31*b* and fall down, or rotated along with the drum 30 while being pushed close to the inner circumferential face of the drum 30.

The motion detector 130 detects the motion of the laundry and outputs an electric signal corresponding to the detected motion.

The motion detector 130 may use various sensors, such as an infrared sensor module, an image sensor module, an ultrasonic sensor module, a radar sensor module, a laser sensor module, etc.

Exemplary configuration and operation of the motion detector 130 will be described later in more detail.

The motor driver 140 supplies a driving current to the driving motor 40 to operate the driving motor 40.

The motor driver 140 may include a rectifying circuit 141 for rectifying AC power input from an external power (AC) source, a smoothing circuit 143 for eliminating ripples of the rectified power, an inverter 145 for generating a driving current to be supplied to the driving motor 40, a current detection circuit 147 for detecting the driving current to be supplied to the driving motor 40, and a driving control circuit 149 for controlling the inverter 145 based on the output of the hall sensor 45 of the driving motor 40 and the output of the current detection circuit 147, as shown in FIG. 7.

The rectifying circuit 141 rectifies AC power of 50 Hz or 60 Hz supplied from the external power (AC) source. Specifically, the rectifying circuit 141 may control voltage polarity to apply an AC voltage applied in both (+) and (−) directions to the (+) direction, and control the current direction to have an AC current flowing both to (+) and (−) directions flow to the (+) direction.

In other words, the rectifying circuit 141 outputs voltage applied in one direction and current flowing in one direction.

The rectifying circuit 141 may include a diode bridge having a plurality of diodes D1, D2, D3, D4 connected in the form of a bridge, as shown in FIG. 7.

The smoothing circuit 143 eliminates ripples of the voltage output from the rectifying circuit 141 and outputs a constant magnitude of voltage.

The voltage output by the aforementioned rectifying circuit 141 is applied in a constant direction but varies in magnitude. The smoothing circuit 143 has the magnitude-varying voltage smoothened and outputs a DC voltage having a constant magnitude.

In other words, the smoothing circuit 143 outputs a constant voltage.

The smoothing circuit 143 may include a pair of conductor plates facing each other and a capacitor having a dielectric arranged between the pair of conductor plates, as shown in FIG. 7.

The inverter 145 uses the DC power output from the smoothing circuit 143 to supply a driving current to the driving motor 40.

The inverter 145 may include 6 switches Q1 to Q6, as shown in FIG. 7.

The inverter 145 may include a pair of input terminals and three pairs of output terminals.

The one pair of input terminals may be connected to a power output terminal of the smoothing circuit 143 and a ground terminal, and the three pairs of output terminals may be connected to u-phase, v-phase, and w-phase input terminals of the driving motor 40.

The upper switches Q1 to Q3 are connected between the power input terminal of the one pair of input terminals and the three pairs of output terminals, and the lower switches Q4 to Q5 are connected between the ground terminal of the one pair of input terminals and the three pairs of output terminals.

The upper switches Q1 to Q3 and the lower switches Q4 to Q6 are opened/closed in a predetermined sequence according to the driving control signal output by the driving control circuit 149, as will be described below.

The driving current is produced by opening/closing the upper switches Q1 to Q3 and the lower switches Q4 to Q6.

The current detection circuit 147 detects the driving current applied to the driving motor 147 from the inverter 145.

For example, the current detection circuit 147 may include a current transformer CT to proportionally decrease the magnitude of the driving current and an ampere meter to detect the magnitude of the proportionally decreased current. Specifically, the current detection circuit 147 may use the current transformer to proportionally decrease the magnitude of the driving current, and measure the magnitude of the proportionally decreased current to detect the driving current.

The driving control circuit 149 generates a driving control signal to control the inverter 145 based on the driving current supplied to the driving motor 40 and rotational displacement of the rotor of the driving motor 40.

Specifically, the driving control circuit 149 may calculate a rotation speed of the driving motor 40 based on the rotational displacement of the rotor output by the hall sensor 45, and calculate a target current by comparing the calculated rotation speed and a target speed $\omega^*$ output by the main controller 110. The driving control circuit 149 may also generate a driving control signal to control the inverter 145 by comparing the calculated target current and the current detection circuit 147.

In this way, the driving control circuit 149 controls the inverter 145 to rotate the driving motor 40 at the target speed ω* input from the main controller 110. Furthermore, under the control of the driving control circuit 149, the inverter 145 applies a driving current for the driving motor 40 to be rotated at the target speed ω*.

As described above, the motor driver 140 applies the driving current for the driving motor 40 to be rotated at the target speed ω*.

The controller 110 controls overall operation of the washing machine 1.

The controller 110 may include a memory 113 for storing a program and data, and a processor 111 for carrying out computational operation according to the program and data stored in the memory 113.

The memory 113 may store a control program and control data for controlling operation of the washing machine 1, user control commands received from the user through the user interface 120, laundry motion data detected by the motion detector 130, water level data detected by the water level detector 80, control signals based on the computation results from the processor 111, etc.

Specifically, the memory 113 may include volatile memories, such as Static Random Access Memories (S-RAMs), Dynamic RAMs (D-RAMs), or the like, and non-volatile memories, such as Read Only Memories (ROMs), Erasable Programmable ROMs (EPROMs), Electrically Erasable Programmable ROMs (EEPROMs), or the like.

Specifically, the non-volatile memory may semi-permanently store the control program and control data to control operation of the washing machine 1.

The volatile memory may fetch the control program and control data from the non-volatile memory and temporarily store them, or may temporarily store the user control command, motion data, water level data, etc.

The processor 111 processes the data stored in the memory 113 according to the control program stored in the memory 113.

For example, the processor 111 may process the user control command, the laundry motion data and the water level data, and generate control signals to control the motor driver 140, the water supplier 50, the drain part 60 and the detergent supplier 70.

Specifically, the processor 111 may output a water valve open signal to open the water valve 52 of the water supplier 50 according to a user control command, and output a water valve close signal to stop supplying water based on the water level data.

The processor 111 may also generate a detergent pump activate signal to supply detergent while water is being supplied, and generate a detergent pump deactivate signal when the detergent supply is completed.

Furthermore, the processor 111 may generate target speed data to rotate the drum 30 during the washing or rinsing course.

When the washing or rinsing course is finished, the processor 111 may output a drain pump activate signal to drain water out of the tub 20, and output a drain pump deactivate signal to stop supplying water according to the water level data.

As such, the controller 110 may control operation of the washing machine 1 using the program and data stored in the memory 113, and computational operation of the processor 111.

Operation of the washing machine 1, as will be described below, may be interpreted as operation controlled by the controller 110.

The aforementioned configuration of the washing machine 1 is only by way of example for specifying the present disclosure, and should not be limited thereto.

The motion detector 130 will now be described in detail.

As described above, the motion detector 130 may detect a motion of the laundry contained in the drum 30 while the drum 30 is rotated.

Before describing the motion detector 130, motion of the laundry contained in the drum 30 while the drum 30 is rotated will be described.

FIG. 8 shows exemplary laundry motions by rotation of a drum included in a washing machine, according to an embodiment of the present disclosure.

Laundry L contained in the drum 30 shows various motions at different rotation speeds of the drum 30.

Specifically, while the drum 30 is rotated, the laundry L is subject to frictional force between the inner circumferential face of the drum 30 and the laundry L, centrifugal force due to the rotation of the drum 30, and gravitational force. Motions of the laundry L may vary depending on strengths of the frictional force, the centrifugal force, and the gravitational force.

While the drum 30 is rotated, the laundry L on the bottom of the drum 30 may be lifted up the drum 30 while being rotated along with the inner circumferential face of the drum 30 according to the frictional force. In this regard, if the centrifugal force due to rotation of the drum 30 decreases, the laundry L being lifted up the drum 30 falls to the bottom of the drum 30 due to the gravity of the laundry L.

In other words, if the rotation speed of the drum 30 is slow, the laundry L may fall to the bottom of the drum 30 from a relatively low height, but if the rotation speed of the drum 30 is fast, the laundry L may lifted up an upper part of the drum 30 and then fall down to the bottom of the drum 30. Further, if the rotation speed of the drum 30 is very fast, the laundry L may be rotated along with the drum 30 while being pushed close to the inner circumferential face of the drum 30.

For example, if the drum 30 is rotated at a rotation speed of about 30 rpm (revolution per minute), the laundry L is lifted up to a mid-level of the drum 30 (e.g., about 60 degrees from the bottom B of the drum) and then falls to the bottom of the drum 30, as shown in (a) of FIG. 8.

In other words, the laundry L falls to the bottom B of the drum 30 from a first fall position FP1 within about 60 degrees from the bottom B of the drum 30. As a result, the laundry L shows a motion as if rolling on the bottom of the drum 30.

In another example, if the drum 30 is rotated at a rotation speed of about 45 rpm, the laundry L is lifted up to an upper part of the drum 30 (e.g., about 120 to 180 degrees from the bottom B of the drum) and then falls to the bottom of the drum 30, as shown in (b) of FIG. 8.

In other words, the laundry L falls to the bottom of the drum 30 from a second fall position FP2 within about 60 to 120 degrees from the bottom B of the drum 30. As a result, the laundry L shows a motion as if falling from an upper part of the drum 30.

In still another example, if the drum 30 is rotated at a rotation speed of about 60 rpm, the laundry L is pushed close to the inner circumferential face of the drum 30 and rotated along with the drum 30, as shown in (c) of FIG. 8.

In other words, the laundry L is rotated along with the drum 30 without being separated from the drum 30.

In this way, the laundry L inside the drum 30 shows motion like rolling (hereinafter, referred to as "rolling motion"), motion like falling (hereinafter, referred to as "falling motion"), and motion like rotating (hereinafter, referred to as "rotation motion"), depending on the rotation speed of the drum 30.

In the aforementioned example, the laundry L shows rolling motion while the drum 30 is rotated at about 30 rpm, falling motion while the drum 30 is rotated at about 45 rpm, and rotation motion while the drum 30 is rotated about 60 rpm.

However, this is merely by way of example. For example, while the drum 30 is rotated at 30 rpm, the laundry L does not necessarily show the rolling motion.

The motion of the laundry L may vary depending not only on the rotation speed of the drum 30 but also on the texture of clothing of the laundry L (stiffness of the cloth) and water absorbency of the laundry L.

In other words, the rotation speed of the drum 30 is only one factor for determining the motion of the laundry L, i.e., the motion of the laundry L is not defined only by the rotation speed of the drum 30.

However, conventional washing machines determine the motion of the laundry based on the rotation speed of the drum, and turn the drum at a predetermined speed to implement a particular motion of the laundry.

By contrast, the washing machine 1 according to an embodiment of the present disclosure may include the motion detector 130 for detecting a motion of the laundry L to directly detect the motion of the laundry L. As a result, the washing machine 1 in accordance with the embodiment may accurately implement a desired motion of the laundry L.

Various implementation forms of the motion detector 130 will now be described.

As described above, the motion detector 130 may have various forms.

For example, the motion detector 130 may include a position identification member attached to the laundry L and a position detector for detecting a position of the position identification member, and determine a motion of the laundry L based on the motion of the position identification member detected by the position detector.

In such a case that the motion detector 130 includes the position identification member and the motion detector, the motion detector 130 may employ a radio frequency (RF) tag for outputting a radio signal as the position identification member, and an RF receiver for detecting a position of the RF tag as the position detector.

In another example, the motion detector 130 may detect the laundry L in a particular position inside the drum 30, and even determine a motion of the laundry L based on the frequency of detecting the laundry L in the position.

In such a case that the motion detector 130 detects a position of the laundry L in a particular position, a laundry detection sensor may be employed to emit a detection medium or detection energy toward the inside of the drum 30 from a predetermined position and determine the position and motion of the laundry L based on a detection medium or detection energy reflected by the laundry L.

Specifically, the motion detector 130 may employ an infrared sensor module for emitting infrared rays from a predetermined position to the inside of the drum 30 and detecting reflected infrared rays bounced off from the laundry L, a laser sensor module for emitting laser to the inside of the drum 30 and detecting laser reflected from the laundry L, etc.

In addition, the motion detector 130 may employ a radar sensor module for emitting radio waves to the inside of the drum 30 and detecting reflected radio waves bounced off from the laundry L, an ultrasonic sensor module for emitting ultrasound to the inside of the drum 30 and detecting ultrasound reflected from the laundry L, etc.

In other words, the motion detector 130 may employ various sensor modules capable of detecting if the laundry L exists in a particular position in the drum 30.

For easy understanding, the washing machine 1 is assumed to employ a laundry detection sensor as the motion detector 130.

FIGS. 9 and 10 show an exemplary motion detector included in a washing machine, according to an embodiment of the present disclosure.

Referring to FIGS. 9 and 10, the motion detector 130 may include a laundry detection sensor 131 for emitting infrared rays, laser, radio waves, ultrasound, or the like to the inside of the drum 30, and detecting infrared rays, laser, radio waves, ultrasound, or the like reflected from the laundry L inside the drum 30.

The laundry detection sensor 131 may be arranged on one side of the door 13 of the washing machine 1.

For example, the laundry detection sensor 131 may be installed in a position of about 120 degrees counterclockwise from the bottom of the door 13, as shown in FIG. 9. In other words, the laundry detection sensor 131 may be installed in a position of about 120 degrees counterclockwise from the bottom of the drum 30.

In such a case that the laundry detection sensor 131 is installed in the position of about 120 degrees counterclockwise from the bottom of the door 13, frequency with which the laundry detection sensor 131 detects the laundry may vary depending on the direction of rotation of the drum 30.

Furthermore, the door 13 is comprised of a transparent part 13*a*, which is transparent to light and an opaque part 13*b*, which is not transparent to light, and the transparent part 13*a* is arranged near the center of the door 13 while the opaque part 13*b* is arranged near the edge of the door 13.

If the laundry detection sensor 131 uses light as a detection medium, such as the laser sensor module, infrared sensor module, etc., the laundry detection sensor 131 may be installed on the transparent part 13*a* of the door 13, as shown in FIG. 9.

The laundry detection sensor 131 may emit a detection medium, such as infrared rays, laser, radio waves, or ultrasound toward the inside of the drum 13, as shown in FIG. 10.

If the detection medium, such as infrared rays, laser, radio waves, or ultrasound is reflected off the laundry L and the laundry detection sensor 131 detects the detection medium reflected from the laundry L, the washing machine 1 may determine that the laundry L is positioned to correspond to the laundry detection sensor 131. If the detection medium is not reflected off the laundry L and the laundry detection sensor 131 does not detect the detection medium, the washing machine 1 may determine that the laundry L is not positioned to correspond to the laundry detection sensor 131.

A detection region DR for the laundry detection sensor 131 to detect the laundry L may have the form of a thin bar, as shown in FIG. 10.

Outputs of the laundry detection sensor 131 according to motions of the laundry L will now be described.

FIGS. 11 to 13 show outputs of the motion detector shown in FIGS. 9 and 10 according to motions of the laundry, and FIG. 14 shows detection results from the motion detector shown in FIGS. 9 and 10 according to rotation speeds of a drum. FIG. 15 shows classifications of laundry motions according to detection results from the motion detector shown in FIGS. 9 and 10.

In the case of rolling motion, the laundry L moves as if rolling on the bottom of the drum 30, as described above.

As shown in (a) of FIG. 11, if the drum 30 is rotated counterclockwise, the laundry detection sensor 131 installed in a position corresponding to about 120 degrees counterclockwise from the bottom B of the drum 30 may rarely detect the laundry L.

Also, if the drum 30 is rotated clockwise, the laundry detection sensor 131 barely detects the laundry L.

As a result, as shown in (b) of FIG. 11, outputs of the laundry detection sensor 131 show that detection time for which the laundry detection sensor 131 detects the laundry L is shorter than non-detection time for which the laundry L is not detected.

According to an experiment, in the case that the laundry L is doing the rolling motion, as shown in FIG. 14, a detection time duty ratio representing a ratio of time of detecting the laundry L by the laundry detection sensor 131 to the entire time for which the laundry detection sensor 131 is operated to detect the laundry L is less than about 10%.

This numerical value, however, may vary by another factor, such as the size of the drum 30, without being limited thereto.

Next, in the case of falling motion, the laundry L is lifted up the drum 30 and then falls to the bottom of the drum 30, as described above.

As shown in (a) of FIG. 12, if the drum 30 is rotated counterclockwise, the laundry detection sensor 131 installed at about 120 degrees counterclockwise from the bottom B of the drum 30 may detect the laundry L lifted up the drum 30.

On the other hand, if the drum 30 is rotated clockwise, the laundry detection sensor 131 may rarely detect the laundry L as the laundry L is moved along the inner circumferential face of the drum 30 on the opposite side of the laundry detection sensor 131.

In the case that the drum 30 is alternately rotated clockwise and counterclockwise, the detection time duty ratio representing frequency with which the laundry detection sensor 131 detects the laundry L may be around 40%, as shown in (b) of FIG. 12.

However, the detection time duty ratio may be smaller or larger than 40% depending on the rotation speed of the drum 30.

For example, as the rotation speed of the drum 30 increases, the laundry L may pass around 180 degrees from the bottom B of the drum 30 in the rotation direction of the drum 30 and then fall to the bottom of the drum 30. In other words, in the case that the drum 30 is rotated clockwise, the laundry L may fall from the right side of the drum 30. In this case, the laundry detection sensor 131 may detect the laundry L. Accordingly, the detection time duty ratio of the laundry detection sensor 131 detecting the laundry may exceed 40%.

Furthermore, if the rotation speed of the drum 30 decreases, frequency of falling of the laundry L is reduced as the rotation speed of the drum 30 decreases. That is, probability of the laundry L being lifted up the drum 30 is reduced. Accordingly, if the drum 30 is rotated counterclockwise, the detection time duty ratio of the laundry detection sensor 131 detecting the laundry may be less than 40%.

According to an experiment, in the case that the laundry L is doing the falling motion, as shown in FIG. 14, the detection time duty ratio representing frequency with which the laundry detection sensor 131 detects the laundry L is about 10% to 70% depending on the rotation speed of the drum 30.

This numerical value, however, may vary by another factor, such as the size of the drum 30, without being limited thereto.

Next, in the case of rotation motion, the laundry L is rotated along with the drum 30 while being pushed close to the inner circumferential face of the drum 30, as described above.

As shown in (a) of FIG. 13, if the drum 30 is rotated counterclockwise, the laundry detection sensor 131 may detect most of the laundry L because the laundry L is rotated along with the drum 30 while being pushed close to the inner circumferential face of the drum 30.

Also, if the drum 30 is rotated clockwise, the laundry detection sensor 131 may detect most of the laundry L because the laundry L is rotated along with the drum 30 while being pushed close to the inner circumferential face of the drum 30.

Consequently, as shown in (b) of FIG. 13, detection time for which the laundry detection sensor 131 detects the laundry L is longer than non-detection time for which the laundry L is not detected.

According to an experiment, in the case that the laundry L is doing the rotation motion, as shown in FIG. 14, the detection time duty ratio representing frequency with which the laundry detection sensor 131 detects the laundry L is about 70% or more.

This numerical value, however, may vary by another factor, such as the size of the drum 30, without being limited thereto.

According to such motions of the laundry L, the detection time duty ratio representing frequency with which the laundry detection sensor 131 detects the laundry L varies.

For example, as shown in FIG. 14, the detection time duty ratio of the laundry detection sensor 131 is less than about 10% in the case of rolling motion, the detection time duty ratio is about 10% to 70% in the case of falling motion, and the detection time duty ratio is about 70% or more in the case of rotation motion.

Based on such experimental data, a motion of the laundry L may be defined by a duty ratio.

For example, as shown in FIG. 15, while the drum 30 is rotated, if the detection time duty ratio of the laundry detection sensor 131 is less than a first reference value, the washing machine 1 may determine the motion of the laundry L to be the rolling motion, and if the detection time duty ratio of the laundry detection sensor 131 is equal to or greater than the first reference value but less than a second reference value, the washing machine 1 may determine the motion of the laundry L to be the falling motion. Furthermore, if the detection time duty ratio of the laundry detection sensor 131 is equal to or greater than the second reference value, the washing machine 1 may determine the motion of the laundry L to be the rotation motion.

The first and second reference values may be defined through experiments. According to the aforementioned experiments, the first reference value may be set to about 10% and the second reference value may be set to about 70%.

Since probability of the laundry detection sensor 131 detecting the laundry L increases if there is a large amount of laundry L, the washing machine 1 may increase the first and second reference values. Furthermore, since because probability of the laundry detection sensor 131 detecting the laundry L decreases if there is a small amount of laundry L, the washing machine 1 may decrease the first and second reference values.

As such, the washing machine 1 may change the first and second reference values based on an amount of the laundry L.

The washing machine 1 may implement the aforementioned motions of the laundry L by controlling the rotation speed of the drum 30. For example, the washing machine 1 may rotate the drum 30 at a rotation speed of about 30 rpm in order to implement the rolling motion of the laundry L.

However, as described above, the motion of the laundry L varies not only by the rotation speed of the drum 30 but also by the amount, material, or water absorbency of the laundry L, and thus, the laundry L may do the falling motion even if the washing machine 1 rotates the drum at about 30 rpm.

Accordingly, the washing machine 1 controls the rotation speed of the drum 30 based on detection results from the motion detector 130 in order to implement a target motion of the laundry L.

FIGS. 16 to 18 are flowcharts of a method for a washing machine to implement motions of the laundry, according to an embodiment of the present disclosure.

First, referring to FIG. 16, a method 1100 for the washing machine 1 to implement the rolling motion of the laundry L will be described.

The washing machine 1 determines if a target motion is the rolling motion (1110).

The target motion is a motion of the laundry L determined in advance to protect the laundry L with maximized washing performance. The target motion may be one of the rolling, falling, and rotation motions, and the washing machine 1 may implement the rolling, falling, and rotation motions in a predetermined sequence. For example, if the laundry L is clothing of a material vulnerable to impact, such as silk, wool, etc., the washing machine 1 may use the rolling motion.

If the target motion of the laundry L is the rolling motion (YES of 1110), the washing machine 1 rotates the drum 30 at a first initial speed (1120).

The first initial speed refers to a rotation speed of the drum 30 doing the rolling motion based on a case where an amount of the laundry L corresponds to a standard amount often used by the user and a material of the laundry L is what is often washed by the user.

For example, the first initial speed may be set to about 30 rpm.

Furthermore, the washing machine 1 may change the first initial speed based on an amount of the laundry L. For example, the first initial speed may be increased if the laundry L is large in amount, and the first initial speed may be decreased if the laundry L is small in amount.

After rotating the drum 30 at the first initial speed, the washing machine 1 determines if the detection time duty ratio of the laundry detection sensor 131 is less than the first reference value (1130).

As described above, the washing machine 1 may determine a motion of the laundry L based on the detection time duty ratio output by the laundry detection sensor 131. Specifically, the washing machine 1 may determine if the laundry L is doing the rolling motion, based on whether the detection time duty ratio is less than the first reference value.

The first reference value may be set to 10%, as described above.

If the detection time duty ratio is equal to or greater than the first reference value (NO of 1130), the washing machine 1 decreases the rotation speed of the drum 30 (1140).

If the detection time duty ratio is equal to or greater than the first reference value, the washing machine 1 may determine that the motion of the laundry L is not the rolling motion but the falling motion. In other words, the washing machine 1 may determine that the laundry L is falling to the bottom of the drum 30 from an upper part of the drum 30.

In response, the washing machine 1 may decrease the rotation speed of the drum 30 to not lift the laundry L up the drum 30.

After that, the washing machine 1 repeats comparison of the detection time duty ratio and the first reference value.

If the detection time duty ratio is less than the first reference value (YES of 1130), the washing machine 1 stops controlling the rotation speed of the drum 30.

If the detection time duty ratio is less than the first reference value, the washing machine 1 may determine that the motion of the laundry L is the rolling motion. That is, the washing machine 1 may determine that the laundry L is moving as if rolling on the bottom of the drum 30.

Accordingly, the washing machine 1 maintains the current rotation speed of the drum 30 without changing the rotation speed of the drum 30, and stops controlling the rotation speed of the drum 30.

Next, referring to FIG. 17, a method 1200 for the washing machine 1 to implement the falling motion of the laundry L will be described.

The washing machine 1 determines if a target motion is the falling motion (1210).

To maximize the washing performance and protect the laundry, the washing machine 1 may use various motions of the laundry L depending on the amount, material, etc., of the laundry L. The falling motion is known to be a motion of the laundry L having the best washing performance.

Accordingly, to maximize the washing performance, the washing machine 1 may include the falling motion in motions of the laundry L to wash the laundry L.

If the target motion of the laundry L is the falling motion (YES of 1210), the washing machine 1 rotates the drum 30 at a second initial speed (1220).

The second initial speed refers to a rotation speed of the drum 30 doing the falling motion based on a case where an amount of the laundry L corresponds to a standard amount often used by the user and a material of the laundry L is what is often washed by the user.

For example, the second initial speed may be set to about 45 rpm.

Furthermore, the washing machine 1 may change the second initial speed based on an amount of the laundry L. For example, the second initial speed may be increased if the laundry L is large in amount, and the second initial speed may be decreased if the laundry L is small in amount.

After rotating the drum 30 at the second initial speed, the washing machine 1 determines if the detection time duty ratio of the laundry detection sensor 131 is equal to or greater than the first reference value (1230).

As described above, the washing machine 1 may determine a motion of the laundry L based on the detection time duty ratio output by the laundry detection sensor 131. Specifically, the washing machine 1 may determine if the laundry L is doing the falling motion, based on whether the detection time duty ratio is equal to or greater than the first reference value.

The first reference value may be set to 10%, as described above.

If the detection time duty ratio is less than the first reference value (NO of 1230), the washing machine 1 increases the rotation speed of the drum 30 (1240).

If the detection time duty ratio is less than the first reference value, the washing machine 1 may determine that the motion of the laundry L is not the falling motion but the rolling motion. In other words, the washing machine 1 may determine that the laundry L is moving as if rolling on the bottom of the drum 30.

In response, the washing machine 1 may increase the rotation speed of the drum 30 to lift the laundry L up the drum 30.

After that, the washing machine 1 repeats comparison of the detection time duty ratio and the first reference value.

If the detection time duty ratio is equal to or greater than the first reference value (YES of 1230), the washing machine 1 determines if the detection time duty ratio of the laundry detection sensor 131 is less than the second reference value (1250).

The washing machine 1 may determine whether the laundry L is doing the falling motion or the rotation motion based on whether the detection time duty ratio is less than the second reference value.

The second reference value may be set to 70%, as described above.

If the detection time duty ratio is equal to or greater than the second reference value (NO of 1250), the washing machine 2 decreases the rotation speed of the drum 30 (1260).

If the detection time duty ratio is equal to or greater than the second reference value, the washing machine 1 may determine that the motion of the laundry L is not the falling motion but the rotation motion. In other words, the washing machine 1 may determine that the laundry L is rotated along with the drum 30 while being pushed close to the inner circumferential face of the drum 30.

In response, the washing machine 1 may decrease the rotation speed of the drum 30 for the laundry L not to be rotated along with the drum 30 but to fall from an upper part of the drum 30 to the bottom.

After that, the washing machine 1 repeats comparison of the detection time duty ratio and the second reference value.

If the detection time duty ratio is less than the second reference value (YES of 1250), the washing machine 2 stops controlling the rotation speed of the drum 30.

If the detection time duty ratio is equal to and greater than the first reference value and less than the second reference value, the washing machine 1 may determine that the motion of the laundry L is the falling motion. In other words, the washing machine 1 may determine that the laundry L is falling to the bottom of the drum 30 from an upper part of the drum 30.

Accordingly, the washing machine 1 maintains the current rotation speed of the drum 30 without changing the rotation speed of the drum 30, and stops controlling the rotation speed of the drum 30.

Lastly, referring to FIG. 18, a method 1300 for the washing machine 1 to implement the rotation motion of the laundry L will be described.

The washing machine 1 determines if a target motion is the rotation motion (1310).

To maximize the washing performance and protect the laundry, the washing machine 1 may use various motions of the laundry L depending on the amount, material, etc., of the laundry L.

The laundry L is often not mixed together by the rotation of the drum 30 but remains in the initial position if the laundry L is large in amount. In other words, the laundry L is stuck together and not easily separated.

Since the rotation motion allows the laundry L to be separated from each other and rotated along with the inner circumferential face, it enables the laundry L to be mixed together. In other words, it may cause the laundry L to be shifted to another position.

For the same reason, if the laundry L is large in amount, the washing machine 1 may include the rotation motion in motions of the laundry L to wash the laundry L to maximize the washing performance.

If the target motion of the laundry L is the rotation motion (YES of 1310), the washing machine 1 rotates the drum 30 at a third initial speed (1320).

The third initial speed refers to a rotation speed of the drum 30 doing the rotation motion based on a case where an amount of the laundry L corresponds to a standard amount often used by the user and a material of the laundry L is what is often washed by the user.

For example, the third initial speed may be set to about 60 rpm.

Furthermore, the washing machine 1 may change the third initial speed based on an amount of the laundry L. For example, the third initial speed may be increased if the laundry L is large in amount, and the third initial speed may be decreased if the laundry L is small in amount.

After rotating the drum 30 at the third initial speed, the washing machine 1 determines if the detection time duty ratio of the laundry detection sensor 131 is equal to or greater than the second reference value (1330).

As described above, the washing machine 1 may determine a motion of the laundry L based on the detection time duty ratio output by the laundry detection sensor 131. Specifically, the washing machine 1 may determine whether the laundry L is doing the falling motion or the rotation motion, based on whether the detection time duty ratio is equal to or greater than the second reference value.

The second reference value may be set to 70%, as described above.

If the detection time duty ratio is less than the first reference value (NO of 1330), the washing machine 1 increases the rotation speed of the drum 30 (1340).

If the detection time duty ratio is less than the second reference value, the washing machine 2 may determine that the motion of the laundry L is not the rotation motion but the falling motion. In other words, the washing machine 1 may determine that the laundry L is falling from an upper part of the drum 30 to the bottom.

In response, the washing machine 1 may increase the rotation speed of the drum 30 for the laundry L to be pushed close to the inner circumferential face of the drum 30 and rotated along with the drum 30.

After that, the washing machine 1 repeats comparison of the detection time duty ratio and the second reference value.

If the detection time duty ratio is equal to or greater than the second reference value (YES of 1330), the washing machine 2 stops controlling the rotation speed of the drum 30.

If the detection time duty ratio is equal to or greater than the second reference value, the washing machine 1 may determine that the motion of the laundry L is the rotation motion. In other words, the washing machine 1 may determine that the laundry L is rotated along with the drum 30 while being pushed close to the inner circumferential face of the drum 30.

Accordingly, the washing machine 1 maintains the current rotation speed of the drum 30 without changing the rotation speed of the drum 30, and stops controlling the rotation speed of the drum 30.

Configuration of the motion detector 130, method for identifying motions of the laundry L, and method for implementing a motion of the laundry L in the case that the motion detector 130 includes the laundry detection sensor 131 were described above.

However, the configuration and operation of the motion detector 130 is not limited thereto, but the motion detector 130 may include any other configuration and perform any other operation for detecting the motion of the laundry L.

FIGS. 19 and 20 show another exemplary motion detector included in a washing machine, according to an embodiment of the present disclosure.

Referring to FIGS. 19 and 20, the motion detector 130 may include first and second laundry detection sensors 133 and 135 for emitting infrared rays, laser, radio waves, ultrasound, or the like to the inside of the drum 30, and detecting infrared rays, laser, radio waves, ultrasound, or the like reflected from the laundry L inside the drum 30.

The first and second laundry detection sensors 133 and 135 may be arranged on one side of the door 13 of the washing machine 1.

For example, as shown in FIG. 19, the first laundry detection sensor 133 may be installed on the upper position of the center of the door 13 and the second laundry detection sensor 135 may be installed around the center of the door 13.

In such a case that the first laundry detection sensor 133 is located on the upper position of the center of the drum 30 and the second laundry detection sensor 135 is located around the center of the drum 30, frequency with which the first and second laundry detection sensors 133 and 135 detects the laundry does not significantly vary depending on the rotational direction of the drum 30.

Furthermore, if the first and second laundry detection sensors 133 and 135 use light as a detection medium, such as the laser sensor module, infrared sensor module, etc., the first and second laundry detection sensors 133 and 135 may be installed on the transparent part 13*a* of the door 13, as shown in FIG. 19.

The first and second laundry detection sensors 133 and 135 may emit a detection medium, such as infrared rays, laser, radio waves, or ultrasound toward the inside of the drum 13, as shown in FIG. 20.

If the detection medium, such as infrared rays, laser, radio waves, or ultrasound is reflected off the laundry L and the first and second laundry detection sensors 133 and 135 detect the detection medium reflected from the laundry L, the washing machine 1 may determine that the laundry L is positioned to correspond to the first and second laundry detection sensors 133 and 135.

Specifically, the washing machine 1 may determine that the laundry L is positioned to correspond to the first laundry detection sensor 133 if the first laundry detection sensor 133 detects a detection medium reflected from the laundry L, and the washing machine 1 may determine that the laundry L is positioned to correspond to the laundry detection sensor 135 if the second laundry detection sensor 135 detects the detection medium reflected from the laundry L.

A detection region DR for the laundry detection sensor 131 to detect the laundry L may have the form of a thin bar, as shown in FIG. 20.

Outputs of the first and second laundry detection sensors 133 and 135 according to motions of the laundry L will now be described.

FIGS. 21 to 23 show outputs of the motion detector shown in FIGS. 19 and 20 according to motions of the laundry, and FIG. 24 shows detection results from the motion detector shown in FIGS. 19 and 20 according to rotation speeds of a drum. FIG. 25 shows classifications of laundry motions according to detection results from the motion detector shown in FIGS. 19 and 20.

In the case of the rolling motion, the laundry L moves as if rolling on the bottom of the drum 30, as described above.

Accordingly, the first laundry detection sensor 133 installed on the upper position of the center of the drum 30 may very rarely detect the laundry L, as shown in (a) of FIG. 21.

Consequently, as shown in (b) of FIG. 21, first detection time for which the first laundry detection sensor 133 detects the laundry L is shorter than non-detection time for which the laundry L is not detected.

According to an experiment, as shown in FIG. 24, a first detection time duty ratio representing a ratio of first detection time of detecting the laundry L by the first laundry detection sensor 133 to the entire time for which the first laundry detection sensor 133 is operated to detect the laundry L is less than about 10%.

On the other hand, the second laundry detection sensor 135 installed around the center of the drum 30 may often detect the laundry L than the first laundry detection sensor 133.

If the laundry L is doing the rolling motion, part of the laundry L may pass around the center of the drum 30, as shown in (a) of FIG. 21. The second laundry detection sensor 135 may then detect the laundry L passing around the center of the drum 30.

Consequently, as shown in (c) of FIG. 21, second detection time for which the second laundry detection sensor 135 detects the laundry L is longer than the first detection time for which the first laundry detection sensor 133 detects the laundry L.

According to an experiment, in the case that the laundry L is doing the rolling motion, as shown in FIG. 24, a second detection time duty ratio representing a ratio of second detection time of detecting the laundry L by the second laundry detection sensor 135 to the entire time for which the second laundry detection sensor 135 is operated to detect the laundry L is less than about 20%.

This numerical value, however, may vary by another factor, such as the size of the drum 30, without being limited thereto.

Next, in the case of falling motion, the laundry L is lifted up the drum 30 and then falls to the bottom of the drum 30, as described above. Accordingly, as shown in (a) of FIG. 22, the first laundry detection sensor 133 installed on the upper position of the center of the drum 30 and the second laundry detection sensor 135 installed around the center of the drum 30 may detect the laundry L falling from the upper part of the drum 30 to the bottom.

Consequently, the first detection time for which the first laundry detection sensor 133 detects the laundry L and the second detection time for which the second laundry detection sensor 135 detects the laundry L are similar to what are shown in (b) and (c) of FIG. 22.

According to an experiment, in the case that the laundry L is doing the falling motion, as shown in FIG. 24, the first detection time duty ratio of the first laundry detection sensor 133 detecting the laundry is about 10% to 70%, and the second detection time duty ratio of the second laundry detection sensor 133 detecting the laundry L is about 20% to 40%.

The numerical values, however, may vary by another factor, such as the size of the drum 30, without being limited thereto.

Next, in the case of rotation motion, the laundry L is rotated along with the drum 30 while being pushed close to the inner circumferential face of the drum 30, as described above.

Accordingly, the first laundry detection sensor 133 installed on the upper position of the center of the drum 30 may detect the laundry L rotated along with the drum 30, as shown in (a) of FIG. 23.

Consequently, as shown in (b) of FIG. 23, the first detection time for which the first laundry detection sensor 133 detects the laundry L is longer than non-detection time for which the laundry L is not detected.

On the contrary, since the laundry L is rotated while being pushed close to the inner circumferential face of the drum L, the second laundry detection sensor 135 installed around the center of the drum 30 may rarely detect the laundry L, as shown in (b) of FIG. 23.

Consequently, as shown in (c) of FIG. 23, second detection time for which the second laundry detection sensor 135 detects the laundry L is shorter than non-detection time for which the laundry L is not detected. Besides, the second detection time is shorter than the first detection time.

According to an experiment, in the case that the laundry L is doing the rotation motion, as shown in FIG. 24, the first detection time duty ratio of the first laundry detection sensor 133 detecting the laundry is about 70% or more, and the second detection time duty ratio of the second laundry detection sensor 135 detecting the laundry L is less than about 40%.

The numerical values, however, may vary by another factor, such as the size of the drum 30, without being limited thereto.

Depending on such motions of the laundry L, the first detection time duty ratio representing frequency with which the first laundry detection sensor 133 detects the laundry L and a second detection time duty ratio representing frequency with which the second laundry detection sensor 135 detects the laundry L vary.

For example, as shown in FIG. 24, the first detection time duty ratio of the first laundry detection sensor 133 is less than 10% in the case of rolling motion, the first detection time duty ratio is about 10% to 70% in the case of falling motion, and the first detection time duty ratio is about 70% or more in the case of rotation motion. Furthermore, as shown in FIG. 24, as the rotation speed of the drum 30 increases, the first detection time duty ratio increases.

By contrast, the second detection time duty ratio of the second laundry detection sensor 135 is less than 20% in the case of rolling motion, the second detection time duty ratio is about 20% to 40% in the case of falling motion, and the second detection time duty ratio is less than about 40% in the case of rotation motion.

Furthermore, in the case of falling motion, the second detection time duty ratio increases as the rotation speed increases, and in the case of rotation motion, the second detection time duty ratio decreases as the rotation speed increases.

Consequently, the difference between the first and second detection time duty ratios is not big in the case of falling motion while the difference between the first and second detection time duty ratios is big in the case of rotation motion.

With the same reason, as shown in FIG. 25, motions of the laundry L may be divided into rolling, falling, and rotation motions based on the first and second detection time duty ratios.

For example, as shown in FIG. 25, while the drum 30 is rotated, the washing machine 1 may determine the motion of the laundry L to be the rolling motion if the first detection time duty ratio of the first laundry detection sensor 133 is less than a third reference value.

Furthermore, the washing machine 1 may determine the motion of the laundry L to be the falling motion if the first detection time duty ratio of the first laundry detection sensor 133 is equal to or greater than the third reference value and a ratio of the first detection time of the first laundry detection sensor 133 to a second detection time of the second laundry detection sensor 133 is less than a fourth reference value.

Furthermore, the washing machine 1 may determine the motion of the laundry L to be the rotation motion if the first detection time duty ratio of the first laundry detection sensor 133 is equal to or greater than the third reference value and a ratio of the first detection time of the first laundry detection sensor 133 to a second detection time of the second laundry detection sensor 133 is equal to or greater than the fourth reference value.

The third and fourth reference values may be defined through experiments. According to the aforementioned experiments, the third reference value may be set to about 10% and the fourth reference value may be set to about 1.5.

Since probability of the laundry detection sensor 131 detecting the laundry L increases if there is a large amount of the laundry L, the washing machine 1 may increase the third reference value. Furthermore, since probability of the laundry detection sensor 131 detecting the laundry L decreases if there is a small amount of the laundry L, the washing machine 1 may decrease the third reference value.

As such, the washing machine 1 may change the third reference value based on an amount of the laundry L.

The washing machine 1 may implement the aforementioned motions of the laundry L by controlling the rotation speed of the drum 30. For example, the washing machine 1 may rotate the drum 30 at a rotation speed of about 30 rpm in order to implement the rolling motion of the laundry L.

However, as described above, the motion of the laundry L varies not only by the rotation speed of the drum 30 but also by the amount, texture, or water absorbency of the laundry L, and thus, the laundry L may do the falling motion even if the washing machine 1 rotates the drum at about 30 rpm.

Accordingly, the washing machine 1 controls the rotation speed of the drum 30 based on detection results from the motion detector 130 in order to implement a target motion of the laundry L.

FIGS. 26 to 28 are flowcharts of a method for a washing machine to implement motions of the laundry, according to an embodiment of the present disclosure.

First, referring to FIG. 26, a method 1400 for the washing machine 1 to implement the rolling motion of the laundry L will be described.

The washing machine 1 determines if a target motion is the rolling motion (1410).

The target motion is a motion of the laundry L determined in advance to protect the laundry L with maximized washing performance. The target motion may be one of the rolling, falling, and rotation motions, and the washing machine 1 may implement the rolling, falling, and rotation motions in a predetermined sequence. For example, if the laundry L is clothing of a material vulnerable to impact, such as silk, wool, etc., the washing machine 1 may use the rolling motion.

If the target motion of the laundry L is the rolling motion (YES of 1410), the washing machine 1 rotates the drum 30 at a first initial speed (1420).

The first initial speed refers to a rotation speed of the drum 30 doing the rolling motion based on a case where an amount of the laundry L corresponds to a standard amount often used by the user and a material of the laundry L is what is often washed by the user.

For example, the first initial speed may be set to about 30 rpm.

Furthermore, the washing machine 1 may change the first initial speed based on an amount of the laundry L. For example, the first initial speed may be increased if the laundry L is large in amount, and the first initial speed may be decreased if the laundry L is small in amount.

After rotating the drum 30 at the first initial speed, the washing machine 1 determines if the first detection time duty ratio of the first laundry detection sensor 133 is less than the third reference value (1430).

As described above, the washing machine 1 may determine a motion of the laundry L based on outputs of the first and second laundry detection sensors 133 and 135. Specifically, the washing machine 1 may determine if the motion of the laundry L is the rolling motion, based on whether the first detection time duty ratio of the first laundry detection sensor 133 is less than the third reference value.

The third reference value may be set to 10%, as described above.

If the first detection time duty ratio is equal to or greater than the third reference value (NO of 1430), the washing machine 1 decreases the rotation speed of the drum 30 (1440).

If the first detection time duty ratio is equal to or greater than the third reference value, the washing machine 1 may determine that the motion of the laundry L is not the rolling motion but the falling motion. In other words, the washing machine 1 may determine that the laundry L is falling to the bottom of the drum 30 from an upper part of the drum 30.

In response, the washing machine 1 may decrease the rotation speed of the drum 30 to not lift the laundry L up the drum 30.

After that, the washing machine 1 repeats comparison of the first detection time duty ratio and the third reference value.

If the first detection time duty ratio is less than the third reference value (YES of 1430), the washing machine 3 stops controlling the rotation speed of the drum 30.

If the first detection time duty ratio is less than the third reference value, the washing machine 3 may determine that the motion of the laundry L is the rolling motion. That is, the washing machine 1 may determine that the laundry L is moving as if rolling on the bottom of the drum 30.

Accordingly, the washing machine 1 maintains the current rotation speed of the drum 30 without changing the rotation speed of the drum 30, and stops controlling the rotation speed of the drum 30.

Next, referring to FIG. 27, a method 1500 for the washing machine 1 to implement the falling motion of the laundry L will be described.

The washing machine 1 determines if a target motion is the falling motion (1510).

To maximize the washing performance and protect the laundry, the washing machine 1 may use various motions of the laundry L depending on the amount, material, etc., of the laundry L. The falling motion is known to be a motion of the laundry L having the best washing performance.

Accordingly, to maximize the washing performance, the washing machine 1 may include the falling motion in motions of the laundry L to wash the laundry L.

If the target motion of the laundry L is the falling motion (YES of 1510), the washing machine 1 rotates the drum 30 at a second initial speed (1520).

The second initial speed refers to a rotation speed of the drum 30 doing the falling motion based on a case where an amount of the laundry L corresponds to a standard amount often used by the user and a material of the laundry L is what is often washed by the user.

For example, the second initial speed may be set to about 45 rpm.

Furthermore, the washing machine 1 may change the second initial speed based on an amount of the laundry L. For example, the second initial speed may be increased if the laundry L is large in amount, and the second initial speed may be decreased if the laundry L is small in amount.

After rotating the drum 30 at the second initial speed, the washing machine 1 determines if the first detection time duty ratio of the first laundry detection sensor 133 is equal to or greater than the third reference value (1530).

As described above, the washing machine 1 may determine a motion of the laundry L based on outputs of the first and second laundry detection sensors 133 and 135. Specifically, the washing machine 1 may determine if the motion of the laundry L is the falling motion, based on whether the first detection time duty ratio of the first laundry detection sensor 133 is equal to or greater than the third reference value.

The third reference value may be set to 10%, as described above.

If the first detection time duty ratio is less than the third reference value (NO of 1530), the washing machine 1 increases the rotation speed of the drum 1 (1540).

If the first detection time duty ratio is less than the third reference value, the washing machine 1 may determine that the motion of the laundry L is the rolling motion. In other words, the washing machine 1 may determine that the laundry L is moving as if rolling on the bottom of the drum 30.

In response, the washing machine 1 may increase the rotation speed of the drum 30 to lift the laundry L up the drum 30.

After that, the washing machine 1 repeats comparison of the first detection time duty ratio and the third reference value.

If the detection time duty ratio is equal to or greater than the third reference value (YES of 1530), the washing machine 1 determines if a ratio of the first detection time to the second detection time (first detection time/second detection time) is less than the fourth reference value (1550).

As described above, a difference between the first detection time and the second detection time during the rotation motion is greater than a difference between the first detection time and the second detection time during the rolling motion. As a result, a ratio of the first detection time to the second detection time (first detection time/second detection time) rapidly increases between the falling and rotation motions.

Using this, the washing machine 1 may determine whether the motion of the laundry L is the falling motion or the rotation motion, based on the ratio of the first detection time to the second detection time (first detection time/second detection time).

Specifically, the washing machine 1 may determine the motion of the laundry L to be the falling motion if the ratio of the first detection time to the second detection time (first detection time/second detection time) is less than the fourth reference value, and the washing machine 1 may determine the motion of the laundry L to be the rotation motion if the ratio of the first detection time to the second detection time (first detection time/second detection time) is equal to or greater than the fourth reference value.

The fourth reference value may be set to 1.5, as described above.

If the ratio of the first detection time to the second detection time (first detection time/second detection time) is equal to or greater than the fourth reference value (NO of 1550), the washing machine 1 decreases the rotation speed of the drum 30 (1560).

If the ratio of the first detection time to the second detection time (first detection time/second detection time) is equal to or greater than the fourth reference value, the washing machine 1 may determine the motion of the laundry L to be the rotation motion. In other words, the washing machine 1 may determine that the laundry L is rotated along with the drum 30 while being pushed close to the inner circumferential face of the drum 30.

In response, the washing machine 1 may decrease the rotation speed of the drum 30 for the laundry L not to be rotated along with the drum 30 but to fall from an upper part of the drum 30 to the bottom.

After that, the washing machine 1 repeats comparison of the ratio of the first detection time to the second detection time (first detection time/second detection time) and the fourth reference value.

If the ratio of the first detection time to the second detection time (first detection time/second detection time) is less than the fourth reference value (YES of 1550), the washing machine 1 stops controlling the rotation speed of the drum 30.

If the first detection time duty ratio is equal to or greater than the third reference value and the ratio of the first detection time to the second detection time (first detection time/second detection time) is less than the fourth reference value, the washing machine 1 may determine the motion of the laundry L to be the falling motion. In other words, the washing machine 1 may determine that the laundry L is falling to the bottom of the drum 30 from an upper part of the drum 30.

Accordingly, the washing machine 1 maintains the current rotation speed of the drum 30 without changing the rotation speed of the drum 30, and stops controlling the rotation speed of the drum 30.

Lastly, referring to FIG. 28, a method 1600 for the washing machine 1 to implement the rotation motion of the laundry L will be described.

The washing machine 1 determines if a target motion is the rotation motion (1610).

To maximize the washing performance and protect the laundry, the washing machine 1 may use various motions of the laundry L depending on the amount, material, etc., of the laundry L.

The laundry L is often not mixed together by the rotation of the drum 30 but remains in the initial position if the laundry L is large in amount. In other words, the laundry L is stuck together and not easily separated.

Since the rotation motion allows the laundry L to be separated from each other and rotated along with the inner circumferential face, it enables the laundry L to be mixed together. In other words, it may cause the laundry L to be shifted to another position.

For the same reason, if the laundry L is large in amount, the washing machine 1 may include the rotation motion in motions of the laundry L to wash the laundry L to maximize the washing performance.

If the target motion of the laundry L is the rotation motion (YES of 1610), the washing machine 1 rotates the drum 30 at a third initial speed (1620).

The third initial speed refers to a rotation speed of the drum 30 doing the rotation motion based on a case where an amount of the laundry L corresponds to a standard amount often used by the user and a material of the laundry L is what is often washed by the user.

For example, the third initial speed may be set to about 60 rpm.

Furthermore, the washing machine 1 may change the third initial speed based on an amount of the laundry L. For example, the third initial speed may be increased if the laundry L is large in amount, and the third initial speed may be decreased if the laundry L is small in amount.

After rotating the drum 30 at the third initial speed, the washing machine 1 determines if the first detection time duty ratio of the first laundry detection sensor 131 is equal to or greater than the third reference value (1630).

As described above, the washing machine 1 may determine a motion of the laundry L based on outputs of the first and second laundry detection sensors 133 and 135. Specifically, the washing machine 1 may determine if the motion of the laundry L is the falling motion, based on whether the first detection time duty ratio of the first laundry detection sensor 133 is equal to or greater than the third reference value.

The third reference value may be set to 10%, as described above.

If the first detection time duty ratio is less than the third reference value (NO of 1630), the washing machine 1 increases the rotation speed of the drum 1 (1640).

If the first detection time duty ratio is less than the third reference value, the washing machine 1 may determine that the motion of the laundry L is the rolling motion. In other words, the washing machine 1 may determine that the laundry L is moving as if rolling on the bottom of the drum 30.

In response, the washing machine 1 may increase the rotation speed of the drum 30 for the laundry L to be rotated along with the drum 30.

After that, the washing machine 1 repeats comparison of the first detection time duty ratio and the third reference value.

If the detection time duty ratio is equal to or greater than the third reference value (YES of 1630), the washing machine 1 determines if a ratio of the first detection time to the second detection time (first detection time/second detection time) is equal to or greater than the fourth reference value (1650).

The washing machine 1 may determine whether the motion of the laundry L is the falling motion or the rotation motion, based on the ratio of the first detection time to the second detection time (first detection time/second detection time).

Specifically, the washing machine 1 may determine the motion of the laundry L to be the falling motion if the ratio of the first detection time to the second detection time (first detection time/second detection time) is less than the fourth reference value, and the washing machine 1 may determine the motion of the laundry L to be the rotation motion if the ratio of the first detection time to the second detection time (first detection time/second detection time) is equal to or greater than the fourth reference value.

The fourth reference value may be set to 1.5, as described above.

If the ratio of the first detection time to the second detection time (first detection time/second detection time) is less than the fourth reference value (NO of 1650), the washing machine 1 increases the rotation speed of the drum 30 (1660).

If the ratio of the first detection time to the second detection time (first detection time/second detection time) is less than the fourth reference value, the washing machine 1 may determine the motion of the laundry L to be the falling motion. In other words, the washing machine 1 may determine that the laundry L is falling to the bottom of the drum 30 from an upper part of the drum 30 while the drum 30 is rotated.

In response, the washing machine 1 may increase the rotation speed of the drum 30 for the laundry L to be rotated along with the drum 30 without falling to the bottom from an upper part of the drum 30.

After that, the washing machine 1 repeats comparison of the ratio of the first detection time to the second detection time (first detection time/second detection time) and the fourth reference value.

If the ratio of the first detection time to the second detection time (first detection time/second detection time) is equal to or greater than the fourth reference value (YES of 1650), the washing machine 1 stops controlling the rotation speed of the drum 30.

If the first detection time duty ratio is equal to or greater than the third reference value and the ratio of the first detection time to the second detection time (first detection time/second detection time) is equal to or greater than the fourth reference value, the washing machine 1 may determine the motion of the laundry L to be the rotation motion. In other words, the washing machine 1 may determine that the laundry L is rotated along with the drum 30.

Accordingly, the washing machine 1 maintains the current rotation speed of the drum 30 without changing the rotation speed of the drum 30, and stops controlling the rotation speed of the drum 30.

Configuration of the motion detector 130, method for identifying motions of the laundry L, and method for implementing a motion of the laundry L in the case that the motion detector 130 includes the first and second laundry detection sensors 133 and 135 were described above.

However, the configuration and operation of the motion detector 130 is not limited thereto, but the motion detector 130 may include any other configuration and perform any other operation for detecting the motion of the laundry L.

Configuration of the washing machine 1 and operation of individual components included in the washing machine 1 were described above.

Operation of the washing machine 1 will now be described.

FIG. 29 shows operation of a washing machine, according to an embodiment of the present disclosure.

Referring to FIG. 29, operation 2000 of the washing machine 1 will be briefly described.

The washing machine 1 determines whether to wash the laundry (2010).

The user may input information about settings of washing, such as washing course, rinsing course, and spin-drying course through the user interface 120, and then input a washing activate command to start washing the laundry through the user interface 120.

It means a washing method to show an optimum washing performance according to types and materials of the laundry.

If it is determined to wash the laundry (YES of 2010), the washing machine 1 detects an amount of laundry contained in the drum 30 (2020).

The washing machine 300 may detect the amount of laundry in various ways.

For example, the amount of laundry may be detected by rotating the drum 30 at a predetermined rotation speed and detecting a magnitude of a driving current applied to the driving motor 40 to rotate the drum 30.

In another example, the amount of laundry may be detected by accelerating the drum 330 from a first rotation speed to a second rotation speed and calculating a total sum of the driving currents applied to the driving motor 341.

In still another example, the washing machine 1 may detect the amount of laundry by installing an additional component to directly detect the weight of the drum 30 and detecting a change in weight of the drum 30.

After detecting the amount of the laundry, the washing machine 1 may sequentially perform a washing course 2100, a rinsing course 2200, and a spin-drying course 2300.

The washing course 2100 may include water supplying operation 2110 to supply water to the tub 20, washing operation 2120 to wash the laundry contained in the drum 30, drain operation 2130 to discharging water from the tub 20, and midway spin-drying operation 2140 to separate water from the laundry contained in the drum 30.

During the water supplying operation 2110, the washing machine 1 may open the water valve 52 of the water supplier 50 to supply water to the tub 20. Water is supplied to the tub 20 via the detergent supplier 70 once the water valve 52 is opened.

In this regard, the washing machine 1 may activate the detergent supplier 70 to supply a detergent along with the water if the user selects automatic detergent supply. The detergent is supplied with the water while the water is passing through the detergent supplier 70 if the user does not select automatic detergent supply.

The washing machine 1 determines whether water supply has been completed based on the water level in the tub 20 detected by the water level detector 80, and closes the water valve 52 if it is determined that water supply has been completed.

During the washing operation 2120, the washing machine 1 rotates the drum 30 clockwise and counterclockwise to separate stains from the laundry.

For example, the washing machine 1 may determine a target motion of the laundry according to a course of washing set by the user, and control the rotation speed of the drum 30 based on detection results from the motion detector 130 for the motion of the laundry to be the target motion.

Consequently, during the washing operation 2120, the laundry may move the aforementioned rolling motion, falling motion, or rotation motion.

During the drain operation 2130, the washing machine 1 may activate the drain pump 62 of the drain part 60 to discharge the water contained in the tub 20. The water is discharged out of the washing machine 1 from the tub 20 once the drain pump 62 is activated.

The washing machine 1 determines if water drainage has been completed based on the water level in the tub 20 detected by the water level detector 80, and stops activating the drain pump 62 if it is determined that water drainage has been completed.

During the midway spin-drying operation 2140, the washing machine 1 rotates the drum 30 at a high speed to separate water from the laundry. Due to the centrifugal force from the high-speed rotation of the drum 30, the water absorbed in the laundry is separated from the laundry and released out of the drum 30 through the through-hole 31*a* of the drum 30.

Through the washing course 2100 as described above, the washing machine 1 may separate a stain from the laundry.

The rinsing course 2200 may include water supplying operation 2210 to supply water to the tub 20, rinsing operation 2220 to rinse the laundry contained in the drum 30, drain operation 2230 to discharging water from the tub 20, and midway spin-drying operation 2240 to separate water from the laundry contained in the drum 30.

The washing machine 1 may repeat the water supply operation 2210, rinsing operation 2220, drain operation 2230, and midway spin-drying operation 2240 included in the rinsing course 2200 several times according to the number of rinsing times set by the user.

For example, if the user sets the number of rinsing times to 2, the washing machine 1 may repeat the water supply operation 2210, rinsing operation 2220, drain operation 2230, and midway spin-drying operation 2240 twice.

The water supply operation 2210, drain operation 2230, and midway spin-drying operation 2240 of the rinsing course 2200 are the same as the water supply operation 2110, drain operation 2130, and midway spin-drying operation 2140 of the washing course 2100, so the description thereof will be omitted.

During the rinsing operation 2220, the washing machine 1 rotates the drum 30 clockwise or counterclockwise to remove remaining detergent and stains separated from the laundry.

For example, the washing machine 1 may determine a target motion of the laundry for rinsing operation, and control the rotation speed of the drum 30 based on detection results from the motion detector 130 for the motion of the laundry to be the target motion.

Through the rinsing course 2200 as described above, the washing machine 1 may remove remaining detergent and stains separated from the laundry.

The spin-drying course 2300 may include an intermittent spin-drying operation 2310 for preparing for high-speed rotation of the drum 30, and a main spin-drying operation 2320 for rotating the drum at high speed to separate/remove water from the laundry.

During the intermittent spin-drying operation 2310, the washing machine 1 rotates the drum 30 at rotation speed of hundreds rpm. During the intermittent spin-drying operation 2310, the laundry is pushed close to the inner circumferential face of the drum 30, getting rid of unbalance that causes vibration of the drum 30.

During the main spin-drying operation 2320, the washing machine 1 rotates the drum 30 at rotation speed of a thousand rpm or more to separate/remove water from the laundry. Due to the centrifugal force from the high-speed rotation of the drum 30, the water absorbed in the laundry is separated from the laundry and released out of the drum 30 through the through-hole 31*a* of the drum 30.

The washing machine 1 washes the laundry by the aforementioned washing course 2100, rinsing course, spin-drying course 2300.

Operation of each of the washing course 2100, the rinsing course 2200, and the spin-drying course 2300 will now be described in detail.

FIG. 30 shows combinations of possible laundry motions during washing operation of a washing machine, according to an embodiment of the present disclosure, and FIGS. 31 to 39 show various motions of the laundry according to the combinations of laundry motions shown in FIG. 30. Furthermore, FIG. 40 shows washing performance according to various motions of the laundry.

As described above, the laundry L may show various motions during the washing operation 2120. For example, the laundry L may do the rolling motion, falling motion, and rotation motion.

Furthermore, during the washing operation 2120, the laundry L may show a single motion as well as a combination of various motions depending on a type and amount of the laundry L.

Specifically, the washing machine 1 may change the rotation speed of the drum 30 for the laundry L to show the rolling, falling, and rotation motions combined. In other words, the washing machine 1 may change the rotation speed of the drum 30 for the laundry L to show various motions shown in FIG. 30 depending on a course of washing.

First, the washing machine 1 may rotate the drum 30 such that the laundry L performs a first washing motion including only the falling motion. In other words, during the washing operation 2120, the laundry L may repeat motions of falling from the upper part of the drum 30 to the bottom.

In such a case that the laundry L shows a single motion, the washing machine 1 may only change the rotation direction of the drum 30 but maintain the rotation speed of the drum 30 to be constant.

Second, the washing machine 1 may rotate the drum 30 such that the laundry L performs a second washing motion including the rolling and falling motions. In other words, the laundry L may repeat motions of rolling on the bottom of the drum 30 and falling from the upper part of the drum 30 to the bottom through rotation of the drum 30, during the washing operation 2120.

Furthermore, the washing machine 1 may rotate the drum 30 such that the laundry L performs various second washing motions by combining the rolling motion and the falling motion in various ways.

For example, the washing machine 1 may rotate the drum 30 such that the laundry L alternately performs the rolling and falling motions, or rotate the drum 30 such that the laundry L performs the rolling motion twice and then the falling motion once. Furthermore, the washing machine 1 may rotate the drum 30 such that the laundry L performs the rolling motion once and then the falling motion twice, or rotate the drum 30 such that the laundry L performs the rolling motion twice and then the falling motion twice.

In such a case that the laundry L shows two or more motions, the washing machine 1 may not only change the rotation direction of the drum 30 but also change the rotation speed of the drum 30.

Third, the washing machine 1 may rotate the drum 30 such that the laundry L performs a third washing motion including the falling and rotation motions. In other words, the laundry L may repeat motions of falling from an upper part of the drum 30 to the bottom and being rotated while being pushed close to the inner circumferential face of the drum 30 through rotation of the drum 30, during the washing operation 2120.

Furthermore, the washing machine 1 may rotate the drum 30 such that the laundry L performs various third washing motions by combining the falling motion and the rotation motion in various ways.

Fourth, the washing machine 1 may rotate the drum 30 such that the laundry L performs a fourth washing motion including the rolling, falling, and rotation motions. In other words, the laundry L may repeat motions of rolling on the bottom of the drum 30, falling from an upper part of the drum 30 to the bottom and being rotated while being pushed close to the inner circumferential face of the drum 30 through rotation of the drum 30, during the washing operation 2120.

Furthermore, the washing machine 1 may rotate the drum 30 such that the laundry L performs various fourth washing motions by combining the rolling, falling and rotation motions in various ways.

For example, the washing machine 1 may rotate the drum 30 such that the laundry L performs the fourth washing motion in the sequence of rolling, falling, and rotation motions, or rotate the drum 30 such that the laundry L performs the fourth washing motion in the sequence of rolling, rotation, and falling motions. Furthermore, the washing machine 1 may rotate the drum 30 such that the laundry L performs the fourth washing motion in the sequence of falling, rolling, and rotation motions, or rotate the drum 30 such that the laundry L performs the fourth washing motion in the sequence of rotation, falling, and rolling motions.

Furthermore, the washing machine 1 may rotate the drum 30 such that the laundry L performs the fourth washing motion in the sequence of rolling, falling, rolling, and rotation motions, or rotate the drum 30 such that the laundry L performs the fourth washing motion in the sequence of falling, rolling, falling, and rotation motions. In addition, the washing machine 1 may rotate the drum 30 such that the laundry L performs the fourth washing motion in the sequence of rotation, rolling, rotation, and falling motions.

Fifth, the washing machine 1 may rotate the drum 30 such that the laundry L performs a fifth washing motion including only the rolling motion. In other words, during the washing operation 2120, the laundry L may repeat motions of rolling on the bottom of the drum 30 through rotation of the drum 30.

Sixth, the washing machine 1 may rotate the drum 30 such that the laundry L performs a sixth washing motion including the rolling and rotation motions. In other words, the laundry L may repeat motions of rolling on the bottom of the drum 30 and being rotated while being pushed close to the inner circumferential face of the drum 30 through rotation of the drum 30, during the washing operation 2120.

Furthermore, the washing machine 1 may rotate the drum 30 such that the laundry L performs various sixth washing motions by combining the rolling and rotation motions in various ways.

Seventh, the washing machine 1 may rotate the drum 30 such that the laundry L performs a seventh washing motion including only the rotation motion. In other words, the laundry L may repeat motions of being rotated while being pushed close to the inner circumferential face of the drum 30 through rotation of the drum 30, during the washing operation 2120.

The above 7 washing motions may be used in various ways depending on the amount, materials, and type of the laundry L.

First, if the amount of the laundry L is at an optimum level, the washing machine 1 may vary the motion of the laundry L in various ways focusing on the falling motion, thereby maximizing washing performance for the laundry L and showing uniform washing performance for the laundry L.

For example, the washing machine 1 may rotate the drum 30 such that the laundry L performs the fourth washing motion including the rolling, falling, and rotation motions, as shown in FIGS. 31 and 32.

Specifically, the washing machine 1 may rotate the drum 30 such that the laundry L repeats the fourth washing motion in the sequence of rolling, falling, and rotation motions, as shown in FIG. 31, or rotate the drum 30 such that the laundry L repeats the fourth washing motion in the sequence of rolling, rotation, falling and falling motions, as shown in FIG. 32.

As such, the washing machine 1 may improve washing performance for the laundry L by having the laundry L perform the falling motion, known to have the best washing efficiency, twice.

Furthermore, the washing machine 1 may disentangle and mix the laundry L by adding the rolling and rotation motions to the falling motion. By disentangling and mixing the laundry L, the washing machine 1 may have uniform washing performance for all the laundry.

Next, if there is a large amount of the laundry L, the washing machine 1 may have uniform washing performance for the laundry L by combining the falling and rotation motions.

In the case that the laundry L is large in amount, an empty space in the drum 30 is not sufficient for the laundry L to be easily mixed together. In other words, rotation of the drum 30 can merely makes the laundry L roll in the drum 30, but the laundry L placed in the center of a stack of the laundry and the laundry L placed around the stack of the laundry cannot shift to each other's position.

As a result, cleaning level of the washed laundry L may be different depending on points in the stack of the laundry.

Accordingly, the washing machine 1 may increase the frequency with which the rotation motion makes the laundry L separated from each other and pushed close to the inner circumferential face of the drum 30 if the laundry L is large in amount.

For example, the washing machine 1 may rotate the drum 30 such that the laundry L performs the third washing motion including the falling and rotation motions, as shown in FIGS. 33 and 34.

Specifically, the washing machine 1 may rotate the drum 30 such that the laundry L performs the third washing motion in the sequence of falling, and rotation motions, as shown in FIG. 33, or rotate the drum 30 such that the laundry L performs the third washing motion in the sequence of falling, falling, and rotation motions, as shown in FIG. 34.

As such, the washing machine 1 may uniformly improve the washing performance for the laundry L by adjusting portions of the falling and rotation motions to be almost equal.

Next, if the laundry L is clothing of a material vulnerable to physical impact, the washing machine 1 may minimize damage to the laundry L by combining the falling and rotation motions.

Since the laundry L of silk or wool material is weak to impact, there may be a concern that the laundry L is damaged by impact from the falling motion.

Accordingly, the washing machine 1 may exclude the falling motion to make the laundry L fall from an upper part of the drum 30 to the bottom if the laundry L is fragile.

For example, the washing machine 1 may rotate the drum 30 such that the laundry L performs the sixth washing motion including the rolling and rotation motions, as shown in FIGS. 35 and 36.

Specifically, the washing machine 1 may rotate the drum 30 such that the laundry L performs the sixth washing motion in the sequence of rolling and rotation motions, as shown in FIG. 35, or rotate the drum 30 such that the laundry L performs the sixth washing motion in the sequence of rolling, rolling, and rotation motions, as shown in FIG. 36.

As such, the washing machine 1 may minimize damage to the laundry L and improve washing performance for the laundry L by excluding the falling motion and performing only the rolling and rotation motions.

It was described above that if the amount of the laundry L is at an optimum level, the washing machine 1 maximizes the washing performance for the laundry L by changing the motion of the laundry L in various ways focusing on the falling motion.

It was also described that the washing machine 1 adds the rolling and rotation motions to the falling motion to change the motion of the laundry L in various ways. However, to change the motion of the laundry L in various ways focusing on the falling motion, the embodiment is not limited to the addition of the rolling and rotation motions.

The falling motion may be divided into a plurality of motions. For example, the falling motion may be divided into first to third falling motions based on the spot where the laundry L falls, as shown in FIG. 37.

The first falling motion may be a motion by which the laundry L falls from the third falling position FP3 (a position within a range of about 120 to 160 degrees from the bottom B of the drum) to the bottom of the drum 30, as shown in (a) of FIG. 37.

As such, in the case that the laundry L is doing the first falling motion, the detection time duty ratio representing a frequency with which the laundry detection sensor 131 detects the laundry L may be about 10% to 30%.

The second falling motion may be a motion by which the laundry L falls from the fourth falling position FP4 (a position within a range of about 160 to 200 degrees from the bottom B of the drum) to the bottom of the drum 30, as shown in (b) of FIG. 37.

As such, in the case that the laundry L is doing the second falling motion, the detection time duty ratio representing a frequency with which the laundry detection sensor 131 detects the laundry L may be about 30% to 50%.

Furthermore, the third falling motion may be a motion by which the laundry L falls from the fifth falling position FP5 (a position within a range of about 200 to 240 degrees from the bottom B of the drum) to the bottom of the drum 30, as shown in (c) of FIG. 37.

As such, in the case that the laundry L is doing the third falling motion, the detection time duty ratio representing a frequency with which the laundry detection sensor 131 detects the laundry L may be about 50% to 70%.

These numerical values, however, may vary by another factor, such as the size of the drum 30, without being limited thereto.

The washing machine 1 may further improve the washing performance by making the laundry L move the first, second, and third falling motions combined.

For example, the washing machine 1 may rotate the drum 30 such that the laundry L repeats the first, second, third, and fourth falling motions, as shown in FIG. 38.

Furthermore, the washing machine 1 may rotate the drum 30 such that the laundry L repeats the first, third, second, and second falling motions, as shown in FIG. 39.

As such, the washing machine 1 may further improve the washing performance and show uniform washing performance for the laundry L by dividing the falling motion into first, second, and third falling motions and combining the first, second, and third falling motions in various ways.

Referring to FIG. 40, washing performance DT1 resulting from washing the laundry L by varying the motion of the laundry L and washing performance DT2 resulting from washing the laundry L by fixing the motion of the laundry L will be compared. FIG. 40 shows washing performance for the laundry L based on a CU estimation scheme.

The CU estimation scheme estimates washing performance based on a difference in surface reflectivity between non-washed laundry and washed laundry. Specifically, a CU estimation value corresponds to an average value of the difference in surface reflectivity between non-washed laundry and washed laundry.

According to what is shown in FIG. 40, the occasion when the laundry L is washed by varying the motion of the laundry L has about two to three point more improved washing performance than the occasion when the laundry L is washed by fixing the motion of the laundry L. Furthermore, the about two to three point improvement in washing performance may even reduce time for washing by about 1.5 minute.

As such, if the laundry L is washed by varying the motion of the laundry L, washing performance may be improved and time for washing may be reduced compared to the occasion when the laundry L is washed by fixing the motion of the laundry L.

Change in motion of the laundry L during the washing operation 2120 was described above.

The rinsing operation 2230 will now be described.

As described above, the rinsing course 2200 may include the water supply operation 2210, rinsing operation 2220, drain operation 2230, and midway spin-drying operation 2240, and the rinsing course 2200 may repeat the water supply operation 2210, rinsing operation 2220, drain operation 2230, and midway spin-drying operation 2240 several times according to a selection of the user.

FIG. 41 shows a rinsing course of a conventional washing machine, and FIG. 42 shows motions of the laundry during a rinsing operation of the conventional washing machine.

Referring to FIG. 41, the conventional washing machine stops rotation of the drum and starts water supply, if the midway spin-drying of the washing course is finished. Once the water supply is finished, the conventional washing machine rotates the drum at 30 to 60 rpm for rinsing. Once the rinsing is finished, the conventional washing machine stops rotation of the drum and starts water supply. The conventional washing machine then rotates the drum at about 1,000 rpm for midway spin-drying.

The conventional washing machine repeats starting and stopping rotation of the drum for the midway spin-drying, and rotates the drum in the rinsing course at the similar rotation speed to that in the washing course.

As such, the conventional washing machine spends lots of time in the rinsing course by repeating starting and stopping rotation of the drum.

Furthermore, since the conventional washing machine rotates the drum at a similar low speed to that in the washing course, there is a concern that the laundry might not be sufficiently rinsed.

For example, as shown in FIG. 42, if a large amount of the laundry L is contained in the drum, some of the laundry L is positioned above the water level WL of the water for rinsing. The majority of the laundry L positioned around the center of the drum does not sufficiently come into contact with the water.

As a result, there may be a concern that some of the laundry L is not sufficiently rinsed.

FIG. 43 shows a rinsing course of a washing machine, according to an embodiment of the present disclosure, and FIG. 44 is an enlarged view of an area A of FIG. 43. FIG. 45 shows motions of the laundry during rinsing operation of a washing machine, according to an embodiment of the present disclosure.

Referring to FIGS. 43 and 44, the washing machine 1 performs the water supply operation 2210 and the rinsing operation 2220 without stopping rotation of the drum 30 after the midway spin-drying operation 2140 of the washing course 2100 is finished.

Specifically, after the midway spin-drying operation 2140 of the washing course 2100 is finished, the washing machine 1 opens the water valve 52 while slowing down the rotation speed of the drum 30. Water is supplied to the tub 20 and the drum 30 once the water valve 52 is opened, and the water valve 52 is closed if the water contained in the tub 20 reaches a water level for rinsing.

As such, the washing machine 1 may perform the water supply operation 2210 of the rinsing course 2200 while the drum 30 is rotated.

After that, the washing machine 1 performs the rinsing operation 2220 of the rinsing course 2200. Furthermore, during the rinsing operation 2220, the washing machine 1 may maintain the rotation speed of the drum 30 at about 200 rpm.

If the washing machine 1 maintains the rotation speed of the drum 30 at about 200 rpm or more, the laundry L is distributed on the inner circumferential face of the drum 30 and rotated along with the drum 30, as shown in FIG. 45. Accordingly, the height of the laundry L is lowered, and most of the laundry L may come into contact with water.

As a result, the whole laundry L may be sufficiently rinsed. Besides, if the drum 30 is rotated at 200 rpm or more, the quantity of motion of the rotation may increase, thereby improving rinsing performance compared to the conventional rinsing course.

The rotation speed of the drum 30 is maintained at 200 rpm for the rinsing operation 2220 in FIGS. 43 and 44, without being limited thereto.

The rotation speed of the drum 30 may be any rotation speed as long as it enables the laundry 30 to be distributed on the inner circumferential face of the drum 30 and rotated along with the drum 30. For example, about 100 rpm or more is enough for the rotation speed of the drum 30.

In other words, during the rinsing operation 2220, it is enough to maintain the rotation speed of the drum 30 to be more than a rotation speed to perform the aforementioned rotation motion. For this, the washing machine 1 may use the motion detector 130 to control the rotation speed of the drum 30 such that the motion of the laundry L is the rotation motion.

However, it is preferable to maintain the rotation speed of the drum 30 to be more than a resonance frequency to prevent vibration and noise due to the resonance.

Furthermore, the washing machine 1 may increase deceleration time of the drum 30 in order to secure enough time for rinsing operation 2230. For example, the washing machine 100 may slowly reduce the rotation speed of the drum 30 by reducing the rate at which the rotation speed of the drum 30 decreases (rotation deceleration/acceleration).

In addition, the washing machine 1 may maintain the rotation speed of the drum 30 to be a constant speed for a certain period of time in order to secure enough time for the rinsing operation 2230. For example, the rotation speed of the drum 30 may be maintained at 200 rpm for a certain period of time if the rotation speed of the drum 30 reaches about 200 rpm.

Such a rinsing operation 2220 may last for a predetermined rinsing time.

After the rinsing operation 2220 is finished, the washing machine 1 performs the drain operation 2230 and the midway spin-drying operation 2240 of the rinsing course 2200.

During the drain operation 2230, rotation of the drum 30 may not be stopped. For example, as shown in FIGS. 43 and 44, the rotation speed of the drum 30 may be increased during the drain operation 2230. In other words, the drain operation 2230 and the midway spin-drying operation 2240 may be performed simultaneously.

As such, by performing the drain operation 2230 and the midway spin-drying operation 2240 simultaneously, time to perform the drain operation 2230 and the midway spin-drying operation 2240 may be reduced.

However, it is not limited to increasing the rotation speed of the drum 30 during the drain operation 2230, and simultaneously performing the drain operation 2230 and the midway spin-drying operation 2240.

For example, in order to easily drain the water, the rotation speed of the drum 30 may be sufficiently reduced during the drain operation 2230.

In the rinsing course, the washing machine 1 may repeat the water supply operation 2210, rinsing operation 2220, drain operation 2230, and spin-drying operation 2240 several times.

As described above, the washing machine 1 may control the rotation speed of the drum 30 such that the laundry L is distributed on the inner circumferential face of the drum 30 and rotated along with the drum 30 during the rinsing operation 2220, and may consecutively perform the water supply operation 2210, rinsing operation 2220, drain operation 2230, and spin-drying operation 2240 without stopping the rotation of the drum 30 during the rinsing course 2200.

The spin-drying course 2300 will now be described.

After finishing the last rinsing operation 2220 of the rinsing course 2200, the washing machine 1 may skip the drain operation 2230 and the midway spin-drying operation 2240 and go directly to the spin-drying course 2300, as shown in FIG. 43.

During the spin-drying course 2300, the intermittent spin-drying operation 2310 for preparing for high-speed rotation of the drum 30 while changing the rotation speed of the drum 30 and the main spin-drying operation 2320 for rotating the drum at high speed to separate water from the laundry L may be performed.

However, it is not limited thereto, since the rotation speed of the drum 30 remains at a rotation speed of about 200 rpm or more during the last rinsing operation 2220 of the rinsing course 2200, the washing machine 1 may skip the intermittent spin-drying operation 2310 and perform the main spin-drying operation 2320 right after the rinsing operation 2220.

As described above, the washing machine 1 may include the motion detector 130 to control the motion of the laundry L.

Furthermore, the washing machine 1 may improve the washing performance and wash the entire laundry L uniformly by changing the motion of the laundry L in various ways during the washing course 2100.

In addition, the washing machine 1 may improve the rinsing performance and rinse the entire laundry L sufficiently by rotating the drum 30 at a relatively fast speed without stopping rotation of the drum 30 during the rinsing course 2200.

Several embodiments have been described, but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

The invention claimed is:

1. A washing machine comprising:

a cabinet on which an opening is formed;

a door arranged to close the opening;

a drum rotationally arranged in the cabinet to contain laundry;

a motion detector comprising a laundry detection sensor installed in an upper part of the door, where the laundry detection sensor is configured to output a signal corresponding to a motion of the laundry in the drum; and a controller configured to control rotation speed of the drum such that the laundry moves in a predetermined motion, based on the signal.

2. The washing machine of claim 1, wherein the laundry detection sensor is installed in the upper part of the door and is offset from a vertical center line of the door.

3. The washing machine of claim 2, wherein the laundry detection sensor is configured to emit at least one of infrared rays, laser, radio waves, ultrasounds, and acoustic waves to the inside of the drum, and receive at least one of infrared rays, laser, radio waves, ultrasounds, and acoustic waves reflected from the laundry, and the controller is configured to determine a motion of the laundry based on at least one of infrared rays, laser, radio waves, ultrasounds, and acoustic waves received by the laundry detection sensor.

4. The washing machine of claim 3, wherein the controller is configured to control rotation speed of the drum based on detection time for which the laundry detection sensor receives at least one of the reflected infrared rays, laser, radio waves, ultrasounds, and acoustic waves.

5. The washing machine of claim 1, wherein the motion detector further comprises another laundry detection sensor installed in approximately the center of the door, and the other laundry detection sensor is configured to output another signal corresponding to a motion of the laundry in the drum, and wherein the controller is configured to control rotation speed of the drum such that the laundry moves in the predetermined motion, based on the signal and the other signal.

6. The washing machine of claim 5, wherein the laundry detection sensor and the other laundry detection sensor are configured to emit at least one of infrared rays, laser, radio waves, ultrasounds, and acoustic waves to the inside of the drum, and receive at least one of infrared rays, laser, radio waves, ultrasounds, and acoustic waves reflected from the laundry, and the controller is configured to determine a motion of the laundry based on at least one of infrared rays, laser, radio waves, ultrasounds, and acoustic waves received by the laundry detection sensor and the other laundry detection sensor.

7. The washing machine of claim 6, wherein the controller is configured to control rotation speed of the drum based on a first detection time for which the laundry detection sensor receives at least one of the infrared rays, laser, radio waves, ultrasounds, and acoustic waves and a second detection time for which the other laundry detection sensor receives at least one of the infrared rays, laser, radio waves, ultrasounds, and acoustic waves.

8. The washing machine of claim 7, wherein the controller is configured to control rotation speed of the drum based on a ratio of the first detection time and the second detection time.

9. The washing machine of claim 1, wherein the controller is configured to change rotation speed of the drum such that the laundry moves in at least two different motions during a washing course.

10. The washing machine of claim 9, wherein the controller is configured to change rotation speed of the drum such that the laundry moves in different motions depending on a quantity of the laundry.

11. The washing machine of claim 9, wherein the controller is configured to change rotation speed of the drum such that the laundry moves in different motions depending on materials of the laundry.

12. The washing machine of claim 1, wherein the controller is configured to control rotation speed of the drum such that the laundry is rotated along with the drum while being pushed close to an inner circumferential face of the drum during a rinsing course.

13. The washing machine of claim 12, further comprising a water supplier configured to supply water to the drum, wherein the controller is configured to control the water supplier to supply water to the drum while rotation speed of the drum is being reduced.

14. The washing machine of claim 12, further comprising a drain part configured to drain water contained in the drum, wherein the controller is configured to control the drain part to drain water contained in the drum while rotation speed of the drum is being increased.

15. A method for controlling a washing machine including a cabinet on which an opening is formed and a door arranged to close the opening, the method comprising:

rotating a drum, which is rotationally arranged in the cabinet to contain laundry;

detecting, by a laundry detection sensor, a motion of the laundry, wherein the laundry detection sensor is installed in an upper part of the door; and controlling rotation speed of the drum based on the detected motion such that the laundry moves in a predetermined motion.

16. The method of claim 15, wherein the detecting of the motion of the laundry comprises:

emitting at least one of infrared rays, laser, radio waves, ultrasound, and acoustic waves to the inside of the drum;

receiving at least one of infrared rays, laser, radio waves, ultrasound, and acoustic waves reflected from the laundry; and determining a motion of the laundry based on a reception time for at least one of the received infrared rays, laser, radio waves, ultrasound, and acoustic waves.

17. The method of claim 15, wherein the controlling of the rotation speed of the drum comprises changing rotation speed of the drum such that the laundry moves in at least two different motions.

18. The method of claim 17, wherein the controlling of the rotation speed of the drum comprises changing rotation speed of the drum such that the laundry moves in different motions depending on a quantity of the laundry.

19. The method of claim 17, wherein the controlling of the rotation speed of the drum comprises changing rotation speed of the drum such that the laundry moves in different motions depending on materials of the laundry.

20. The method of claim 16, wherein the controlling of the rotation speed of the drum comprises controlling rotation speed of the drum such that the laundry is rotated along with the drum while being pushed close to an inner circumferential face of the drum during a rinsing course.

* * * * *